US007764232B2

(12) United States Patent
Achour et al.

(10) Patent No.: US 7,764,232 B2
(45) Date of Patent: Jul. 27, 2010

(54) ANTENNAS, DEVICES AND SYSTEMS BASED ON METAMATERIAL STRUCTURES

(75) Inventors: Maha Achour, San Diego, CA (US); Ajay Gummalla, San Diego, CA (US); Marin Stoytchev, San Diego, CA (US); Franz Birkner, Encinitas, CA (US)

(73) Assignee: Rayspan Corporation, San Diego, CA (US)

( * ) Notice: Subject to any disclaimer, the term of this patent is extended or adjusted under 35 U.S.C. 154(b) by 719 days.

(21) Appl. No.: 11/741,674

(22) Filed: Apr. 27, 2007

(65) Prior Publication Data

US 2008/0258981 A1 Oct. 23, 2008

Related U.S. Application Data

(60) Provisional application No. 60/795,845, filed on Apr. 27, 2006, provisional application No. 60/840,181, filed on Aug. 25, 2006, provisional application No. 60/826,670, filed on Sep. 22, 2006.

(51) Int. Cl.
*H01Q 1/38* (2006.01)
*H01Q 15/02* (2006.01)

(52) U.S. Cl. ..... 343/700 MS; 343/909

(58) Field of Classification Search ..... None
See application file for complete search history.

(56) References Cited

U.S. PATENT DOCUMENTS

| | | | | |
|---|---|---|---|---|
| 5,511,238 | A | 4/1996 | Bayraktaroglu | |
| 6,366,254 | B1 | 4/2002 | Sievenpiper et al. | |
| 6,512,494 | B1 | 1/2003 | Diaz et al. | |
| 6,525,695 | B2 | 2/2003 | McKinzie, III | |
| 6,545,647 | B1 | 4/2003 | Sievenpiper et al. | |
| 6,842,140 | B2 | 1/2005 | Killen et al. | |
| 6,859,114 | B2 | 2/2005 | Eleftheriades et al. | |
| 6,897,831 | B2 * | 5/2005 | McKinzie et al. | 343/909 |
| 6,906,674 | B2 * | 6/2005 | McKinzie et al. | 343/767 |
| 6,943,731 | B2 | 9/2005 | Killen et al. | |
| 6,958,729 | B1 | 10/2005 | Metz | |
| 7,068,234 | B2 | 6/2006 | Sievenpiper | |
| 7,071,889 | B2 * | 7/2006 | McKinzie et al. | 343/756 |
| 7,205,941 | B2 | 4/2007 | Wang et al. | |
| 7,215,007 | B2 | 5/2007 | McKinzie, III et al. | |
| 7,256,753 | B2 | 8/2007 | Werner et al. | |
| 7,330,090 | B2 | 2/2008 | Itoh et al. | |

(Continued)

FOREIGN PATENT DOCUMENTS

| | | |
|---|---|---|
| KR | 1020030086030 | 11/2003 |

(Continued)

OTHER PUBLICATIONS

Caloz and Itoh, *Electromagnetic Metamaterials: Transmission Line Theory and Microwave Applications*, John Wiley & Sons (2006).

(Continued)

*Primary Examiner*—Trinh V Dinh

(57) ABSTRACT

Techniques, apparatus and systems that use one or more composite left and right handed (CRLH) metamaterial structures in processing and handling electromagnetic wave signals. Antenna, antenna arrays and other RF devices can be formed based on CRLH metamaterial structures. The described CRLH metamaterial structures can be used in wireless communication RF front-end and antenna sub-systems.

6 Claims, 34 Drawing Sheets

U.S. PATENT DOCUMENTS

| | | | | |
|---|---|---|---|---|
| 7,358,915 | B2 | 4/2008 | Legay et al. | |
| 7,391,288 | B1 | 6/2008 | Itoh et al. | |
| 7,429,961 | B2 | 9/2008 | Sievenpiper et al. | |
| 7,446,712 | B2 | 11/2008 | Itoh et al. | |
| 7,463,213 | B2 | 12/2008 | Nakano et al. | |
| 7,592,957 | B2 * | 9/2009 | Achour et al. | 343/700 MS |
| 2003/0011522 | A1 * | 1/2003 | McKinzie et al. | 343/700 MS |
| 2004/0075617 | A1 | 4/2004 | Lynch et al. | |
| 2004/0227668 | A1 | 11/2004 | Sievenpiper | |
| 2005/0225492 | A1 | 10/2005 | Metz | |
| 2005/0253667 | A1 | 11/2005 | Itoh et al. | |
| 2008/0001684 | A1 | 1/2008 | Itoh et al. | |
| 2008/0048917 | A1 | 2/2008 | Achour et al. | |
| 2008/0204327 | A1 | 8/2008 | Lee et al. | |

FOREIGN PATENT DOCUMENTS

| | | |
|---|---|---|
| WO | 2007127955 | 11/2007 |

OTHER PUBLICATIONS

Gesbert, D., et al., "From Theory to Practice: An Overview of MIMO Space-Time Coded Wireless Systems," *IEEE Journal Selected Areas in Communications*, 21(3):281-302, Apr. 2003.

Itoh, T., "Invited paper: Prospects for Metamaterials," *Electronics Letters*, 40(16):972-973, Aug. 2004.

Jiang, J.-S., et al., "Comparison of Beam Selection and Antenna Selection Techniques in Indoor MIMO Systems at 5.8 GHz," *Proceedings Radio and Wireless Conference* (*RAWCON*), pp. 179-182, Aug. 2003.

Lai, A., et al., "Analysis and Design of Left-Handed Metamaterial Lenses Using Ansoft HFSS," *UCLA 2005 Annual Research Review, Microwave Electronics Lab*, pp. 1-8, Oct. 2005.

Lai, A., et al., "Infinite Wavelength Resonant Antennas with Monopolar Radiation Pattern Based on Periodic Structures," *IEEE Transactions on Antennas and Propagation*, 55(3):868-876, Mar. 2007.

Pozar, D.M., *Microwave Engineering*, 3rd Ed., John Wiley & Sons, pp. 318-323 & 370, 2005.

Sievenpiper, "High-Impedance Electromagnetic Surfaces," Ph.D. Dissertation, University of California, Los Angeles, 1999.

Waldschmidt, C., et al., "Compact Wide-Band Multimode Antennas for MIMO and Diversity," *IEEE Transactions on Antennas and Propagation*, 52(8):1963-1969, Aug. 2004.

Waldschmidt, C., et al., "Complete RF System Model for Analysis of Compact MIMO Arrays," *IEEE Transactions on Vehicular Technology*, 53(3):579-586, May 2004.

Waldschmidt, C., et al., "Handy MIMO," *IEEE Communications Engineer*, 3(1):22-25, Feb./Mar. 2005.

Korean Intellectual Property Office search report dated Mar. 12, 2010 for Korean Patent Application No. 2008-7028654 (related to International Patent Application No. PCT/US07/67696, filed Apr. 27, 2007). 4 Pages.

Office Action from Taiwan Patent Office dated Apr. 7, 2010 in Taiwanese Patent Application No. 096115082 (related to International Patent Application No. PCT/US07/67696, filed Apr. 27, 2007). 11 Pages.

Lai, Anthony, et al. "Composite Right/Left-Handed Transmission Line Metamaterials." IEEE Microwave Magazine, Sep. 2004. pp. 34-50.

Lee, Cheng-Jung, et al. "Design of resonant small Antenna Using Composite Right/Left-Handed Transmission Lines." IEEE Antennas and Propagation Society International Symposium, Jul. 2005. pp. 218-221.

Lim, Sungjoon, et al. "A Reflecto-Directive System Using a Composite Right/Left-Handed (CRLH) Leaky-Wave Antenna and Heterodyne Mixing." IEEE Microwave and Wireless Components Letters. vol. 14, No. 4. Apr. 2004. pp. 183-185.

* cited by examiner

Composite ($\beta=\beta_L+\beta_R$) Left and Right Handed Metamaterial Dispersion Diagram HFSS Model - Top Layer HFSS Model - Bottom Layer

ANTENNAS, DEVICES AND SYSTEMS BASED ON METAMATERIAL STRUCTURES

PRIORITY CLAIMS AND RELATED APPLICATIONS

This application claims the benefits of the following U.S. Provisional Patent Applications:

1. Ser. No. 60/795,845 entitled "Compact Multiple Input Multiple Output (MIMO) Antenna Systems Using Metamaterials" and filed on Apr. 27, 2006;
2. Ser. No. 60/840,181 entitled "Broadband and Compact Multiband Metamaterial Structures and Antennas" and filed on Aug. 25, 2006; and
3. Ser. No. 60/826,670 entitled "Advanced Metamaterial Antenna Sub-Systems" and filed on Sep. 22, 2006.

The disclosures of the above applications are incorporated by reference as part of the specification of this application.

BACKGROUND

This application relates to metamaterial (MTM) structures and their applications.

The propagation of electromagnetic waves in most materials obeys the right handed rule for the (E,H,β) vector fields, where E is the electrical field, H is the magnetic field, and β is the wave vector. The phase velocity direction is the same as the direction of the signal energy propagation (group velocity) and the refractive index is a positive number. Such materials are "right handed" (RH). Most natural materials are RH materials. Artificial materials can also be RH materials.

A metamaterial is an artificial structure. When designed with a structural average unit cell size p much smaller than the wavelength of the electromagnetic energy guided by the metamaterial, the metamaterial can behave like a homogeneous medium to the guided electromagnetic energy. Different from RH materials, a metamaterial can exhibit a negative refractive index where the phase velocity direction is opposite to the direction of the signal energy propagation where the relative directions of the (E,H,β) vector fields follow the left handed rule. Metamaterials that support only a negative index of refraction are "left handed" (LH) metamaterials.

Many metamaterials are mixtures of LH metamaterials and RH materials and thus are Composite Left and Right Handed (CRLH) metamaterials. A CRLH metamaterial can behave like a LH metamaterials at low frequencies and a RH material at high frequencies. Designs and properties of various CRLH metamaterials are described in, Caloz and Itoh, "Electromagnetic Metamaterials: Transmission Line Theory and Microwave Applications," John Wiley & Sons (2006). CRLH metamaterials and their applications in antennas are described by Tatsuo Itoh in "Invited paper: Prospects for Metamaterials," Electronics Letters, Vol. 40, No. 16 (August, 2004).

CRLH metamaterials can be structured and engineered to exhibit electromagnetic properties that are tailored for specific applications and can be used in applications where it may be difficult, impractical or infeasible to use other materials. In addition, CRLH metamaterials may be used to develop new applications and to construct new devices that may not be possible with RH materials.

SUMMARY

This application describes, among others, Techniques, apparatus and systems that use one or more composite left and right handed (CRLH) metamaterial structures in processing and handling electromagnetic wave signals. Antenna, antenna arrays and other RF devices can be formed based on CRLH metamaterial structures. For example, the described CRLH metamaterial structures can be used in wireless communication RF front-end and antenna sub-systems.

In one implementation, a device is described to include antenna elements spaced from one another and structured to form a composite left and right handed (CRLH) metamaterial structure. Each antenna element is of a dimension of one tenth of a wavelength of a signal in resonance with the CRLH metamaterial structure and two adjacent antenna elements are spaced from each other by one quarter of the wavelength or less.

In another implementation, a device includes an antenna formed on a substrate and including unit cells structured to form a composite left and right handed (CRLH) metamaterial structure, and an RF circuit element formed on the substrate in a second CRLH metamaterial structure and coupled to the antenna.

In another implementation, a device includes an antenna array formed on a substrate and comprising antenna elements. Each antenna element is structured to include unit cells to form a composite left and right handed (CRLH) metamaterial structure. Signal filters are formed on the substrate and each signal filter is coupled to a signal path of a respective antenna element of the antenna array. This device also includes signal amplifiers formed on the substrate where each signal amplifier is coupled to a signal path of a respective antenna element of the antenna array. An analog signal processing circuit is formed on the substrate and coupled to the antenna array via the signal filters and the signal amplifiers. The analog signal processing circuit is operable to process signals directed to or received from the antenna array.

In another implementation, a device includes a dielectric substrate having a first surface on a first side and a second surface on a second side opposing the first side; conductive patches formed on the first surface and separated from one another; a ground conductive layer formed on the second surface; conductive via connectors formed in the substrate to connect the conductive patches to the ground conductive layer, respectively, to form unit cells each comprising a volume having a respective conductive patch on the first surface, and a respective via connector connecting the respective conductive path to the ground conductive layer; and a conductive feed line having a distal end located close to and electromagnetically coupled to a conductive patch among the conductive patches. The device is structured to form a composite left and right handed (CRLH) metamaterial structure from the unit cells, and each unit cell has a dimension not greater than one sixth of a wavelength of a signal in resonance with the CRLH metamaterial structure.

In another implementation, a device includes a dielectric substrate having a first surface on a first side and a second surface on a second side opposing the first side; conductive patches formed on the first surface and separated from one another; a ground conductive layer formed on the second surface; and conductive via connectors formed in the substrate to connect the conductive patches to the ground conductive layer, respectively, to form a plurality of unit cells. Each unit cell includes a volume having a respective conductive patch on the first surface, and a respective via connector connecting the respective conductive path to the ground conductive layer. The device is structured to form a composite left and right handed (CRLH) metamaterial structure from the unit cells, and the ground conductive layer is patterned to have a dimension underneath a respective conductive patch to be less than a dimension of the respective conductive patch.

In another implementation, a device includes a dielectric substrate having a first surface on a first side and a second surface on a second side opposing the first side; conductive patches formed on the first surface and separated from one another to form a two-dimensional array; a conductive feed line formed on the first surface and electromagnetically coupled to one of said conductive patches; a ground conductive layer formed on the second surface; and conductive via connectors formed in the substrate to connect the conductive patches to the ground conductive layer, respectively, to form unit cells in a two-dimensional array which exhibits a spatial anisotropy. Each unit cell includes a volume having a respective conductive patch on the first surface, and a respective via connector connecting the respective conductive path to the ground conductive layer. The device is structured to form a composite left and right handed (CRLH) metamaterial structure from the unit cells, and the conductive feed line is coupled to a unit cell that is off a symmetric position of the two-dimensional array to excite two modes at two different frequencies.

In another implementation, a device includes a dielectric substrate having a first surface on a first side and a second surface on a second side opposing the first side; conductive patches formed on the first surface and separated from one another to form a two-dimensional array; a first conductive feed line formed on the first surface and electromagnetically coupled to one of said conductive patches that is along a central symmetric line of the two-dimensional array along a first direction; a second conductive feed line formed on the first surface and electromagnetically coupled to one of said conductive patches that is along a central symmetric line of the two-dimensional array along a second direction; a ground conductive layer formed on the second surface; and conductive via connectors formed in the substrate to connect the conductive patches to the ground conductive layer, respectively, to form unit cells in a two-dimensional array. Each unit cell include a volume having a respective conductive patch on the first surface, and a respective via connector connecting the respective conductive path to the ground conductive layer. The device is structured to form a composite left and right handed (CRLH) metamaterial structure from the unit cells, and the CRLH metamaterial structure formed by the unit cells is spatially anisotropic to support two modes at two different frequencies that are in the first feed line and the second feed line, respectively.

In another implementation, a device includes a metamaterial antenna comprising a dielectric substrate, a common conductive layer formed on one side of the dielectric substrate; an array of conductive pads spaced from one another on the other side of and in contact with the dielectric substrate, and conductive via connectors respectively connecting the conductive pads to the common conductive layer. The metal material antenna is structured to exhibit a first resonance along a first direction of the metamaterial antenna at a first frequency and a second resonance along a second direction of the metamaterial antenna at a second, different frequency. This device also includes a first conductive feed line coupled to the metamaterial antenna to guide a signal at the first frequency; a second conductive feed line coupled to the metamaterial antenna to guide a signal at the second frequency; and a Frequency Division Duplex (FDD) circuit comprising a receiver port connected to the first conductive feed line to receive a signal at the first frequency and comprising a transmission port connected to the second conductive feed line to produce a transmission signal at the second frequency which is directed to the metamaterial antenna for transmission. There is not a separate frequency duplexer coupled between the metamaterial antenna and the FDD circuit.

In another implementation, a method is described to include providing a composite left and right handed (CRLH) metamaterial structure comprising unit cells formed on a dielectric substrate by separated conductive patches formed one side of the substrate, a ground conductive layer formed on another side of the substrate, and a plurality of conductive via connectors formed in the substrate to respectively connect the conductive patches to the ground conductive layer, respectively. This method includes coupling a conductive feed line to the CRLH metamaterial structure to excite TE modes that are mixtures of right handed TEM modes and left handed TEM modes to achieve a wider bandwidth in each TE mode than a bandwidth in each of the TEM modes.

In another implementation, a device includes an antenna array; an RF circuit element electromagnetically coupled to the antenna array; and an analog RF circuit coupled to the RF circuit element. The RF circuit element includes a composite left and right handed (CRLH) metamaterial structure.

In yet another implementation, a device includes an RF transceiver module to transmit and receive RF signals. The RF transceiver module includes an antenna array which comprises antenna elements spaced from one another and structured to form a composite left and right handed (CRLH) metamaterial structure. Each antenna element is of a dimension greater than one tenth of a wavelength of a signal in resonance with the CRLH metamaterial structure. Two adjacent antenna elements are spaced from each other by a spacing equal to or greater than one sixth of the wavelength. The RF transceiver module can be a wireless access point or base station.

The CRLH metamaterial structures described can be used to achieve one or more advantages, including reduced interference between different signal channels, improved beamforming and nulling, reduced form factor for antennas and antenna arrays, flexibility designing RF circuit elements and devices, and reduced manufacturing cost.

These and other implementations are described in greater detail in the drawings, the description and the claims.

DETAILED DESCRIPTION

A pure LH material follows the left hand rule for the vector trio (E,H,β) and the phase velocity direction is opposite to the signal energy propagation. Both the permittivity and permeability are negative. A CRLH Metamaterial exhibits both left hand and right hand electromagnetic modes of propagation depending on the regime/frequency of operation. Under certain circumstances, it can exhibit a non-zero group velocity when the wavevector is zero. This situation occurs when both left hand and right hand modes are balanced. In an unbalanced mode, there is a bandgap forbidding the ω crossing with a group velocity different from zero. That is $\beta(\omega_o)=0$ is the transition point between Left and Right handed modes where the guided wavelength is infinite $\lambda_g=2\pi/|\beta|\rightarrow\infty$ while the group velocity is positive:

$$v_g = \frac{d\omega}{d\beta}\bigg|_{\beta=0} > 0$$

This state corresponds to Zeroth Order mode m=0 in a Transmission Line (TL) implementation in the LH handed region. The CRHL structure supports a fine spectrum of low frequencies with a dispersion relation that follows the negative β parabolic region which allows a physically small device to be built that is electrically large with unique capabilities in manipulating and controlling near-field radiation patterns. When this TL is used as a Zeroth Order Resonator (ZOR), it allows a constant amplitude and phase resonance across the entire resonator. The ZOR mode can be used to build MTM-based power combiner/splitter, directional couplers, matching networks, and leaky wave antennas.

In RH TL resonators, the resonance frequency corresponds to electrical lengths $\theta_m=\beta_m l=m\pi$, where l is the length of the TL and m=1, 2, 3 . . . . The TL length should be long to reach low and wider spectrum of resonant frequencies. The operating frequencies of a pure LH material are the low frequencies. A CRLH metamaterial structure is very different from RH and LH materials and can be used to reach both high and low spectral regions of the RF spectral ranges of RH and LH materials.

Figure 1:
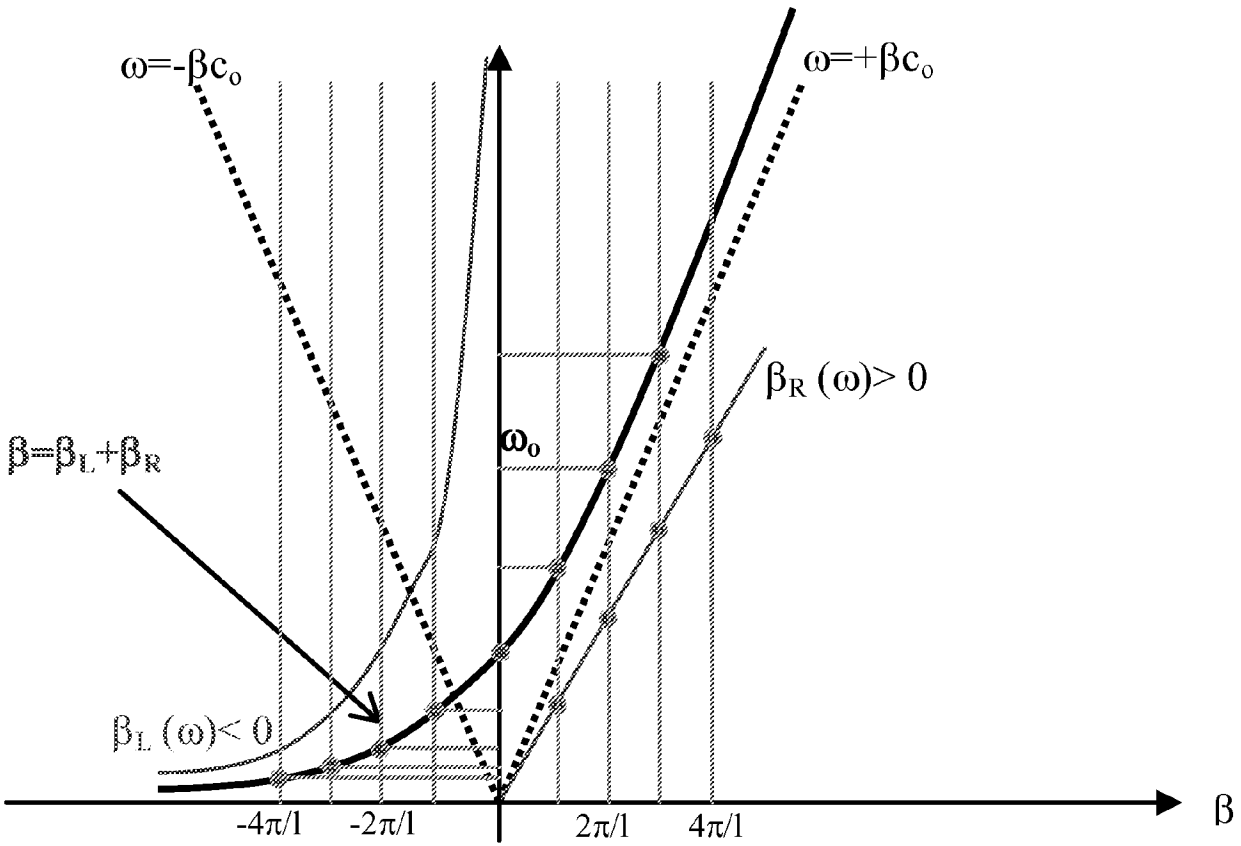
FIG. 1 shows the dispersion diagram of a CRLH metamaterial

FIG. 1 shows the dispersion diagram of a balanced CRLH metamaterial. The CRLH structure can support a fine spectrum of low frequencies and produce higher frequencies including the transition point with m=0 that corresponds to infinite wavelength. This allows seamless integration of CRLH antenna elements with directional couplers, matching networks, amplifiers, filters, and power combiners and splitters. In some implementations, RF or microwave circuits and devices may be made of a CRLH MTM structure, such as directional couplers, matching networks, amplifiers, filters, and power combiners and splitters. CRLH-based Metamaterials can be used to build an electronically controlled Leaky Wave antenna as a single large antenna element in which leaky waves propagate. This single large antenna element includes multiple cells spaced apart in order to generate a narrow beam that can be steered.

Figure 2:
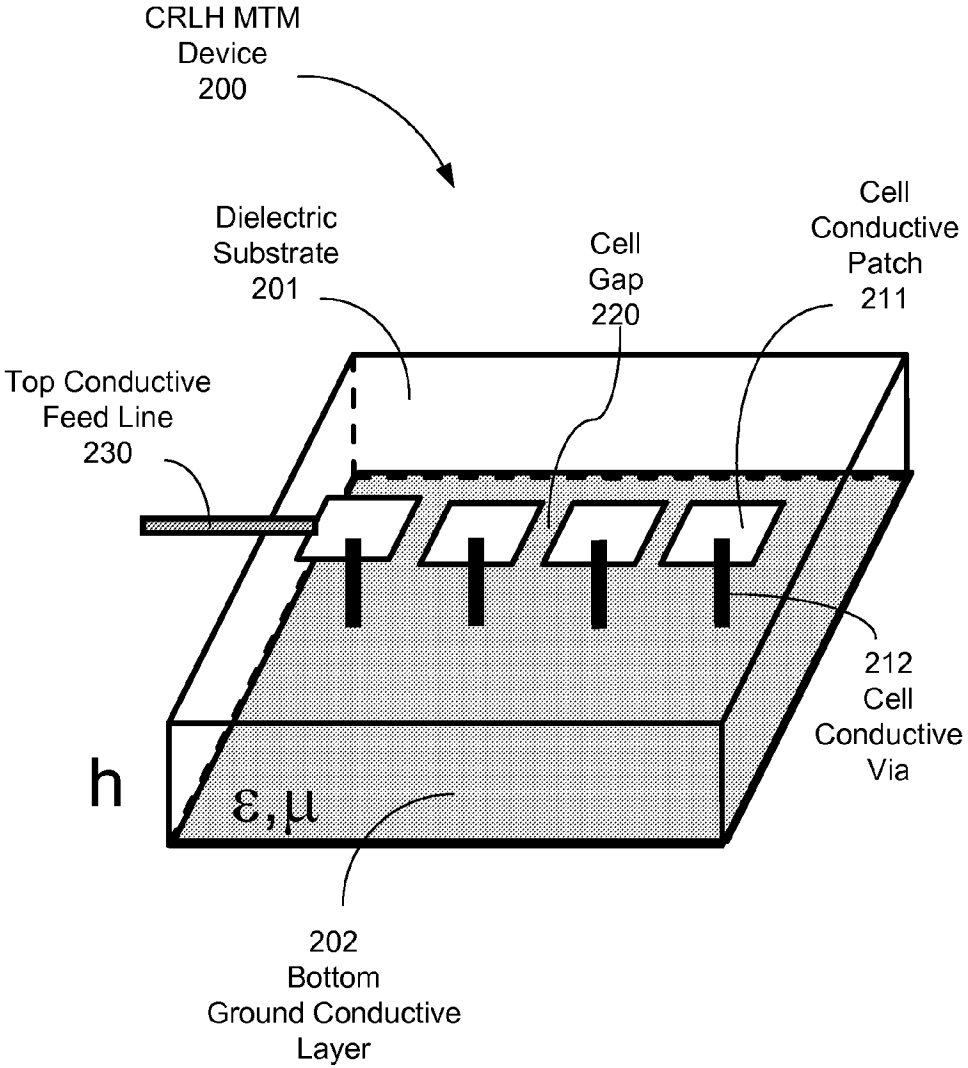
FIG. 2 shows an example of a CRLH MTM device with a 1-dimensional array of four MTM unit cells.

FIG. 2 shows an example of a CRLH MTM device 200 with a 1-dimensional array of four MTM unit cells. A dielectric substrate 201 is used to support the MTM unit cells. Four conductive patches 211 are formed on the top surface of the substrate 201 and separated from one another without direct contact. The gap 220 between two adjacent patches 211 is set to allow capacitive coupling between them. The adjacent patches 211 may interface with each other in various geometries. For example, the edge of each patch 211 may have an interdigitated shape to interleave with a respective interdigitated edge of another patch 211 to achieve enhanced patch to patch coupling. On the bottom surface of the substrate 201, a ground conductive layer 202 is formed and provides a common electrical contact for different unit cells. The ground conductive layer 202 may be patterned to achieve desired properties or performance of the device 200. Conductive via connectors 212 are formed in the substrate 201 to respectively connect the conductive patches 211 to the ground conductive layer 202. In this design, each MTM unit cell includes a volume having a respective conductive patch 211 on the top surface, and a respective via connector 212 connecting the respective conductive patch 211 to the ground conductive layer 202. In this example, a conductive feed line 230 is formed on the top surface and has a distal end located close to but is separated from the conductive patch 211 of a unit cell at one end of the 1-D array of unit cells. A conductive launching pad may be formed near the unit cell and the feed line 230 is connected to the launching pad and is electromagnetically coupled to the unit cell. This device 200 is structured to form a composite left and right handed (CRLH) metamaterial structure from the unit cells. This device 200 can be a CRLH MTM antenna which transmits or receives a signal via the patches 211. A CRLH MTM transmission line can also be constructed from this structure by coupling a second feed line on the other end of the 1-D array of the MTM cells.

Figure 2A:
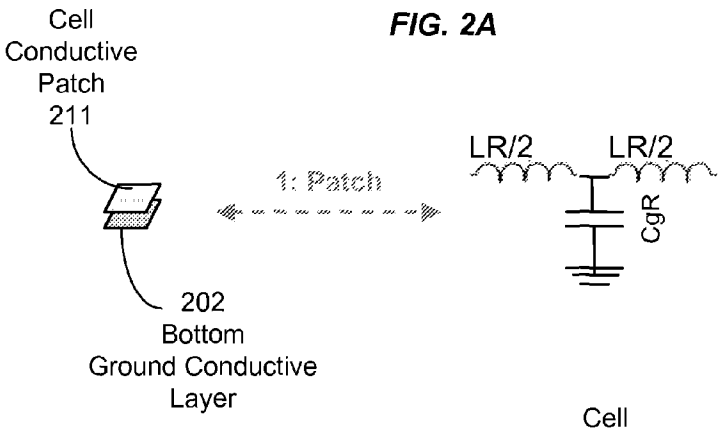
FIGS. 2A, 2B and 2C illustrate electromagnetic properties and functions of parts in each MTM unit cell in FIG. 2 and the respective equivalent circuits.
Figure 2B:
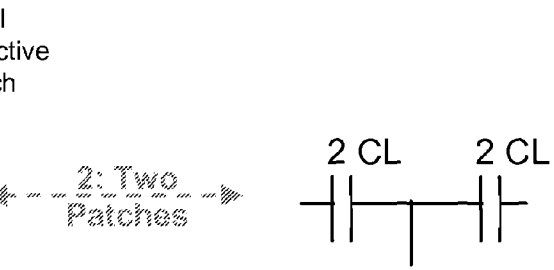
Figure 2C:
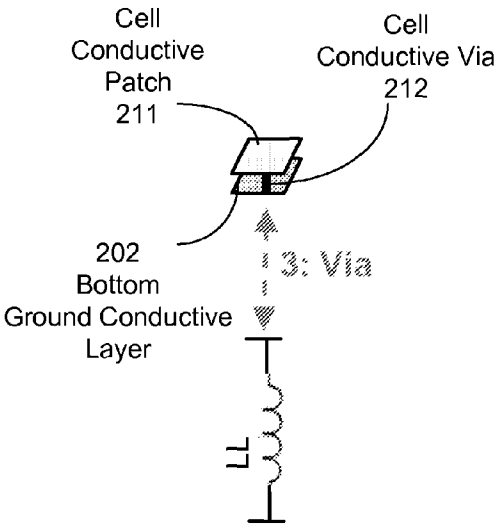

FIGS. 2A, 2B and 2C illustrate the electromagnetic properties and functions of parts in each MTM unit cell in FIG. 2 and the respective equivalent circuits. FIG. 2A shows the capacitive coupling between each patch 211 and the ground conductive layer 202, and induction due to propagation along the top patch 211. FIG. 2B shows capacitive coupling between two adjacent patches 211. FIG. 2C shows the inductive coupling by the via connector 212.

Figure 3:
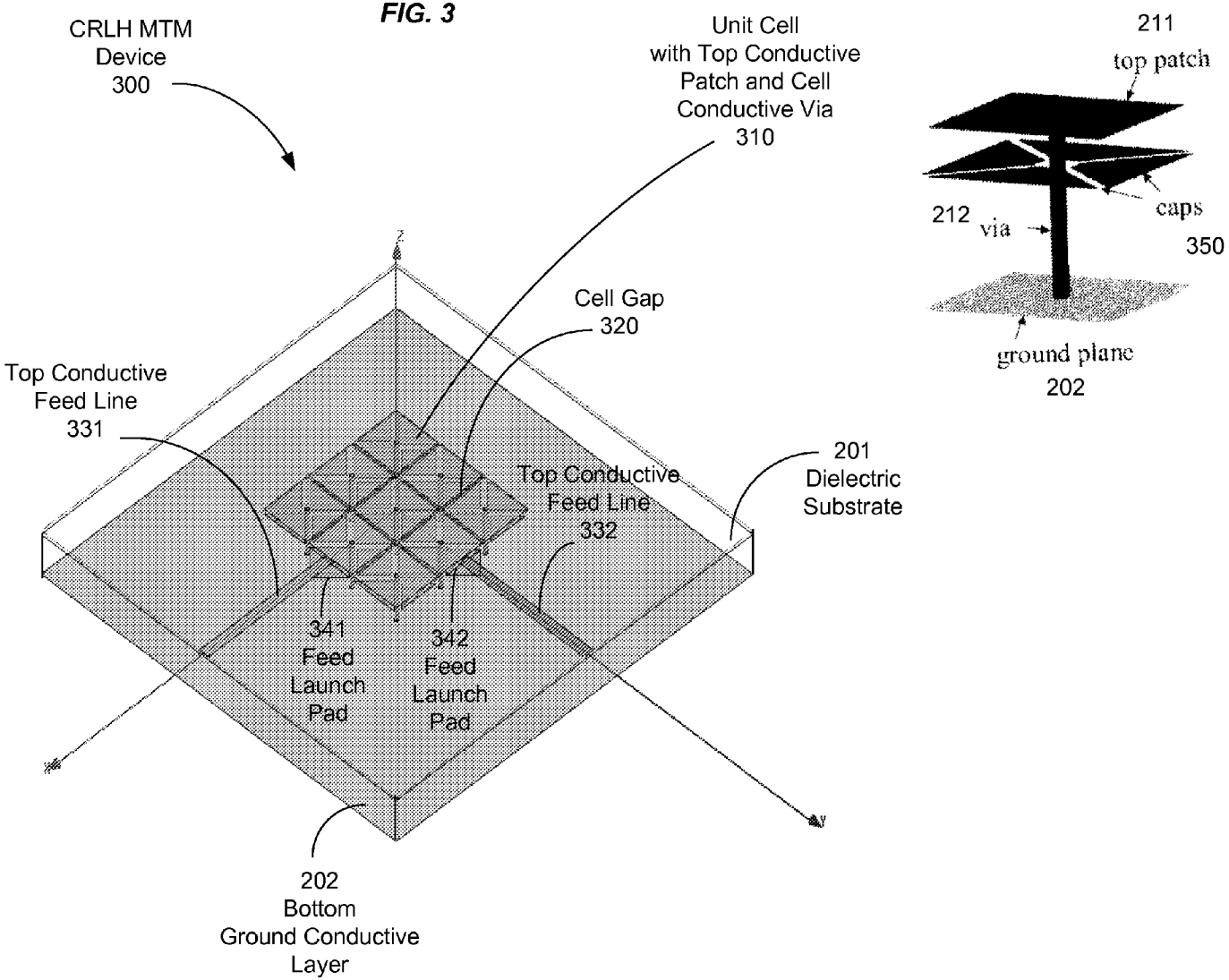
FIG. 3 illustrates another example of a CRLH MTM device based on a 2-dimensional array of MTM unit cells.

FIG. 3 illustrates another example of a CRLH MTM device 300 based on a 2-dimensional array of MTM unit cells 310. Each unit cell 310 may be constructed as the unit cell in FIG. 2. In this example, the unit cell 310 has a different cell structure and includes another conductive layer 350 below the top patch 211 in a metal-insulator-metal (MIM) structure to enhance the capacitive coupling of the left handed capacitance CL between two adjacent unit cells 310. This cell design can be implemented by using two substrates and three metal layers. As illustrated, the conductive layer 350 has conductive caps symmetrically surrounding and separated from the via connector 212. Two feed lines 331 and 332 are formed on the top surface of the substrate 201 to couple to the CRLH array along two orthogonal directions of the array, respectively. Feed launch pads 341 and 342 are formed on the top surface of the substrate 201 and are spaced from their respective patches 211 of the cells to which the feed lines 331 and 332 are respectively coupled. This 2-dimensional array can be used as a CRLH MTM antenna for various applications, including dual-band antennas.

Figure 4:
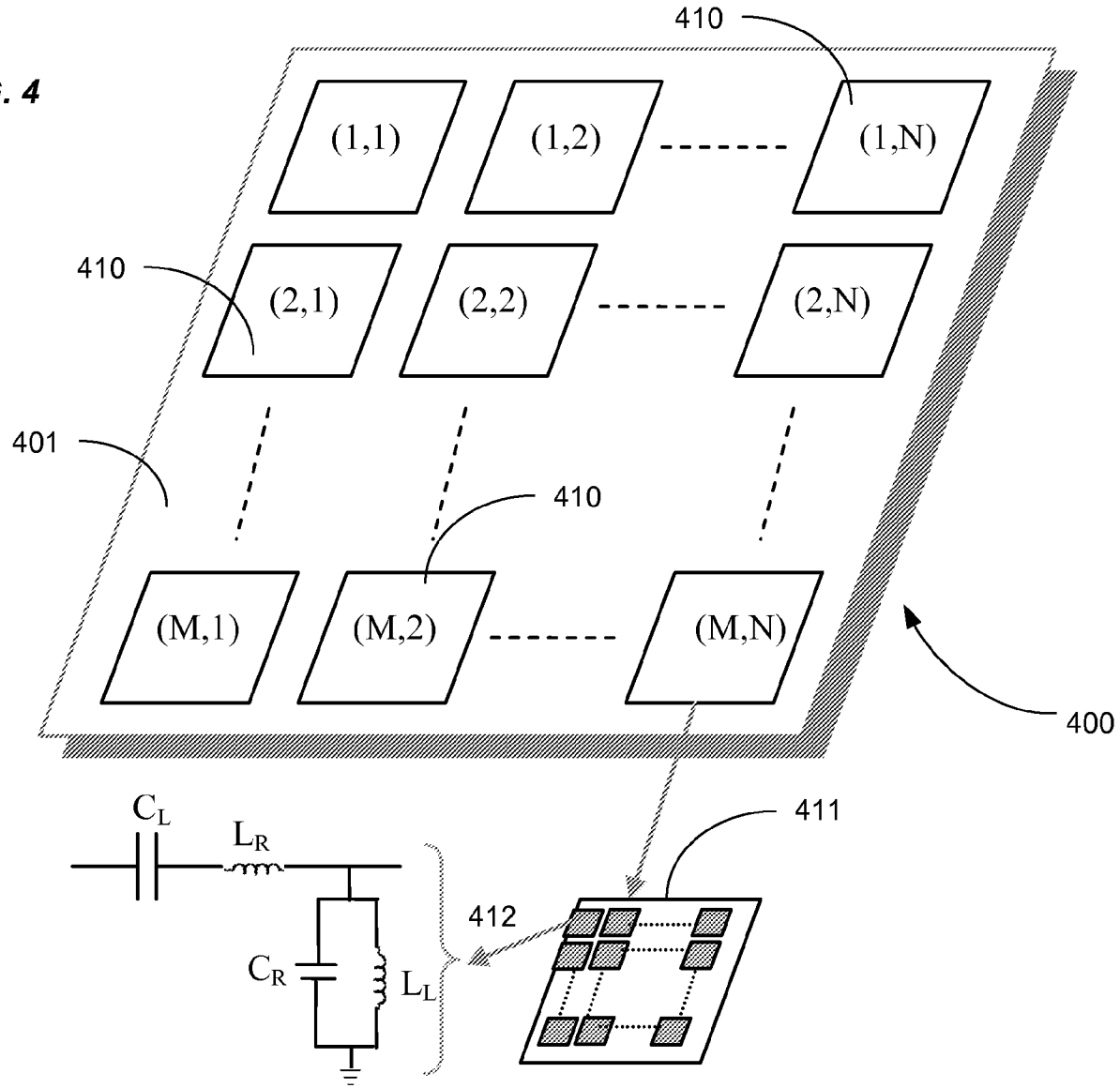
FIG. 4 shows an example of an antenna array that includes antenna elements formed in a 1-D or 2-D array and in a CRLH MTM structure.

FIG. 4 shows an example of an antenna array 400 that includes antenna elements 410 formed in a 1-D and/or 2-D array on a support substrate 401. Each antenna element 410 is a CRLH MTM element and includes one or more CRLH MTM unit cells 412 each in a particular cell structure (e.g., a cell in FIG. 2 or 3). The CRLH MTM unit cells 412 in each antenna element 410 may be directly formed on the substrate 401 for the antenna array 400 or formed on a separate dielectric substrate 411 which is engaged to the substrate 401. The two or more CRLH MTM unit cells 412 in each antenna element may be arranged in various configurations, including a 1-D array or a 2-D array. The equivalent circuit for each cell is also shown in FIG. 4. The CRLH MTM antenna element can be engineered to support desired functions or properties in the antenna array 400, e.g., broadband, multi-band or ultra wideband operations.

The technique by which multiple streams are transmitted and/or received at same time and location over the same frequency band by using multiple uncorrelated communication paths enabled by multiple transmitters/receivers. This method is known as the Multiple Input Multiple Output (MIMO), which is a special case of Smart Antennas (SA).

Figure 5:
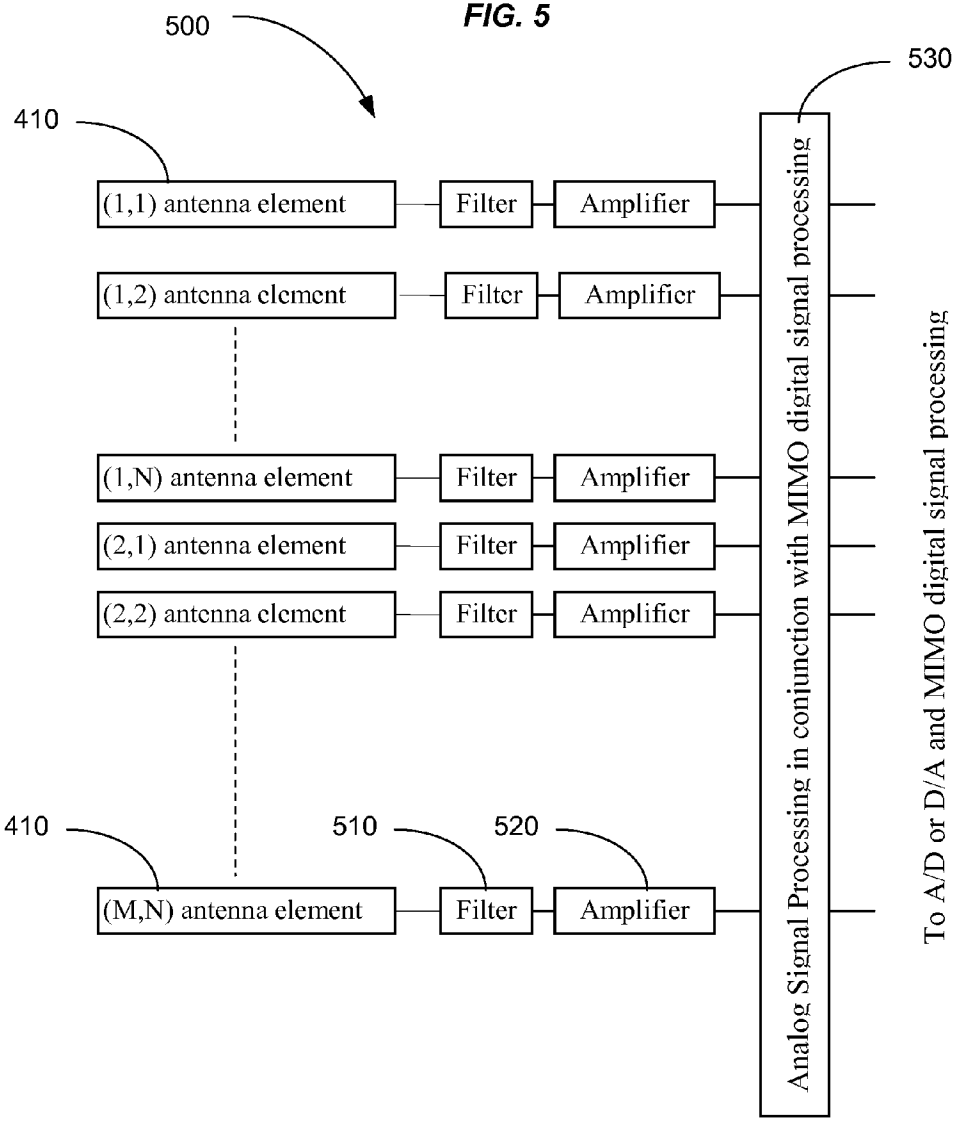
FIG. 5 illustrates a MIMO antenna subsystem based on the antenna array in FIG. 4.

FIG. 5 illustrates a MIMO antenna subsystem 500 based on the antenna array 400 having CRLH MTM antenna elements 410 in FIG. 4. Each antenna element 410 can be connected to a filter 510 and an amplifier 520 to form a signal chain. The filter 510 and amplifier 520 may also be CRLH MTM devices. An analog signal processing device 530 is provided as an interface between the antenna elements 410 and the MIMO digital signal processing unit. This MIMO antenna subsystem 500 may be used in various applications, including a wireless access point (AP) such as a WiFi router, a BS in a wireless network, and a wireless communication USB dongle or card (e.g., PCI Express card or PCMCIA card) for computers and other devices.

Figure 6B:
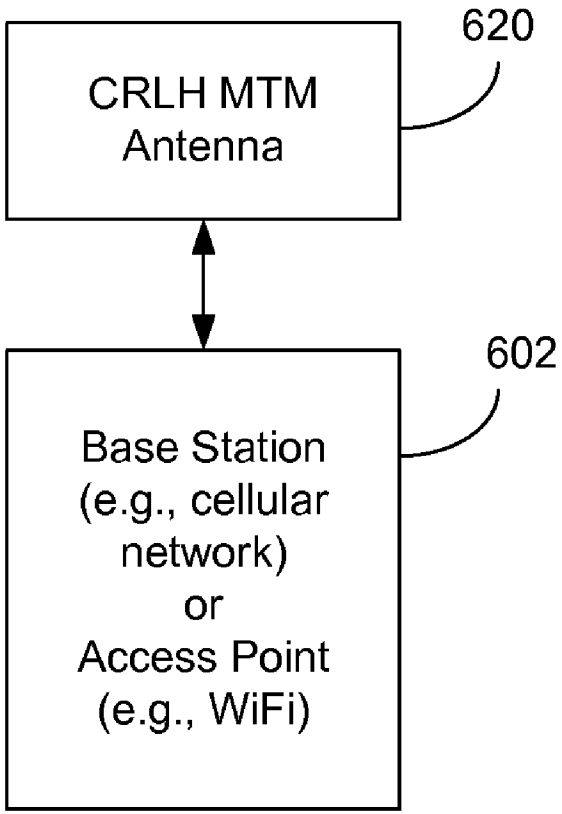
FIGS. 6A and 6B show two examples of wireless applications for CRLH MTM antenna subsystems.
Figure 6A:
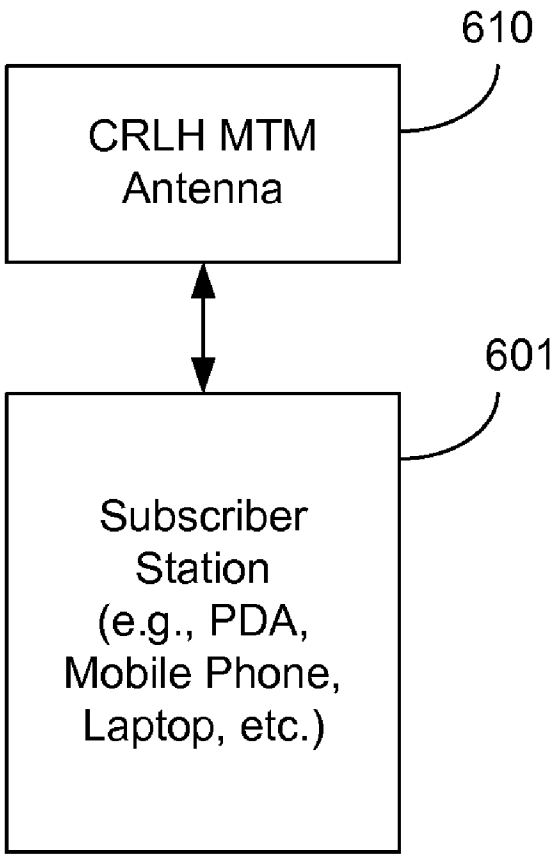

FIG. 6A shows a wireless subscriber station 601 based on a CRLH MTM antenna 610. The subscriber station 601 can be a PDA, a mobile phone, a laptop computer, a desktop computer or other wireless communication device subscribed to and in communication with a wireless communication network. The CRLH MTM antenna 610 can be designed to be compact using the CRLH MTM structure. For example, each MTM unit cell can have a dimension smaller than one sixth or one tenth of a wavelength of a signal in resonance with the CRLH metamaterial structure and two adjacent MTM unit cells are spaced from each other by one quarter of the wavelength or less. In one implementation, the CRLH MTM antenna 610 may be a MIMO antenna. Implementations of the CRLH MTM designs and techniques in this application may combine MIMO and CRLH MTM technologies to provide multiple channels, e.g. two or four channels into a small device 601.

FIG. 6B shows a CRLH MTM antenna 620 used in a BS or AP 602 in a wireless communication system. Different from the example in FIG. 6A, a relatively large CRLH MTM antenna array may be used as the antenna 620. For example, the antenna subsystem in FIG. 5 may be used in the BS or AP 602. For another example, a CRLH MTM leaky wave antenna having multiple CRLH MTM unit cells may be used as the antenna 620.

Figure 7:
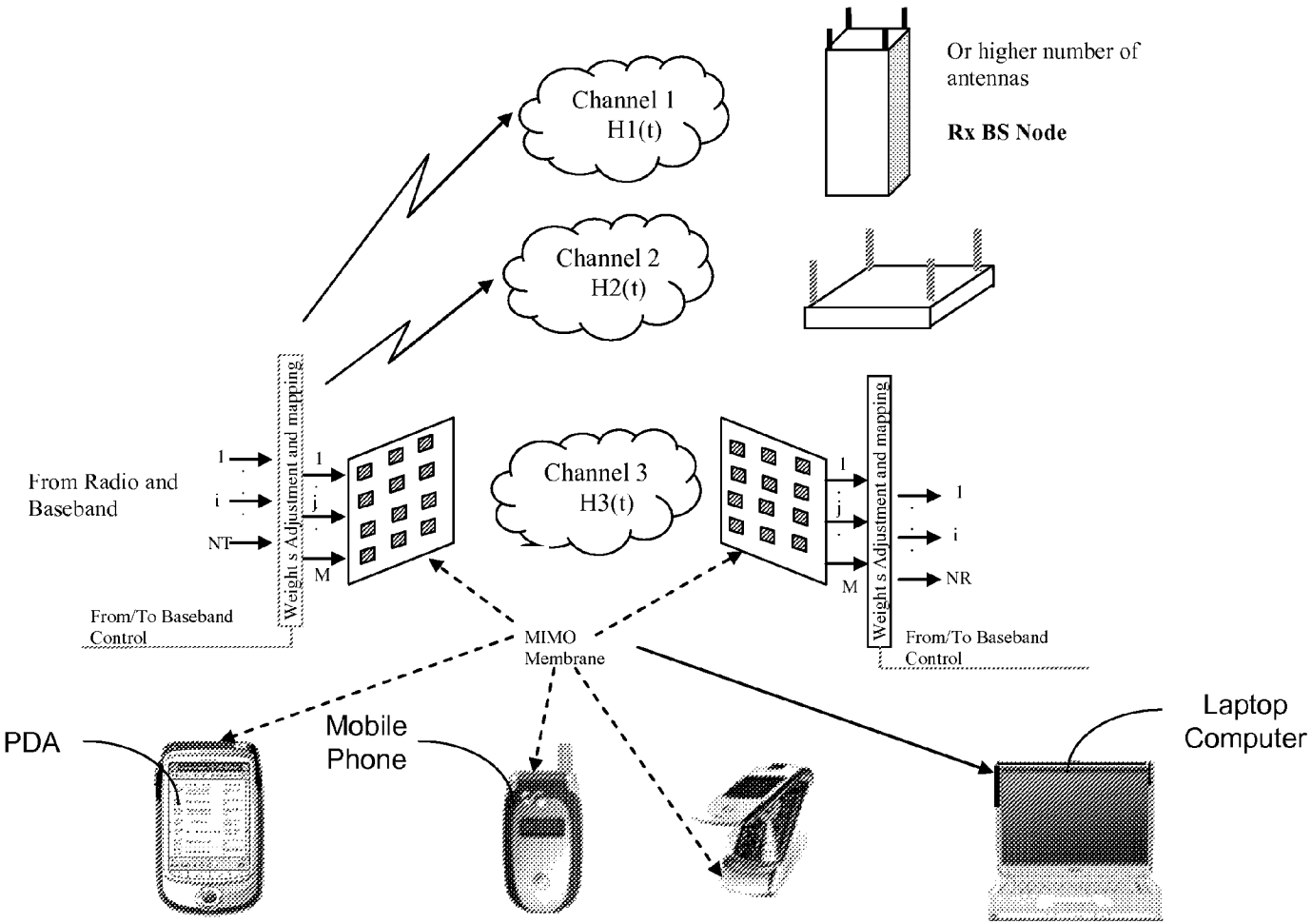
FIG. 7 shows an example of a wireless communication system that implements FIGS. 6A and 6B.

FIG. 7 shows a wireless communication system that implements the designs in FIGS. 6A and 6B. Wireless communication system in FIG. 7 uses electromagnetic waves in the air to provide various communication services. The need for higher communication speed to support emerging broadband applications is pushing wireless communications technologies to the "Last Frontier" by optimizing spectrum utilization, number of bits/sec/Hz, to overcome RF spectrum scarcity and high cost while optimizing power efficiency. In the digital signal processing subsystem of a wireless communication system, optimization is accomplished by reaching the "Shannon Capacity" limit dictated by the required Bit Error Rate (BER) and Signal to Noise Ratio (SNR) parameters. Optimum compression, coding, and modulation techniques have been identified that improve channel capacities for different applications and target deployment scenarios. These advanced digital techniques pushed the last fraction of a dB gain that can be reached leaving engineers with no choice but to conquer the last wireless communication frontier "Air Interface", i.e. Analog Space. Hence, the idea of transmitting and/or receiving multiple streams of data at same time and location over the same frequency band by using multiple uncorrelated communication paths enabled by multiple transmitters/receivers. This technique is known as the MIMO, which is a special case of SA. Smart Antennas referred to air-interface subsystems capable of shaping the beam and steering it in the optimal Line of Sight (LOS) direction. On the receiving side, these antennas are capable of maximizing the Rx antenna gain along the Tx-Rx communication path by performing simple and advanced direction finding techniques. Furthermore, these techniques were also capable of applying nulling weights to minimize or even eliminate unwanted interference signals, hence improving Tx-Rx SNR.

SA constituted of an array of antenna elements driven by various feeding networks that dynamically adjust Tx signal phase, amplitude, or both, referred to by "weights", per element. These Phased Array Antennas can be narrow-beam, broadband, or even frequency independent depending on the geometry and symmetry of the aperture. In the 1990s, SA concept was extended to include additional digital signal processing techniques that leverage Multipath interference instead of eliminating it. This different class of algorithms extended initial SA focus to Non-Line of Sight (NLOS) links along with the traditional LOS SA. Two classes of algorithms were defined to push more bits/sec/Hz using arrays of Tx and Rx antenna, elements, RF chains, and parallel-coded digital signal processing algorithm at both sides of the link.

Wireless systems may be designed to use transceivers with multiple antennas for the input and output and are referred to as MIMO systems. MIMO antennas are SA devices and the use of antennas at both transmitter and receiver in MIMO systems exploits the NLOS multipath propagation to provide a number of benefits, including increase in capacity and spectral efficiency, reductions of fading due to diversity, and improved resistance to interference.

The end-to-end system model should include the manner in which the signal is sent into the air, e.g., antenna/antenna system characteristics such as polarization, pattern, or spatial diversity. This presents a great challenge to system engineers because the design covers three different wireless communication technology boundaries: digital-RF, RF-antenna, and antenna-air interface. Throughout each step, coupling between channels should be minimized to guarantee optimum MIMO performance. With only three completely orthogonal polarizations available (because of practical limitations, however, only two are typically used—Vertical/Horizontal or Left-Handed Circular and Right-Handed Circular polarizations) and their distortion when the signal is reflected along the NLOS communication path, it can be difficult to count only on polarization diversity to effectively implement MIMO. There is a need to use spatial diversity where Omni-directional MIMO antennas are spaced far apart in order for their signals to propagate along different multipath directions, which implies large antenna arrays. Pattern diversity, on the other hand, relies on near-orthogonal (non-correlated) radiation patterns of the antenna elements in a MIMO array, and hence is more suitable for compact MIMO arrays applications provided the miniaturization of each antenna element.

To simplify the MIMO system model, some communication system engineers followed the conventional definition of communication channel "H" as channel=RF+antenna+air propagation to provide the simple relationship r(t)=H(t)□s(t), where r is the received digital signal, s is the transmit digital signal, H is the channel in between, and □ operation depends on the Tx and Rx system architecture. For example, an NT by NR system has r(t) as an NRx1 vector, s(t) as an NTx1 vector, H as an NRxNT matrix, and □ as a matrix multiplication operation.

The first MIMO algorithm transmits NT different data streams along each antenna element/channel allowing each of the NR receiving antennas/channels to receive all NT signals. Depending on the receiving algorithm, NR can be lower, equal, or higher than NT in order to de-correlate the received signals to recover the NT transmit data streams. This is accomplished by applying channel parameters to the NR received signals and initially processed NT Tx data. Key requirement to successfully recover the NT Tx data streams is for the signals to remain "uncorrelated" throughout the NT communication paths. This is referred to as "Channel Diversity (ChDiv)".

Spatial Multiplexing (SM) is the means by which different data streams are transmitted over NT Tx channels and it reaches its peak spectral efficiency when all NT channels are uncorrelated and the gain attained over each channel is maximal. Uncorrelated channels appear when the coupling between MIMO antenna elements is minimal and the communication environment is rich in multipath caused by reflection and diffraction by neighboring structures, typically associated with NLOS situations. In the absence of multipath, i.e. LOS case, the SM received signals cease to be uncorrelated preventing the receiver from de-correlating the NT Tx data streams. Therefore, if the nodes can be always placed in locations that maximize multipath signals in the case of fixed Tx and Rx nodes, then communication links take full advantage of SM benefits. Since users are usually not experts in optimizing multipath links, it is useful to define a system that can adapt to all end-user expertise and utilization scenarios.

With mobility the requirement to constantly characterize the channel—the channel matrix H—becomes of great importance to be able to recover at the receiver the information transmitted. This is accomplished by "Channel Sounding" using preamble/pilot bits or other techniques. The speed by which H needs to be updated depends on mobile nodes speed. Frequent channel updates will eventually reduce the "effective" number of bits/sec/Hz drastically, because excessive "Channel Sounding" consumes some of the designated communication time.

To mitigate this problem, a second type of MIMO algorithm is used, Space-Time Block Coding (STBC). STBC is more immune to precise channel parameterization, i.e. tolerate channel errors and hence does not require frequent channel sounding. Furthermore, and as discussed earlier, another requirement is for communication systems to be capable of operating in a mixed NLOS and LOS environment, i.e. the Rx signal includes a fraction of a direct Tx-Rx LOS path as well as multipath trajectories. In Space-Time Block Coding (STBC), the same Tx data stream is duplicated NT times with each stream coded differently instead of transmitting NT different data streams as in SM. The transmitter performs space (in reference to antenna Spatial Diversity—SpDiv) and time (in reference to bit delay lines) coding prior to transmission.

There are at least two different classes of SA and three techniques to increase spectrum efficiency: (1) Beamforming (BF) and Beamforming and nulling (BFN) based on Phased Arrays Antennas or frequency-independent multi-arm antennas, (2) MIMO and Advanced signal processing capable of transmitting (i) different data streams over multiple channels (SM): NLOS, precise channel characterization, highly uncorrelated channels, (ii) same data stream over multiple channels (STBC): NLOS, NLOS+LOS, tolerate errors in channel characterization and small correlation among the channels, and (iii) BF and BFN where LOS with channel characterization depends on beam patterns and precise channel characterization to either 1) analog switching between different beam patterns, 2) adaptively shape and steer the beam, 3) use digital BF and BFN in addition to analog beam switching and shaping to optimize performance.

In addition, conventional BF and BFN can also be accomplished with MIMO systems in the digital domain without requiring analog phase-shifter, delay-line, or other directional couplers and matching networks. This digital BF and BFN require extensive amount of signal progressing that makes it unpractical to implement. A more suitable approach is a combined digital/analog BF and BFN approach.

Two wireless communication commercial standards including MIMO have been ratified providing carriers with higher communication speeds to support existing and future broadband application services. The first standard, IEEE 802.11n, is focused on Local Area Networks (LAN) and the second one, IEEE 802.16e, is focused on mobile Wide Area Network (WAN) and can be applicable to LAN as well. There are other ongoing standards that call for MIMO technologies such as IEEE802.20 and future 4G UMTS systems. In most of these standards, up to 4×4 MIMO is recommended. That means on both client and AP/BS sides 4 Tx and 4 Rx antennas are used.

So far, ratified commercial standards include SM, STBC, and BF algorithms leaving to the developer the challenges of first implementing uncorrelated MIMO paths concept on small client devices such as a wireless communication USB dongle, PCMCIA/PCI Express cards and handheld computing and multimedia devices, and second adaptively selecting the appropriate approach depending on LOS, NLOS, fixed, and dynamic channel condition.

The designs and techniques in this application are applied to address one of the most challenging problems facing fixed and mobile wireless communication industry implementing full commercial standards targeting broadband end-user applications that require much higher bits/sec/Hz spectrum efficiency. The enabling technology is based on the following:

Fitting multiple antennas and radio transceivers in a small form factor, that may require low-power consumption, without jeopardizing performance and throughput poses a great challenge to handset integrators, wireless communication card developers (e.g., PCMCIA and PCI Express cards and wireless communication USB dongles), PDAs manufacturers, and even for thin and small laptops designers. Implementations of the designs and techniques in this application can be used to provide an overall MIMO subsystem that enables multiple parallel channels to any portable or fixed device regardless of its form factor or power consumption requirement.

Many MIMO systems use conventional right-handed (RH) materials for the MIMO antennas where the properties of the electric field and the magnetic field of an electromagnetic wave obey the right hand rule. The use of RH antenna materials sets lower limits to the size of each antenna (typically half of one wavelength of the signal) and the spacing of two adjacent antennas in an antenna array (e.g., greater than one half of one wavelength of the signal). Such limitations severely hinder applications of MIMO systems in various compact wireless communication devices, such as cell phones, PDAs and other hand-held devices with wireless communication capabilities.

The antenna array designs, wireless systems and associated communication techniques described in this application use Composite Left and Right Handed (CLRH) Metamaterial to construct compact antenna arrays for implementing MIMO systems. Such MIMO systems using antennas made from CLRH Metamaterial can be designed to retain the benefits of the conventional MIMO systems and provide additional benefits that are not available or difficult to achieve with conventional MIMO systems.

The designs and techniques in this application can be implemented to include one or more of the following features:

1. Miniature printed antenna elements greater than $\lambda/6$ in size to allow for integration in small proximity (e.g., on the order of one quarter of a wavelength, $\lambda/4$, or smaller antenna spacing) and minimum coupling between antenna elements. This compact MIMO antenna design is suitable for SM, space-time block codes, and supports BS & nulling features provided by the much larger Base BS or Access Point. Size reduction is accomplished by using CLRH advanced Metamaterials.

2. Use of printed MTM directional couplers and matching networks to further reduce Near-Field (NF) and Far-field (FF) coupling.

3. Use of multiple MTM antennas to build a single MIMO antenna to enable beam shaping, switching, and steering with and without MIMO algorithms.

4. Printed MTM-based 1-to-N power combiner/splitter is used to combine multiple MTM antennas to form a single sub-MIMO array antenna.

5. A single MTM Leaky Wave antenna is used to enable beam shaping, switching, and steering with and without MIMO algorithms 6. MTM-based filters and diplexer/duplexer can be also built and integrated with the antennas and power combiner, directional coupler, and matching network when present to form the RF-chain. Only the external port that is directly connected to the RFIC needs to comply with 50Ω regulation. All internal ports between antenna, filter, diplexer, duplexer, power combiner, directional coupler, and matching network can be different from 50Ω in order to optimize matching between these RF elements.

7. Antenna feed network and RF circuit design that drives the four or more channels. CRHL MTM designs allow for simple integration of these miniature antennas with their feeding network, amplifiers, filters, and power splitter/combiner to optimize the overall RF circuitry while reducing coupling losses. The overall integrated structure is referred to by Active Antennas (AA).

8. The features in No. 1 and No. 2 allow for a "MIMO membrane" having miniature antenna elements integrated within a 2D membrane surface that conforms to communication device to be integrated with as shown in FIG. 5.

9. Post- (Tx side), and pre- (Rx side) digital signal processing that optimizes communication link performance for: a) asymmetric and symmetric links (BS-client, client-client, model-spatial diversity, . . . ), b) dynamic channels, c) systems compliant with commercial standards.

One of the technical challenges remains in fitting four or more MIMO channels (antennas and RF chains) in a compact form factor such as handheld devices, wireless USB dongles or cards (e.g., PCMCIA or PCI Express), wireless communication USB dongles, thin laptops, portable BS, compact APs, and other applicable products while still complying with commercial standards, supporting SM, STBC, and BF and nulling, operating on multiple bands typically ranging from few tens to few hundreds of MHz, and capability to comply with power consumption when applicable.

Implementations of the designs and techniques in this application can be used to overcome three technical issues:

1. Miniature antenna elements with sizes small enough to allow their integration in small proximity with minimum coupling. This advanced compact MIMO antenna design is suitable for SM, space-time block codes, and supports BS & nulling features provides by the much large structure BS (BS) or Access Point (AP). Size reduction and integration are accomplished by using CRLH advanced Metamaterial.

2. Antenna feed network and RF circuit design that drives the four channels. CRHL allows for simple integration of these miniature antennas with their feeding network, amplifiers, filters, and power splitter/combiner to optimize the overall RF sub-component while reducing coupling losses. The overall integrated structure is referred to by AA. Along these lines, the novel concept of "MIMO Membrane" is introduced that allows 2D MIMO antennas to conform to device geometries.

3. Post- (Tx side) and pre- (Rx side) signal processing that is compliant with commercial MIMO standards and can accommodate compact MIMO antennas (e.g. handset), Large MIMO antenna systems (ex BS) links as well as links between two compact antenna systems (peer-to-peer).

MIMO diversity is desirable in wireless communications. Spatial Diversity (SpDiv) or a combination of SpDiv and Polarization Diversity (PoDiv) can be used in large MIMO systems such as BSs. Compact MIMO systems may leverage Pattern Diversity (PaDiv). This Pattern Diversity may be achieved when the end-to-end communication system considers the channel as the air propagation portion only, i.e. extracting the antenna and RF circuitry from conventional H matrix and assigned to communication modules.

Because PaDiv corresponds to angular distribution and polarization characteristics of the radiating beam, it is clear that means to modify or tilt the beam are necessary. However, with Metamaterial not only the near-field radiation can be manipulated to eliminate near-field couplings between nearby antenna elements, but also shape, switch, and steer the beam to give a pattern diversity effect in rich multipath environment. These Metamaterial antennas can easily support a combination of pattern and polarization diversities.

PaDiv can be used to support OFDM-MIMO (OFDM: orthogonal frequency division multiplexing), FH-MIMO (FH: frequency hopping) and DSS-MIMO (DSS: direct spread spectrum) communication systems and combinations thereof. PaDiv can be used to support MIMO digital modulation.

One implementation of the designs and techniques of this application is a wireless communication system covering multi-band, and/or wideband, and/or ultra-wideband RF spectrum while leveraging multipath effects in OFDM or DSS implementation by using innovative air-interface, analog, and digital MIMO processing that fit in a compact communication device such as PDAs, cell phones, and wireless communication USB dongles or cards (e.g., PCMCIA and PCI Express). MIMO includes SA arrays systems that deploy digital signal processing to the transmitted digital signals across the multiple channels. That includes SM, STBC, and BM/BFN for fixed and mobile scenarios operating in NLOS, LOS, and combines NLOS and LOS environments.

Figure 8A:
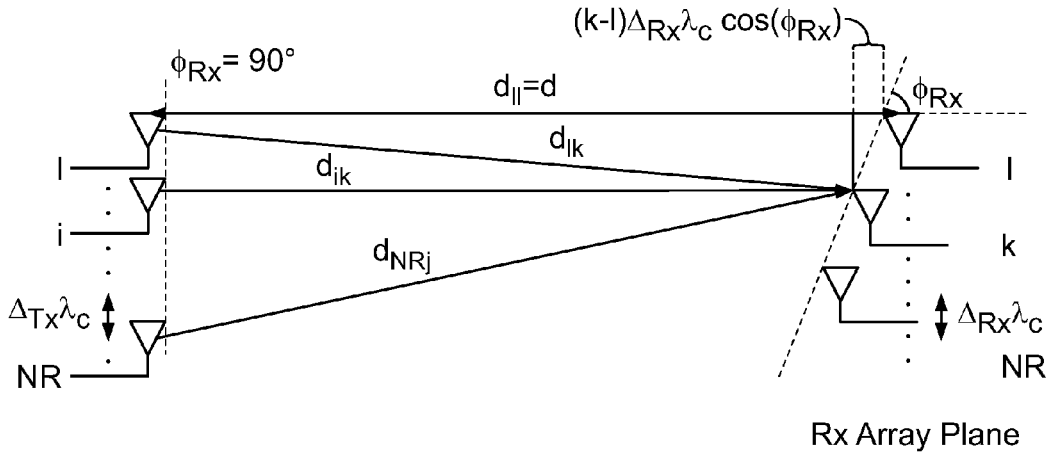
FIGS. 8A, 8B, 9A, 9B and 9C illustrate various conditions in wireless transmission and reception wireless communication.
Figure 8B:
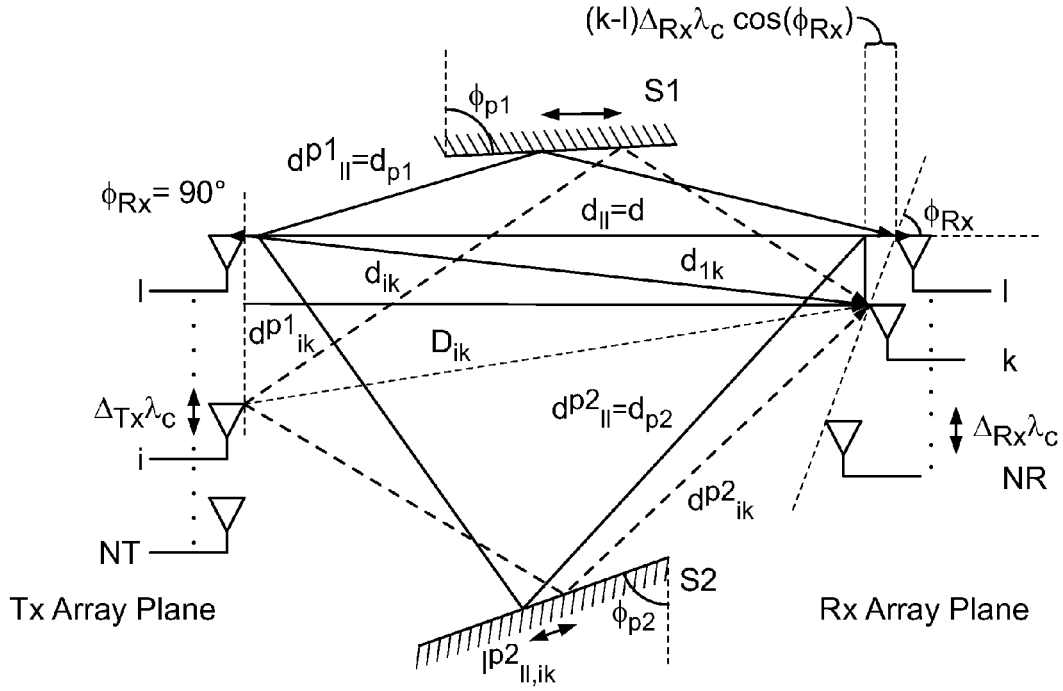

FIG. 8A shows two geographically separated linear Tx and Rx antenna arrays with a LOS Link. FIG. 8B shows two geographically separated linear Tx and Rx antenna arrays with LOS and NLOS Links.

Figure 9A:
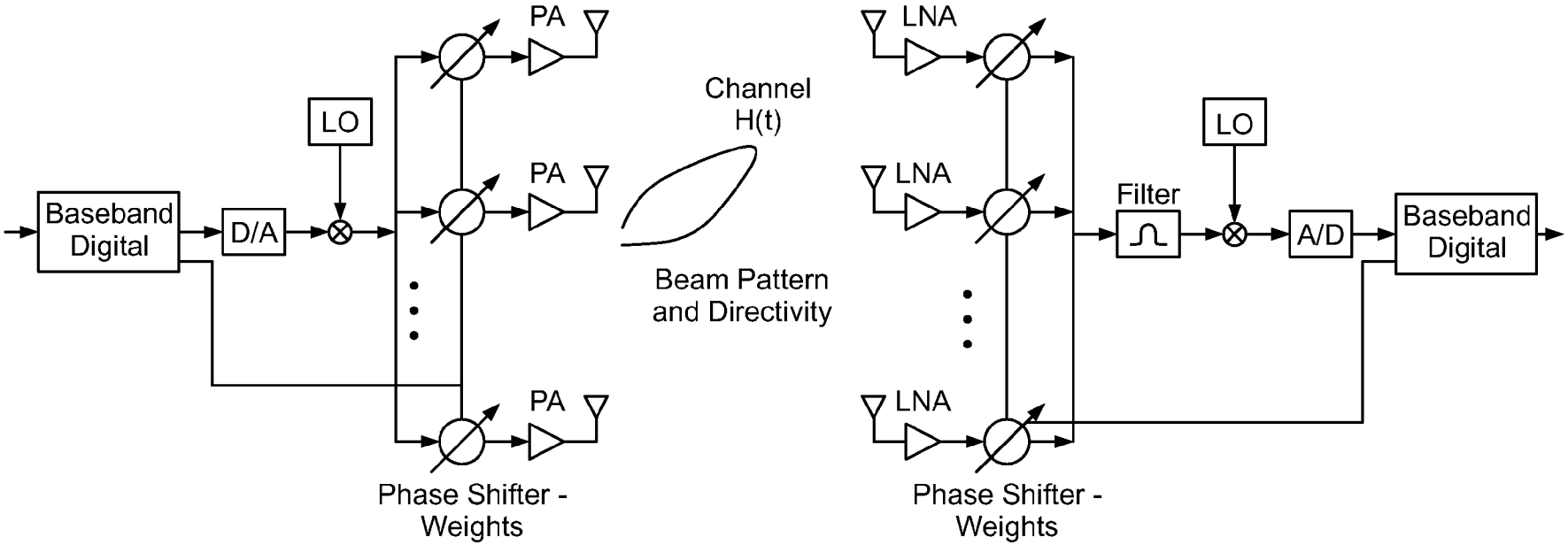

FIG. 9A shows Phased Array Antenna System for BF and/or nulling.

Figure 9B:
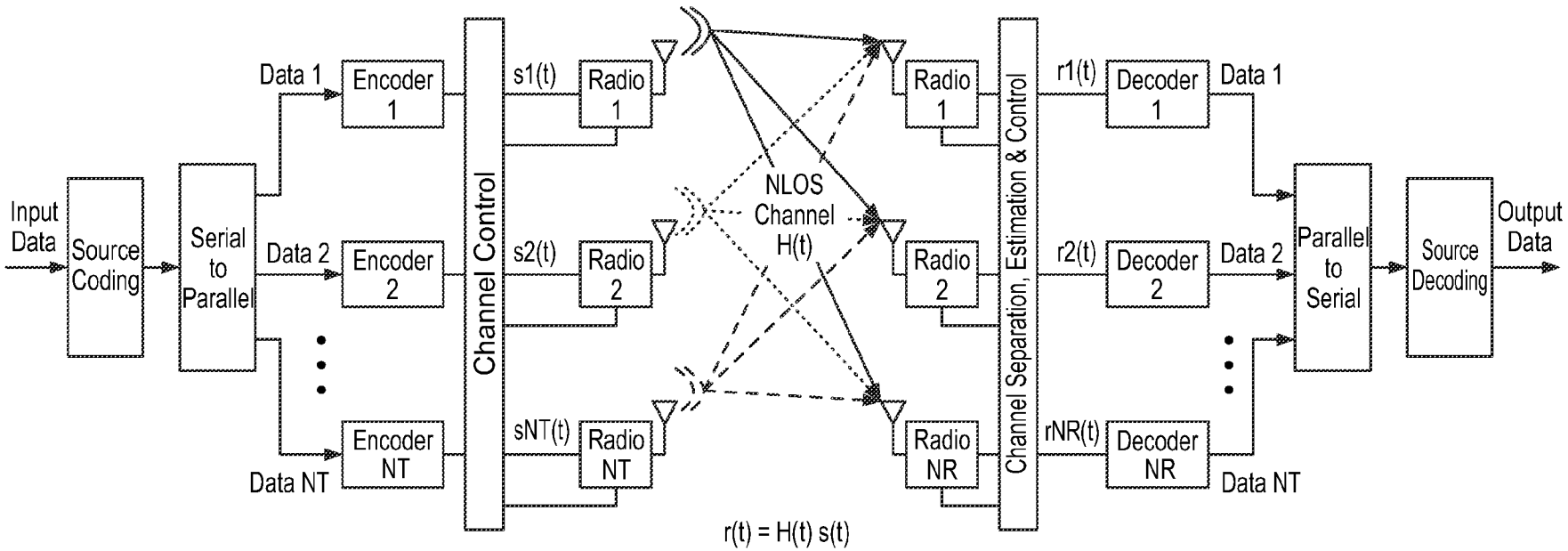

FIG. 9B shows a MIMO system based on SM algorithm.

Figure 9C:
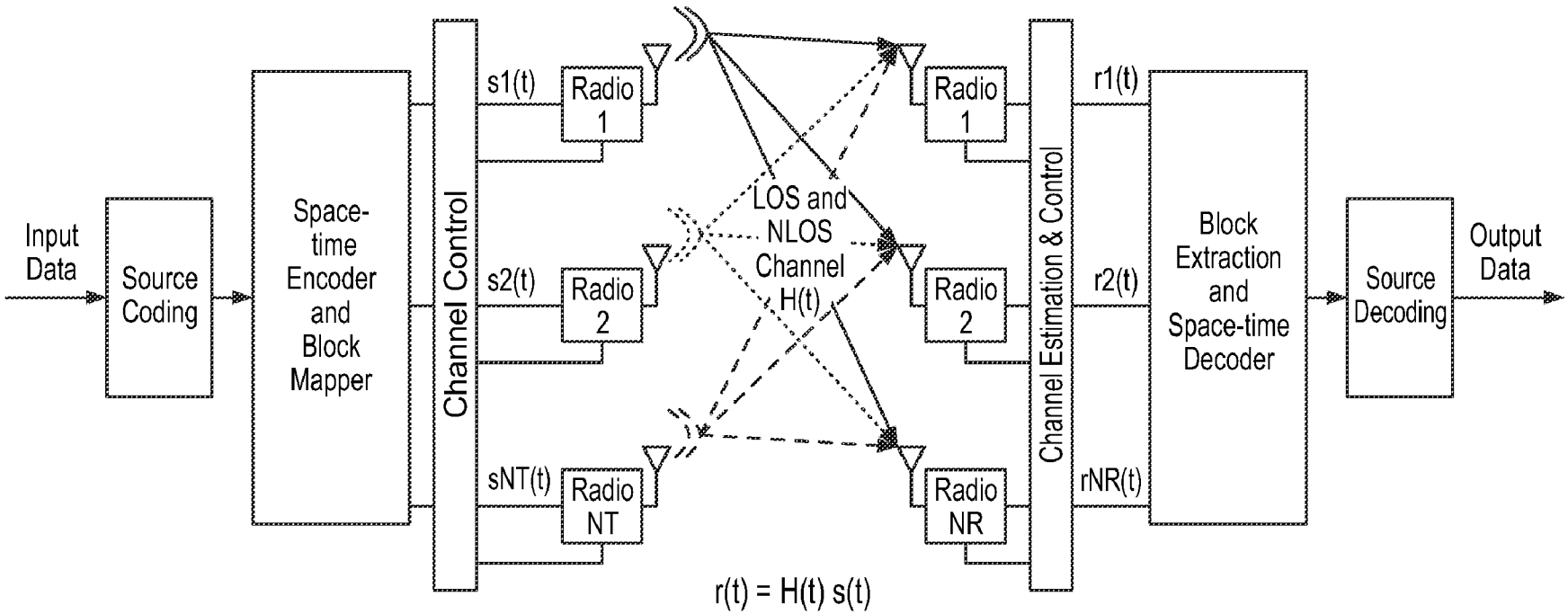

FIG. 9C shows MIMO Systems based on STBC algorithm.

In pre-MIMO era, SAs include phased array antennas transmitting identical signals shifted by amplitude, time of phase delay lines to shape or steer the beam (FIG. 9A). On the receiver side, similar analog tap delay lines are also used to scan, increase receiver gain in the transmit direction, and null unwanted signals. These phased array techniques are mostly in the analog domain and increases SNR by focusing signal energy in receiver direction, hence its limitation to LOS environments.

A transmit signal that bounces off obstacles (FIG. 8B) by reflection and/or diffraction processes, reaches the receiver as a collection of signals with different magnitude and with different delay times that lower the overall SNR causing what is referred to as "multipath interference" and injecting NLOS signals. Neither phased array antennas nor conventional SISO systems can overcome multipath interference and treat these signals as noise.

In a rich multipath environment, the transmit signal bounces off so many obstacles in a way that creates uncorrelated channels capable of carrying same (FIG. 9C) data stream or different data streams (FIG. 9B) from the transmitter to the receiver. These virtual channels are caused by spatially separated radiation sources and receiving elements (Spatial Diversity—SpDiv), orthogonal polarizations (Polarization Diversity—PoDiv), or different radiations patterns (Pattern Diversity—PaDiv). The MIMO channel can be characterized by the following equation:

$$H = \sum_{p=1}^{Paths} a_p^b \vec{e}_{Rx}(\Omega_{p,t}) \vec{e}_{TX}^{*}(\Omega_{p,t}) \tag{1}$$

$a_p$: path gain/amplitude $\Omega(\phi,\theta)$: angular orientation of Tx and Rx beams in reference to Tx and Rx antenna planes along the $p^{th}$ path.

$e(\phi,\theta)$: orientation and polarization of Tx and Rx beams.

Equation (1) identifies the channel viewed by each node. It is obvious that writing all terms in a fixed coordinate system presents a great challenge in term of complexity. It is for this reason that communication engineers assumed the simplest Channel Diversity (ChDiv) approach that is of SpDiv and focus on the digital algorithms that leverages multipath interference to boost Signal to Noise Ratio (SNR).

The digital transmit and receive signal view the channel differently. The Tx and Rx signal equations can be formulated as follows:

$$\begin{bmatrix} y_1 \\ \vdots \\ y_{NR} \end{bmatrix} = \begin{bmatrix} h_{11} & \dots & h_{1NT} \\ \vdots & \ddots & \vdots \\ h_{NR1} & \dots & h_{NRNT} \end{bmatrix} \begin{bmatrix} x_1 \\ \vdots \\ x_{NT} \end{bmatrix} + \begin{bmatrix} n_1 \\ \vdots \\ n_{NR} \end{bmatrix},$$

or $$\begin{bmatrix} y_1 \\ \vdots \\ y_{NR} \end{bmatrix} = \begin{bmatrix} u_{11} & \dots & u_{1NR} \\ \vdots & \ddots & \vdots \\ u_{NR1} & \dots & u_{NRn} \end{bmatrix} \begin{bmatrix} \lambda_1 & \dots & 0 \\ \vdots & \ddots & \vdots \\ 0 & \dots & \lambda_{NT} \end{bmatrix} \begin{bmatrix} v_{11}^* & \dots & v_{1NT}^* \\ \vdots & \ddots & \vdots \\ v_{NT1}^* & \dots & v_{NTNT}^* \end{bmatrix} \begin{bmatrix} x_1 \\ \vdots \\ x_{NT} \end{bmatrix} + \begin{bmatrix} n_1 \\ \vdots \\ n_{NR} \end{bmatrix},$$

where, the matrix H components are $h_{ij}$ and is decomposed to $H=U\Lambda V^*$. The entries to the matrices V and U are the weights needed to reorient the transmitted X and received Y vectors to create up to NT "virtual" uncorrelated parallel channels. Looking back to the Phased Array example in FIG. 9A, the digital U and V weights have similar effects to the analog weights that drive the phase shifters. So, a new concept that balances signal processing complexity between the digital and analog domains is necessary to not only optimize preference and reduce system complexity, but to also increase system efficiency.

The following describes channel diversity.

If the antenna separation is denoted by $\Delta\lambda_c$, where $\lambda_c$ is the free-space carrier wavelength and $\Delta$ is the normalized antenna separation to the carrier wavelength $\lambda_c$, to first order approximation the LOS paths (FIG. 8A) for linear arrays may be considered parallel at large distances between the transmitter and receiver as stated in Eq. (2):

$$d_{ik}=d-(i-1)\Delta_{Rx}\lambda_c \cos(\phi_{Rx})+(k-1)\Delta_{Tx}\lambda_c \cos(\phi_{Tx}) \quad i=1 \dots NT \text{ and } k=1 \dots NR \tag{2},$$

where d is the distance from the first Tx and Rx antennas, and $\phi_{Tx}$ and $\phi_{Rx}$ are the angles of incident of LOS onto the Tx and RX array planes respectively. This linear concept can be extended to 2D arrays, including but not limited to a membrane configuration shown in FIGS. 7 and 5.

In this case, the LOS channel matrix element is proportional to:

$$h_{ik} \propto e^{-j2\pi d/\lambda_c} \frac{e^{j2\pi[(i-1)\Delta_{Tx}\cos(\phi_{Tx})+w_i]}}{\sqrt{NT}} \frac{e^{-j2\pi[(k-1)\Delta_{RTx}\cos(\phi_{Rx})+w_k]}}{\sqrt{NR}} \tag{3}$$

$$i = 1 \dots NT \text{ and } k = 1 \dots NR$$

where the second and third terms represent the normalized Tx and Rx beamformers for omni-directional antenna elements with identical polarizations. The Tx and Rx weights are indicated by $w_i$ and $w_k$ respectively, and are responsible for directing the Tx beam and Rx gain. When each antenna element is characterized by different angular directions and polarizations, then these terms will be multiplied by the 3D vectors of the antenna patterns $e_i(\phi_i,\theta_i)$ and $e_k(\phi_k,\theta_k)$ (same as in Eq. (1)), where the azimuth and elevation angles are in reference to the $i^{th}$ and $k^{th}$ antenna element, respectively. FIG. 9A illustrates an example of a BS system with the Tx and Rx weights applied to each element.

When the total size of the antennas $L_{Tx}=(NT-1)\Delta_{Tx}\lambda_c$ and $L_{Rx}=(NR-1)\Delta_{Rx}\lambda_c$ are small compared to $\lambda_c$ then the combined Tx and Rx system cannot resolve signals that arrive with much less than $\lambda_c/L_{Rx}$ or $\lambda_c/L_{Rx}$ angular separation. In other words, and by using antenna reciprocity theorem, small size antennas have wide beam radiation and see signals from all directions. Hence, it is clear that with compact MIMO antennas, BS alone may be difficult to achieve in order to increase SNR between two user subscriber units. However, it can be accomplished when one of the nodes is a BS/AP. We denote "uplink" information transmitted from the user to the BS/AP, and "downlink" the reverse direction in asymmetric communication scenarios. Therefore, BS/AP can perform BS if it is transmitting or receiving to increase network throughput instead of single-link-based throughput by minimizing interference in densely populated cells. The subscriber antenna elements, collectively, have a much wider radiation beam in the direction of the BS/AP.

When the link between the Tx and Rx nodes include NLOS components, then Eq. (2) is modified to include terms reflecting the NLOS paths. FIG. 8B depicts an example that involves three paths: LOS, Multipath 1 (P1), and Multipath 2 (P2). Signals reflected by the surfaces S1 and S2 will change their direction of propagation, and possibly their polarization, and/or intensity, or both. These changes are determined by the locations, indexes of refraction and the textures/orientations ($\phi_{P1}$ and $\phi_{P2}$) of these surfaces. When the antenna elements are closely spaced, and if the reflecting obstacles are located far from both Tx and Rx antennas, then the distances $l^{P1}{}_{11,ik}$ and $l^{P2}{}_{11,ik}$ approach zero, however the difference in the $d_{ik}$, $d^{P1}{}_{ik}$, and $d^{P2}{}_{ik}$ paths allow the receiver to de-correlate three signals along these paths. In the case one of the nodes is a BS/AP, then the antenna elements are either spaced far apart or use beam-shaping, steering, or switching technique for the distances $l^{P1}{}_{11,ik}$ and $l^{P2}{}_{11,ik}$ to be different from zero to provide an extra dimension to channel diversity.

CRLH MTM antennas can be designed to allow reducing the size of the antenna elements and to allow for close spacing between them, while achieving at the same time reduced/minimal coupling between them and their corresponding RF chains. Such antennas can be used to achieve one or more of the following: 1) antenna size reduction, 2) optimal matching, 3) means to reduce coupling and restore pattern orthogonality between adjacent antennas by using directional couplers and matching network, and 4) potential integration of filters, diplexer/duplexer, and amplifiers. Antennas that includes item 4 are referred to by AA.

Various radio devices for wireless communications include analog/digital converters, oscillators (single for direct conversion or multiples for multi-step RF conversion), matching networks, couplers, filters, diplexer, duplexer, phase shifters and amplifiers. These components tend to be expensive elements, difficult to integrate in close proximity, and often exhibit significant losses in signal power. MTM-based filters and diplexer/duplexer can be also built and integrated with the antennas and power combiner, directional coupler, and matching network when present to form the RF-chain. Only the external port that is directly connected to the RFIC needs to comply with 50Ω regulation. All internal ports between antenna, filter, diplexer, duplexer, power combiner, directional coupler, and matching network can be different from 50Ω in order to optimize matching between these RF elements. Hence, MTM structures can be used to integrate these components in an efficient and cost-effective way is important.

CRLH Metamaterial technology allows for MIMO antenna miniaturization and potential integration with the feed, amplifier, and any power combiner/splitter. Such miniaturized MIMO antennas can be applied to 2D arrays of antenna elements that are closely spaced and span different geometries depending on the end device. For example, in some implementations, the membrane can be mounted on top of cell phones or along the edges of handheld PDAs and laptops as illustrated in FIG. 7. We refer to this structure as "MIMO Membrane" and it is typically located in areas not obstructed by user's hand. Since the MIMO mode is used for high-throughput application, it is highly unlikely that the user will place the device near its head to access multimedia or data applications. Furthermore, this innovative air-interface is capable to communicate with BS/AP using traditional SpDiv/PoDiv techniques as explained in the channel diversity section.

The membrane comprises of many RF elements that are integrated in a way, so that output M signals are fed from or back to the MIMO data channels via the weight adjustments and mapping between the M RF signals and NT/NR data streams. An example of weights adjustment and Mapper are the phase shifters and coupler stated above. FIG. 5 depicts a functional block diagram of a MIMO membrane.

Figure 10:
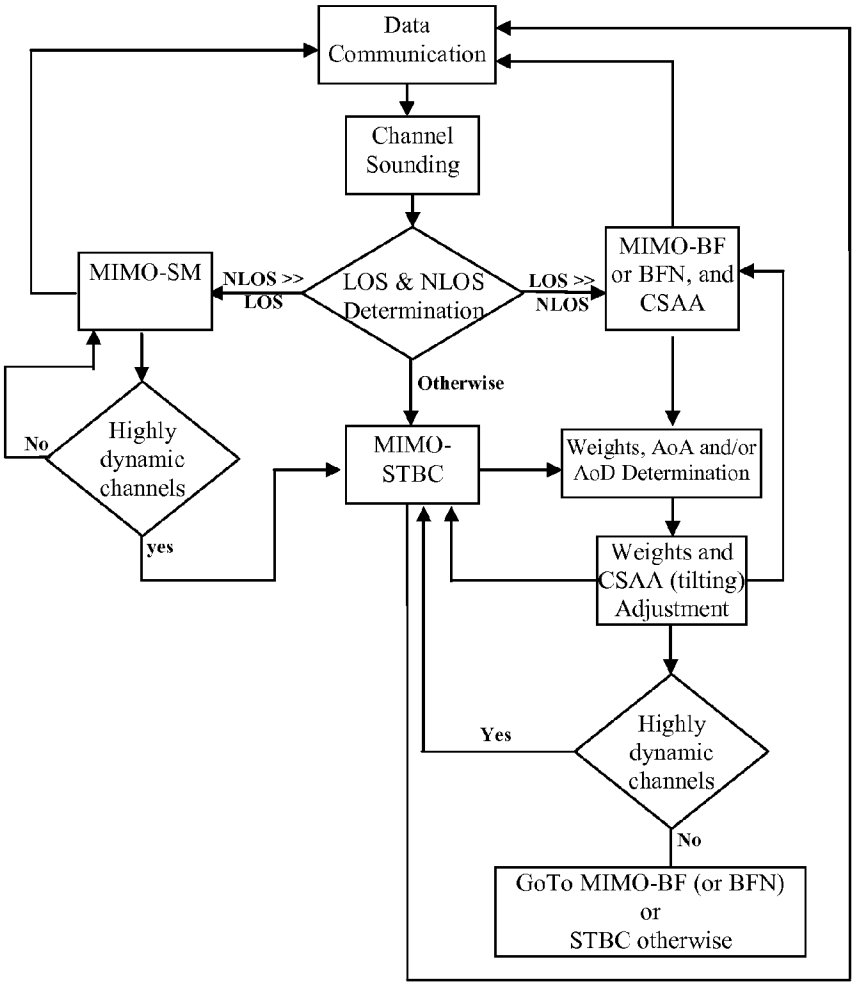
FIG. 10 illustrates one example of a control algorithm in a wireless network.

The MIMO systems depicted in FIGS. 9B and 9C describe the SM and STBC MIMO algorithms. The CRLH MTM based compact MIMO air-interface can be used to support both these algorithms and can dynamically adjust between them and the BS/AP BF and BFN algorithm to optimize link throughput in dynamic channels and various user's applications. The hybrid digital/analog algorithm is accomplished through the "Channel Control" functions in FIGS. 9B and 9C that balances between the digital signal processing weights adjustment (standard compliant) and analog weights (standard agnostic). The high-level functionality of the control algorithm is illustrated in FIG. 10. A digital processor is provided in the MIMO system as part of the communication device to implement the control algorithm. An analog-digital interface is coupled between the digital processor and the analog circuitry of the MIMO system.

Current MIMO-based standards and, possibly future ones as well, include channel sounding in addition to the OFDM signal tones to characterize the status of the channel diversity to derive the corresponding SM, STBC, or BF/BFN weights for optimizing throughput. These standards include packets dedicated for this functionality and are typically referred to by "Channel Feedback Matrix". So the algorithm can be implemented without violating MIMO standards. In a Time Division Duplexing (TDD) scenario, the bidirectional communication occurs over the same frequency band, and hence the channel sounding can be conducted in the uplink to leverage BS/AP large energy capacity. In the case the uplink and downlink occur over two frequency bands, channel sounding is required in both directions.

Since these small wireless communications devices, such as PCMCIA cards and handheld devices, are limited in power consumption, channel adaptation occurs in both the digital and analog domains to reduce the requirements for channel updates. Thus, the throughput can be maintained with less processing complexity, which translates into energy savings. This feature allows each subscriber unit to perform its own channel conditioning, hence the ability to support handheld-handheld MIMO links.

In FIG. 10, the channel sounding occurs first in the analog domain to determine if the signal is LOS or NLOS as illustrated in FIGS. 8A and 8B. This first order estimation gives the channel control preliminary information about the nature of the channel. If the channel is completely LOS (or LOS>>NLOS) component, then the BS/AP are informed to start using BS algorithms based on their calculations on the Angle of Arrival (AoA), Angle of Departure (AoD), or Beamformer weights sent by the subscriber unit. This functionality depends only on BS/AP functionality and all what the subscriber unit does is use all antenna elements collectively as if they were a single antenna to increase output power. The combined signal from antenna elements will behave as if they were a single large antenna. We refer to this functionality as Collective Single Antenna Array (CSAA) that includes the individual beam tilting functionality. The subscriber unit cannot support BS or nulling functionalities. Still in the LOS case, if the channel is highly dynamic, that is the weights constantly changes drastically in values, then select STBC, otherwise maintain the BF/BFN and CSAA.

The hybrid digital/analog domain beam-forming described in previous paragraph can be replaced with pure analog beam-forming, beam-steering, and beam-switching. If the signal is balanced between NLOS and LOS, then STBC algorithms are supported. In the case, NLOS components dominate, then SM is used if the channel is not highly dynamic, otherwise revert to the safer algorithm STBC.

The term dynamic channel is quantified by the norm $\|H(t+\tau)-H(t)\|>$cutoff parameter, where H is the NT×NR matrix that describes the channel. The quantification of the LOS and NLOS components can be accomplished at two stages. First at the analog level to give a coarse identification of the link: Definitely LOS, or a combination. The analog domain alone cannot determine the level of NLOS. It is up to the Channel Control digital signal processing to coarsely measure this factor.

MTM technologies can be used to design and develop radio frequency (RF) components and subsystems with performance similar to or exceeding conventional RF structures, at a fraction of existing sizes, for examples antenna size reduction as much as λ/40. One limitation of various MTM antennas (and resonators in general) is a narrow bandwidth around a resonating frequency in either single-band or multi-band antennas.

In this regard, this application describes techniques to design MTM-based broadband, multi-band, or ultra-wideband transmission line (TL) structure to be used in RF components and sub-systems such as antennas. The techniques can be used to identify suitable structures that are low-cost and easy to manufacture while maintaining high efficiency, gain, and compact sizes. Examples of such structures using full-wave simulation tools such as HFSS are also provided.

In one implementation, the design algorithm includes (1) Identifying structure resonant frequencies, and (2) Determining the dispersion curve slopes near resonances in order to analyze bandwidth. This approach provides insights and guidance for bandwidth expansion not only for TL and other MTM structures but also for MTM antennas radiating at their resonance frequencies. The algorithm also includes (3): once the BW size is determined to be realizable, finding a suitable matching mechanism for the feed line and edge termination (when present), which presents a constant matching load impedance ZL (or matching network) over a wide frequency band around the resonances. Using this mechanism, the BB, MB, and/or UWB MTM designs are optimized using Transmission Lines (TL) analysis and then adopted in Antenna designs through use of full-wave simulation tools such as HFSS.

MTM structures can be used to enhance and expand the design and capabilities of RF components, circuits, and subsystems. Composite Left Right Hand (CRLH) TL structures, where both RH and LH resonances can occur, exhibit desired symmetries, provide design flexibility, and can address specific application requirements such as frequencies and bandwidths of operation.

Various MTM 1D and 2D transmission lines suffer from narrowband resonances. The present designs allow for 1D and 2D broadband, multiband, and ultra-wideband TL structures that are capable of being implemented in antennas. In one design implementation, N-cell dispersion relations and input/output impedances are solved in order to set the frequency bands and their corresponding bandwidths. In one example, a 2-D MTM array is designed to include a 2D anisotropic pattern and uses two TL ports along two different directions of the array to excite different resonances while the rest of the cells are terminated.

The 2D anisotropic analysis has been conducted for a 1 input and 1 output TL, which matrix notation is denoted in Eq. II-1-1. Notably, an off center TL feed analysis is conducted to consolidate multiple resonances along the x and y directions in order to increase frequency bands.

$$\begin{pmatrix} Vin \\ Iin \end{pmatrix} = \begin{pmatrix} A & B \\ C & D \end{pmatrix} \begin{pmatrix} Vout \\ Iout \end{pmatrix} \quad \text{(II-1-1)}$$

One example design for a CRLH MTM array with a broadband resonance includes the following features: (1) 1D and 2D structure with reduced Ground Plane (GND) under the structure, (2) 2D anisotropic structure with offset feed with full GND under the structure, and (3) Improved termination and feed impedance matching.

Various designs for 1D and 2D CRLH MTM TL structures and antenna designs are described to provide broadband, multi-band, and ultra-wideband capabilities. Such designs can include one or more of the following features:

The 1D structure consists of N identical cells with shunt (LL, CR) and series (LR, CL) parameters. These five parameters determine the N resonant frequencies, corresponding bandwidth, and input/output TL impedance variations around these resonances.

These five parameters also decide the structure/antenna size. Hence careful consideration is given to target compact designs as small as λ/40 dimensions, where X is the propagation wavelength in free-space.

In both TL and antenna cases, the bandwidth over the resonances are expanded when the slope of dispersion curves near these resonances is steep. In the 1D case, it was proven that the slope equation is independent of the number of cells N leading to various ways to expand bandwidth.

It was found that structures with high RH frequency $\omega_R$ (i.e. low shunt capacitance CR and series inductance LR) have lager bandwidths. This is counter intuitive because low values of CR means higher frequency bands since most of the times suitable LH resonances occur near the shunt resonance $\omega_{SH}$, hence, lower LH resonances mean higher values of CR.

Low CR values can be achieved by truncating the GND area under the patches that are connected to the GND through the vias.

Once the frequency bands, bandwidth, and size are specified, the next step is to consider matching the structure to the feed-line and proper termination of edge cells to reach the targeted frequency bands and bandwidth.

Specific examples are given where BW increased with wider feed lines and adding a termination capacitor with values near matching values at the desired frequencies.

The biggest challenge in identifying appropriate feed/termination matching impedances is making them frequency independent over the desired bands. It is for this reason that we have conducted full analyses that select the structure with similar impedance values around the resonances.

In the course of conducting these analyses and running FEM simulations, we noticed the presence of different modes in the frequency gap. Typical LH ($n \leqq 0$) and RH ($n \geqq 0$) are TEM modes, whereas the modes between LH and RH are TE modes are considered mixed RH and LH modes.

These TE modes have higher BW in comparison with pure LH modes, and can be manipulated to reach lower frequencies for the same structure. In this application, we present some examples 2D structure is similar with much more complex analysis. The 2D advantage is the additional degrees of freedom it provides over the 1D structure.

In the 2D structure the bandwidth will be expanded following similar steps as in the 1D case as well as combining multiple resonances along the x and y directions to expand bandwidth as discussed below.

The 2D structure consists of Nx and Ny number of columns and rows respectively providing a total of Ny×Nx cells. Each cell is characterized by its series impedance Zx (LRx,CLx) and Zy (LRy,CLy) along the x and y axis respectively and shunt admittance Y (LL,CR).

Each cell is represented by a four-branch RF network with two branches along the x-axis and two along the y-axis. In 1D structure, the unit cell is represented by a two-branch RF network which is less complex to analyze than the 2D structure.

These cells are interconnected like a Lego structure through its four internal branches. In 1D the cells are interconnected through only two branches.

Its external branches, also referred to by edges, are either excited by external source (input port), serve as an output port, or terminated by "Termination Impedances". There are Ny×Nx edge branches in a 2D structure. In 1D structure, there are only two edge branches that can serve as input, output, input/output, or termination port. For example, a 1D TL structure that is used in an antenna design has one end serving as the input/output port and the other end terminated with Zt impedance, which is infinite in most cases representing the extended antenna substrate. Hence the 2D structure is a much more complex structure to be analyzed.

The most general case is when each cell is characterized by different values of its lump elements Zx(nx,ny), Zy(nx,ny, and Y(nx,ny) and all terminations Ztx(1,ny), Ztx(Nx,ny), Zt(nx,1), and Zt(nx,Ny) and feeds are inhomogeneous. Although, such a structure may have unique properties suitable for some applications, its analysis is very complex and implementations are far less practical than a more symmetric structure. This is of course in addition to exploring bandwidth expansion around resonance frequencies.

In the 2D part of this invention, we limit ourselves to cells with equal Zx, Zy, and Y along x-direction, y-direction, and through shunts respectively. Although structures with different values of CR are also common.

Although, the structure can be terminated by any impedances Ztx and Zty that optimize impedance matching along the Input and Output ports, for simplicity we consider infinite Ztx and Zty. Infinite impedances correspond to infinite substrate/ground-plane along these terminated edges.

Cases with non-infinite values of Ztx and Zty follow the same procedure in this invention with alternative matching constraints. An example of such non-infinite termination is manipulating surface currents to contain ElectroMagnetic (EM) waves within the 2D structure to allow for another adjacent 2D structure without causing any interference.

Another interesting case is when the input feed is placed at an offset location from the center of the one of the edge cell along the x or y direction. This translates in the EM wave propagating asymmetrically in both x and y directions even though the feed is along only one of these directions.

We outline the general Nx by Ny case and then solve it completely for a 1 by 2 structure as an example. For simplicity, we use symmetric cell structure.

In the Nx=1 Ny=2 case (denoted by 1×2), we allow the input to be along the (1,1) cell and output along the (2,1) cell. Then, we solve for the transmission [A B C D] matrix to compute the scattering coefficient S11 and S12.

Similar calculations are made for truncated GND, mixed RH/LH TE modes, and perfect H instead of E field GND.

Both 1D and 2D designs are printed on both sides of the substrate (2 layers) with vias in between, or on multilayer structure with additional metallization layers sandwiched between the top and bottom metallization layer.

Figure 11:
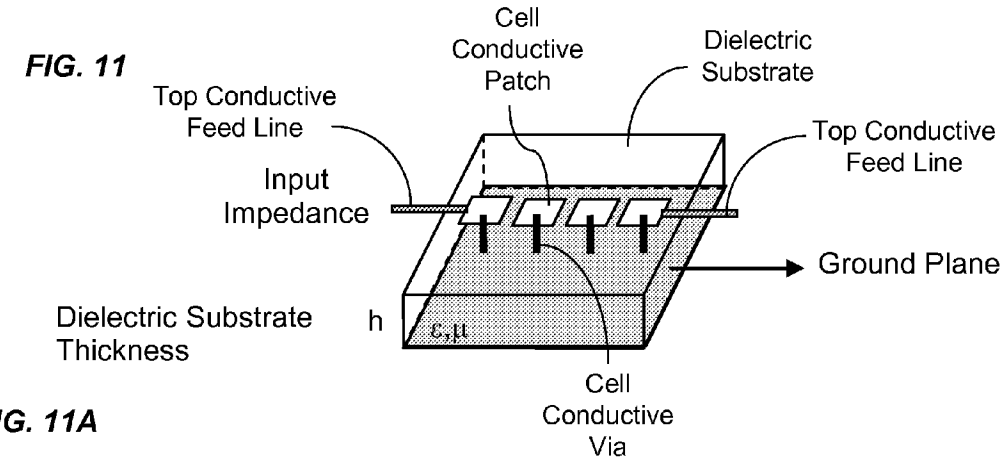
FIG. 11 shows an example of a CRLH MTM transmission line with four unit cells.
Figure 11A:
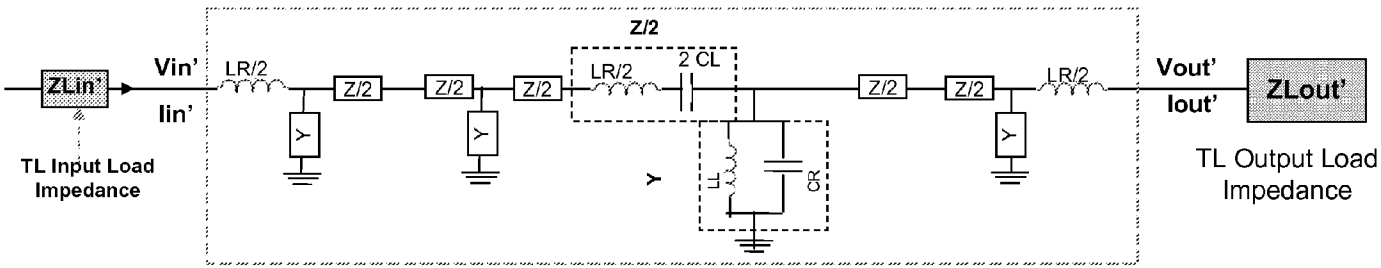
FIGS. 11A, 11B, 11C, 12A, 12B and 12C show equivalents circuits of the device in FIG. 11 under different conditions in either transmission line mode and antenna mode.

1D MTM TL and Antenna with Broadband (BB), Multi-Band (MB), and Ultra Wideband (UWB) Properties FIG. 11 provides an example of a 1D CRLH material TL based on four unit cells. The four patches are placed above a dielectric substrate with centered vias connected to the ground. FIG. 11A shows an equivalent network circuit analogy of the device in FIG. 11. The ZLin' and ZLout' corresponding the input and output load impedances respectively and are due to the TL couplings at each end. This is an example of a printed 2-layer structure. Referring to FIGS. 2A-2C, the correspondences between FIG. 11 and FIG. 11A are illustrated, where in (1) the RH series inductance and shunt capacitor are due to the dielectric being sandwiched between the patch and the ground plane. In (2) the series LH capacitance is due to the presence of two adjacent patches, and the via induces the shunt LH inductance.

The individual internal cell has two resonances $\omega_{SE}$ and $\omega_{SH}$ corresponding to the series impedance Z and shunt admittance Y. Their values are given by the following relation:

$$\omega_{SH} = \frac{1}{\sqrt{LL\ CR}};\ \omega_{SE}\frac{1}{\sqrt{LR\ CL}}; \qquad \text{(II-1-2)}$$

$$\omega_R = \frac{1}{\sqrt{LR\ CR}};\ \omega_L = \frac{1}{\sqrt{LL\ CL}}$$

where, $$Z = j\omega LR + \frac{1}{j\omega CL} \text{ and } Y = j\omega CR + \frac{1}{j\omega LL}$$

The two input/output edge cells in FIG. 11A do not include part of the CL capacitor since it represents the capacitance between two adjacent MTM cells, which are missing at these input/output ports. The absence of a CL portion at the edge cells prevents $\omega_{SE}$ frequency from resonating. Therefore, only $\omega_{SH}$ appears as an n=0 resonance frequency.

Figure 12A:
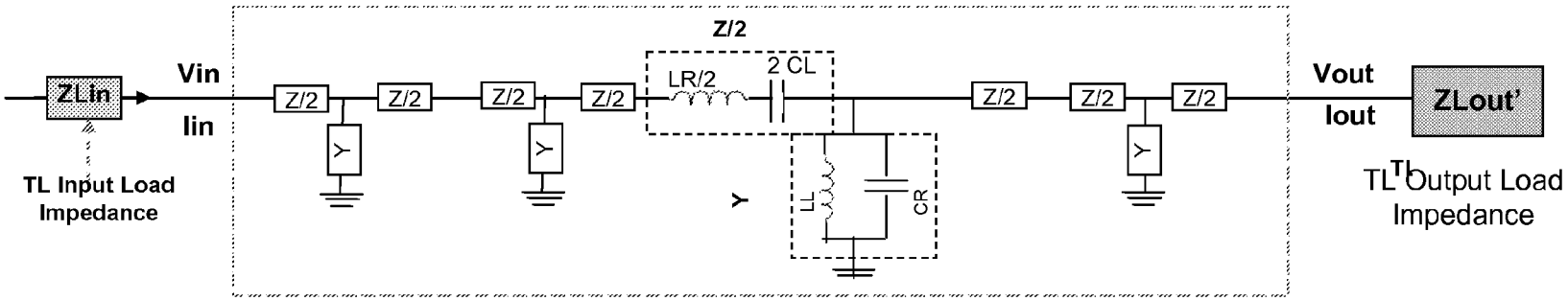

In order to simplify the computational analysis, we include part of the ZLin' and ZLout' series capacitor to compensate for the missing CL portion as seen in FIG. 12A. This way, all N cells have identical parameters.

Figure 11B:
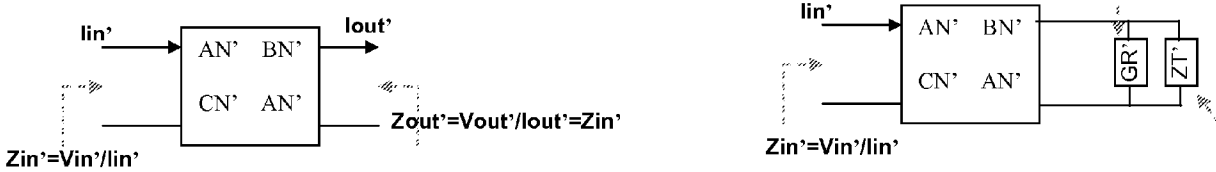
Figure 11C:
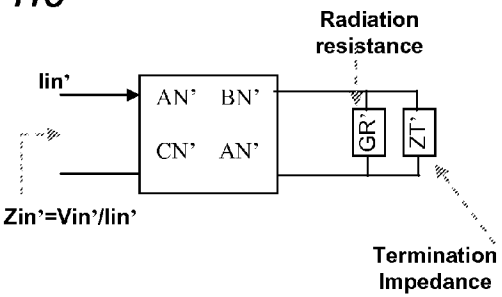
Figure 12B:
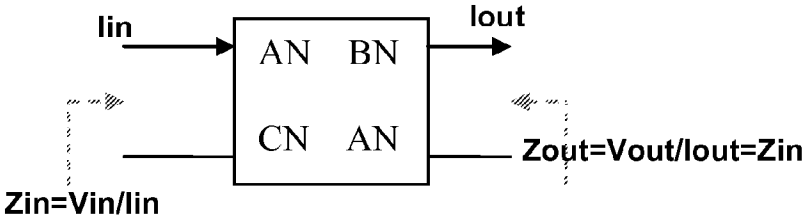
Figure 12C:
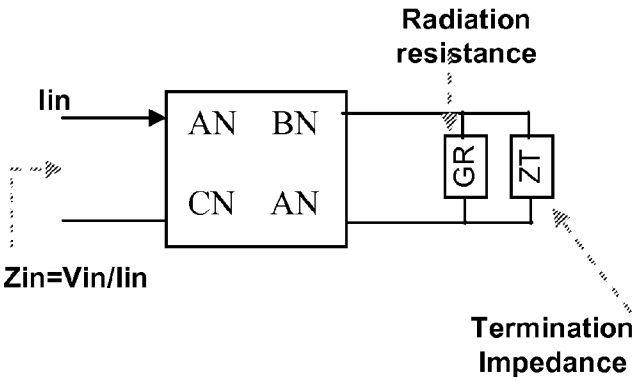

FIG. 11B and FIG. 12B provide the 2-ports network matrix of FIG. 11A and FIG. 12A, respectively, without the load impedances, and FIG. 11C and FIG. 12*c* provide the analogous antenna circuit when the TL design is used as an antenna. In matrix notations similar to Eq II-1-1, FIG. 12B represents the relation:

$$\begin{pmatrix} Vin \\ Iin \end{pmatrix} = \begin{pmatrix} AN & BN \\ CN & AN \end{pmatrix} \begin{pmatrix} Vout \\ Iout \end{pmatrix} \tag{II-1-3}$$

We have set AN=DN because the CRLH circuit in FIG. 12A is symmetric when viewed from Vin and Vout ends. GR is the structure corresponding radiation resistance and ZT is the termination impedance. Note that ZT is basically the desired termination of the structure in FIG. 11*b* with an additional 2CL series capacitor. The same goes for ZLin' and ZLout', in other terms:

$$ZLin' = ZLin + \frac{2}{j\omega CL}, \quad ZLout' = ZLin + \frac{2}{j\omega CL}, \quad ZT' = ZT + \frac{2}{j\omega CL} \tag{II-1-4}$$

Since GR is derived by either building the antenna or simulating it with HFSS, it is difficult to work with the antenna structure to optimize the design. Hence, it is preferable to adopt the TL approach and then simulate its corresponding antennas with various terminations ZT. Eq II-1-2 notation also holds for the circuit in FIG. 11A with the modified values AN', BN', and CN' which reflect the mission CL portion at the two edge cells.

1D CRLH Frequency Bands

The frequency bands are determined from the dispersion equation derived by letting the N CRLH cell structure resonates with $n\pi$ propagation phase length, where n=0, ±1, ±2, . . . ±N. Here, each of the N CRLH cells is represented by Z and Y in Eq II-1-2, which is different from the structure shown in FIG. 11A, where CL is missing from end cells. Hence, one might expect that the resonances associated with these two structures are different. However, extensive calculations show that all resonances are the same except for n=0, where both $\omega_{SE}$ and $\omega_{SH}$ resonate in the first structure and only $\omega_{SH}$ resonates in the second one (FIG. 11A). The positive phase offsets (n>0) corresponds to RH region resonances and the negative values (n<0) are associated with LH region.

The dispersion relation of N identical cells with the Z and Y parameters, which are defined in Eq II-1-2, is given by the following relation:

$$\begin{cases} N\beta p = \cos^{-1}(A_N), \Rightarrow |A_N| \le 1 \Rightarrow 0 \le \chi = -ZY \le 4\forall^5 N \\ \text{where } A_N = 1 \text{ at even resonances } |n| = 2m \in \begin{Bmatrix} 0, 2, 4, \ldots 2\times \\ \mathrm{Int}\left(\frac{N-1}{2}\right) \end{Bmatrix} \\ \text{and } A_N = -1 \text{ at odd resonances } |n| = 2m+1 \in \begin{Bmatrix} 1, 3, \ldots \\ \left(2\times\mathrm{Int}\left(\frac{N}{2}\right)-1\right) \end{Bmatrix} \end{cases} \tag{II-1-5}$$

where, Z and Y are given by Eq II-1-2 and AN is derived from either the linear cascade of N identical CRLH circuit or the one shown in FIG. 12A and p is the cell size. Odd n=(2m+1) and even n=2m resonances are associated with AN=−1 and AN=1, respectively. For AN' in FIG. 11A and FIG. 11B and due to the absence of CL at the end cells, the n=0 mode resonates at $\omega_0=\omega_{SH}$ only and not at both $\omega_{SE}$ and $\omega_{SH}$ regardless of the number of cells. Higher frequencies are given by the following equation for the different values of $\chi$ specified in Table 1:

$$\text{For } n > 0,\ \omega_{\pm n}^2 = \frac{\omega_{SH}^2 + \omega_{SE}^2 + M\omega_R^2}{2} \pm \sqrt{\left(\frac{\omega_{SH}^2 + \omega_{SE}^2 + M\omega_R^2}{2}\right)^2 - \omega_{SH}^2\omega_{SE}^2} \tag{II-1-6}$$

Table 1 provides $\chi$ values for N=1, 2, 3, and 4. Interestingly, the higher resonances |n|>0 are same regardless if the full CL is present at the edge cells (FIG. 12A) or absent (FIG. 11A). Furthermore, resonances close to n=0 have small $\chi$ values (near $\chi$ lower bound 0), whereas higher resonances tend to reach $\chi$ upper bound 4 as stated in Eq II-1-5.

TABLE 1

Resonances for N = 1, 2, 3 and 4 cells.

| N\ Modes | \|n\| = 0 | \|n\| = 1 | \|n\| = 2 | \|n\| = 3 |
|---|---|---|---|---|
| N = 1 | $\chi_{(1,0)} = 0$; $\omega_0 = \omega_{SH}$ | | | |
| N = 2 | $\chi_{(2,0)} = 0$; $\omega_0 = \omega_{SH}$ | $\chi_{(2,1)} = 2$ | | |
| N = 3 | $\chi_{(3,0)} = 0$; $\omega_0 = \omega_{SH}$ | $\chi_{(3,1)} = 1$ | $\chi_{(3,2)} = 3$ | |
| N = 4 | $\chi_{(4,0)} = 0$; $\omega_0 = \omega_{SH}$ | $\chi_{(4,1)} = 2 - \sqrt{2}$ | $\chi_{(4,2)} = 2$ | |

An illustration of the dispersion curve β as a function of omega is provided in FIG. 12 for both the $\omega_{SE}=\psi_{SH}$ balanced (FIG. 12A) and $\omega_{SE}\neq\omega_{SH}$ unbalanced (FIG. 11B) cases. In the latter case, there is a frequency gap between min($\omega_{SE}$,$\omega_{SH}$) and max ($\omega_{SE}$,$\omega_{SH}$). The limiting frequencies $\omega_{min}$ and $\omega_{max}$ values are given by the same resonance equations in Eq II-1-6 with X reaching its upper bound $\chi$=4 as stated in the following equations:

$$\omega_{min}^2 = \frac{\omega_{SH}^2 + \omega_{SE}^2 + 4\omega_R^2}{2} - \sqrt{\left(\frac{\omega_{SH}^2 + \omega_{SE}^2 + 4\omega_R^2}{2}\right)^2 - \omega_{SH}^2\omega_{SE}^2} \tag{II-1-7}$$

-continued $$\omega_{max}^2 = \frac{\omega_{SH}^2 + \omega_{SE}^2 + 4\omega_R^2}{2} + \sqrt{\left(\frac{\omega_{SH}^2 + \omega_{SE}^2 + 4\omega_R^2}{2}\right)^2 - \omega_{SH}^2\omega_{SE}^2}$$

Figure 13A:
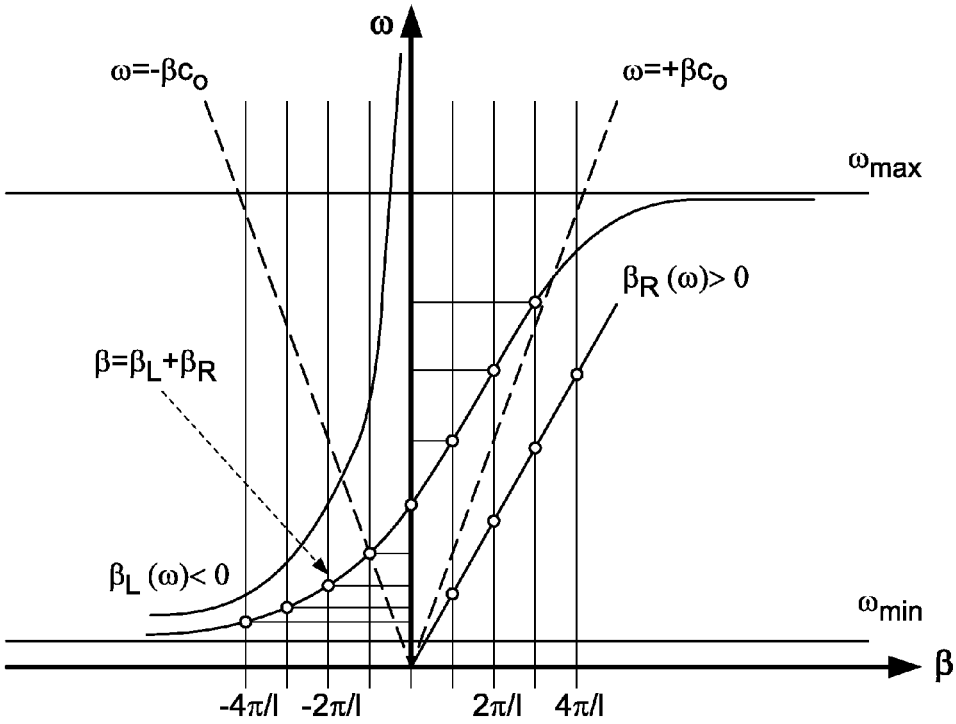
FIGS. 13A and 13B show examples of the resonance position along the beta curves in the device in FIG. 11.
Figure 13B:
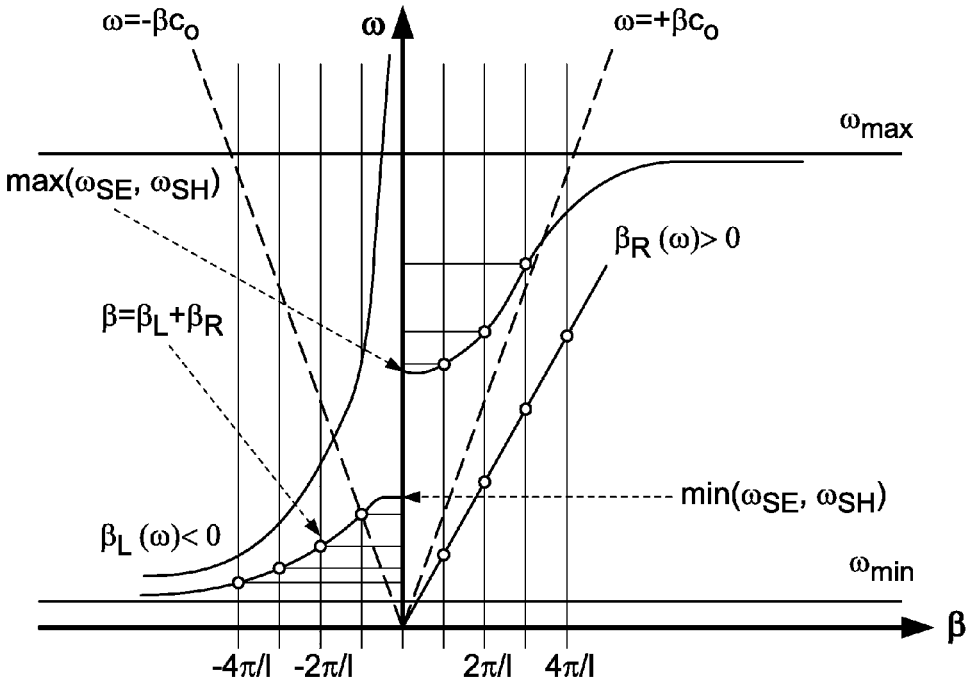

FIGS. 13A and 13B provide examples of the resonance position along the beta curves. FIG. 13A illustrates the balanced case where LR CL=LL CR, and FIG. 13B shows the unbalanced case with the gap between LH and RH regions.

In the RH region (n>0) the structure size l=Np, where p is the cell size, increases with decreasing frequencies. Compared to the LH region, lower frequencies are reached with smaller values of Np, hence size reduction. The β curves provide some indication of the bandwidth around these resonances. For instance, it is clear that LH resonances suffer from narrow bandwidth because the β curves are almost flat. In the RH region bandwidth should be higher because the β curves are steeper, or in other terms:

$$COND1\text{: } 1^{st}\ BB \text{ condition } \left|\frac{d\beta}{d\omega}\right|_{res} = \left|-\frac{\frac{d(AN)}{d\omega}}{\sqrt{(1-AN^2)}}\right|_{res} << 1 \text{ near } \omega = \omega_{res} = \omega_0, \omega_{+1}, \omega_{+2} \ldots \Rightarrow \left|\frac{d\beta}{d\omega}\right| = \left|\frac{\frac{d\chi}{d\omega}}{2p\sqrt{\chi\left(1-\frac{\chi}{4}\right)}}\right|_{res} << 1 \text{ with}$$

$$p = \text{cell size and } \left.\frac{d\chi}{d\omega}\right|_{res} = \frac{2\omega_{\pm n}}{\omega_R^2}\left(1 - \frac{\omega_{SE}^2\omega_{SH}^2}{\omega_{\pm n}^4}\right) \quad \text{(II-1-8)}$$

where, χ is given in Eq II-1-5 and $\omega_R$ is defined in Eq II-1-2. From the dispersion relation in Eq II-1-5 resonances occur when |AN|=1, which leads to a zero denominator in the $1^{st}$ BB condition (COND1) of Eq II-1-8. As a reminder, AN is the first transmission matrix entry of the N identical cells (FIG. 12A and FIG. 12B). The calculation shows that COND1 is indeed independent of N and given by the second equation in Eq II-1-8. It is the values of the numerator and χ at resonances, which are defined in Table 1, that define the slope of the dispersion curves, and hence possible bandwidth. Targeted structures are at most Np=X/40 in size with BW exceeding 4%. For structures with small cell sizes p, Eq II-1-8 clearly indicates that high $\omega_R$ values satisfy COND1, i.e. low CR and LR values since for n<0 resonances happens at χ values near 4 Table 1, in other terms (1−λ/4→0).

1D CRLH TL Matching

As previously indicated, once the dispersion curve slopes have steep values, then the next step is to identify suitable matching. Ideal matching impedances have fixed values and do not require large matching network footprints. Here, the word "matching impedance" refers to feed lines and termination in case of a single side feed such as antennas. In order to analyze input/output matching network, Zin and Zout need to be computed for the TL circuit in FIG. 12B. Since the network in FIG. 12A is symmetric, it is straightforward to demonstrate the Zin=Zout. We have also demonstrated that Zin is independent of N as indicated in the equation below:

$$Zin^2 = \frac{BN}{CN} = \frac{B1}{C1} = \frac{Z}{Y}\left(1 - \frac{\chi}{4}\right), \quad \text{(II-1-9)}$$

which has only positive real values

The reason that B1/C1 is greater than zero is due to the condition of |AN|≦1 in Eq II-1-5 which leads to the following impedance condition:

$$0 \leqq -ZY = \chi \leqq 4.$$

The $2^{ed}$ BB condition is for Zin to slightly vary with frequency near resonances in order to maintain constant matching. Remember that the real matching Zin' includes a portion of the CL series capacitance as stated in Eq II-1-4.

$$COND2\text{: } 2^{ed}\ BB \text{ condition: near resonances,} \quad \left.\frac{dZin}{d\omega}\right|_{near\ res} << 1 \quad \text{(II-1-10)}$$

Antenna Impedance Matching

Unlike the TL example in FIG. 11 and FIG. 11B, antenna designs have an open-ended side with an infinite impedance which typically poorly matches structure edge impedance. The capacitance termination is given by the equation below:

$$Z_T = \frac{AN}{CN} \text{ which depends on } N \text{ and is purely imaginary} \quad \text{(II-1-11)}$$

Since LH resonances are typically narrower than the RH ones, selected matching values are closer to the ones derived in the n<0 than the n>0.

1D CRLH Structure with Truncated GND

In order to increase the bandwidth of LH resonances, the shunt capacitor CR can be reduced. This reduction leads to higher (OR values of steeper beta curves as explained in Eq. II-1-8. There are various ways to decrease CR, including: 1) increase substrate thickness, 2) reduce top cell patch area, or 3) reduce the GND under the top cell patch. In designing the devices, any one of these three methods may be combined to produce the final design.

Figure 14A:
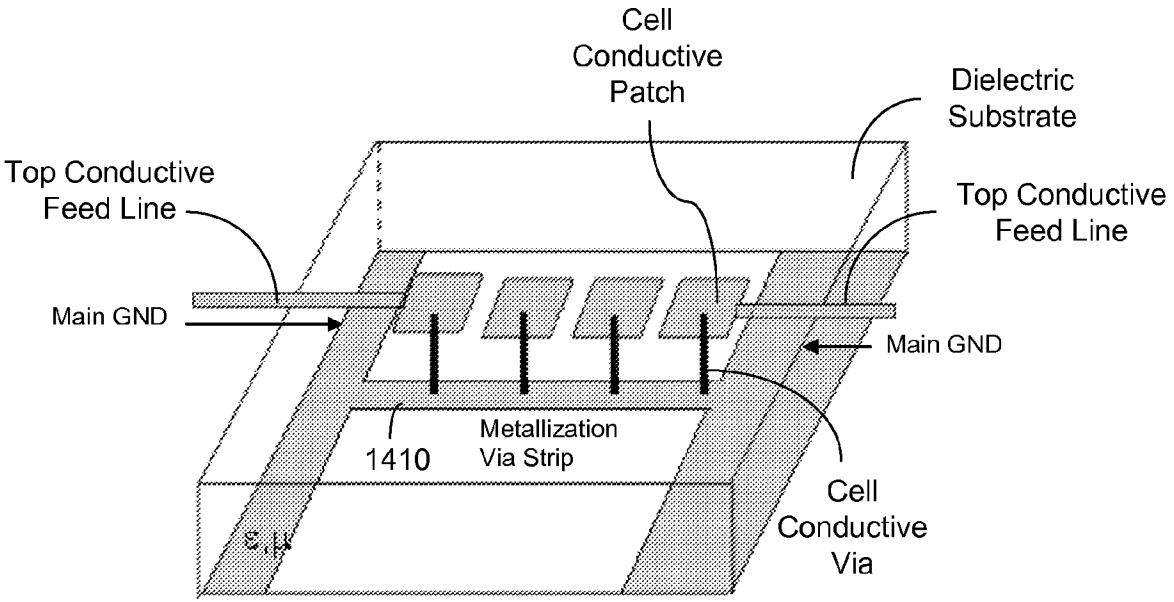
FIGS. 14A and 14B show an example of a CRLH MTM device with a truncated ground conductive layer design.
Figure 14B:
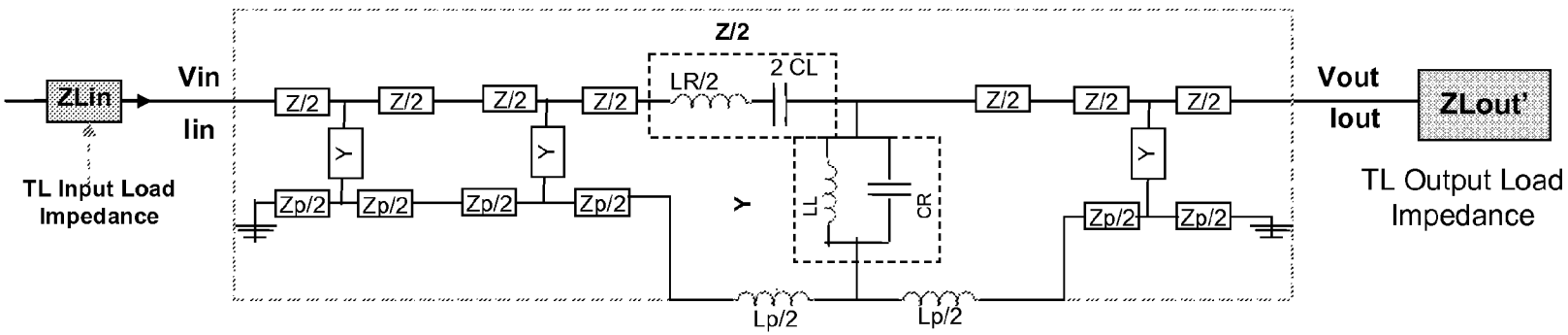

FIG. 14A illustrates one example of a truncated GND where the GND has a dimension less than the top patch along one direction underneath the top cell patch. The ground conductive layer includes a strip line 1410 that is connected to the conductive via connectors of at least a portion of the unit cells and passes through underneath the conductive patches of the portion of the unit cells. The strip line 1410 has a width less than a dimension of the conductive path of each unit cell. The use of truncated GND can be more practical than other methods to implement in commercial devices where the substrate thickness is small and the top patch area cannot be reduced because of lower antenna efficiency. When the bottom GND is truncated, another inductor Lp (FIG. 14B) appears from the metallization strip that connects the vias to the main GND as illustrated in FIG. 14A.

Figure 15A:
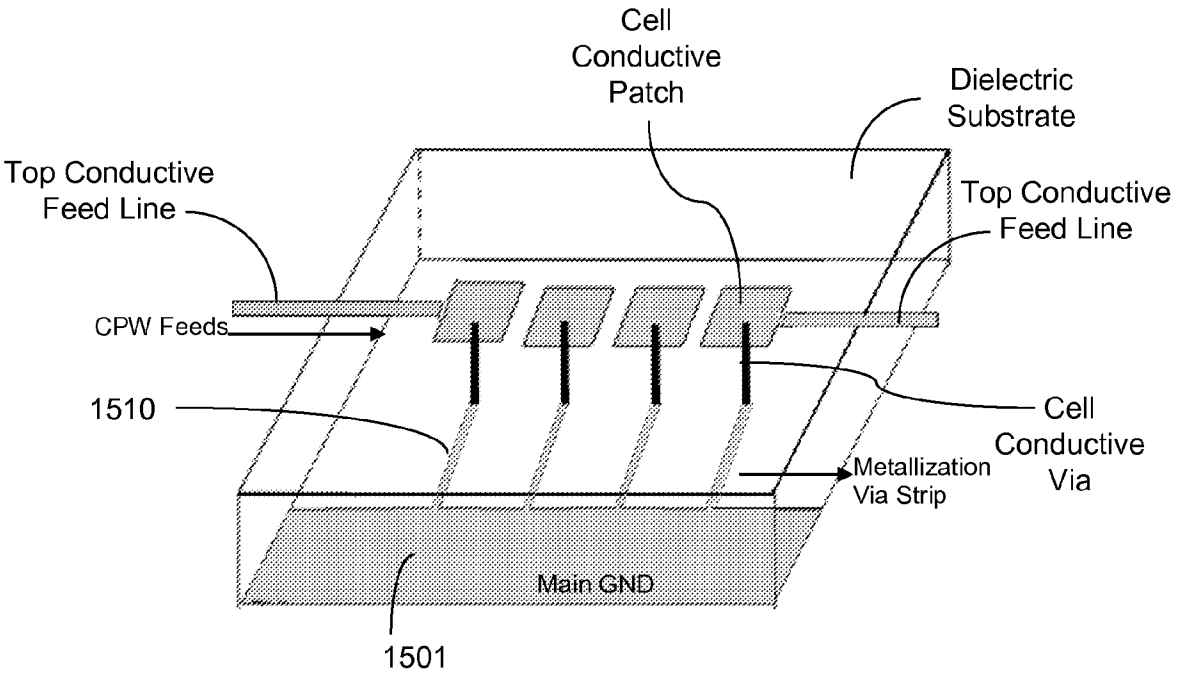
FIGS. 15A and 15B show another example of a CRLH MTM device with a truncated ground conductive layer design
Figure 15B:
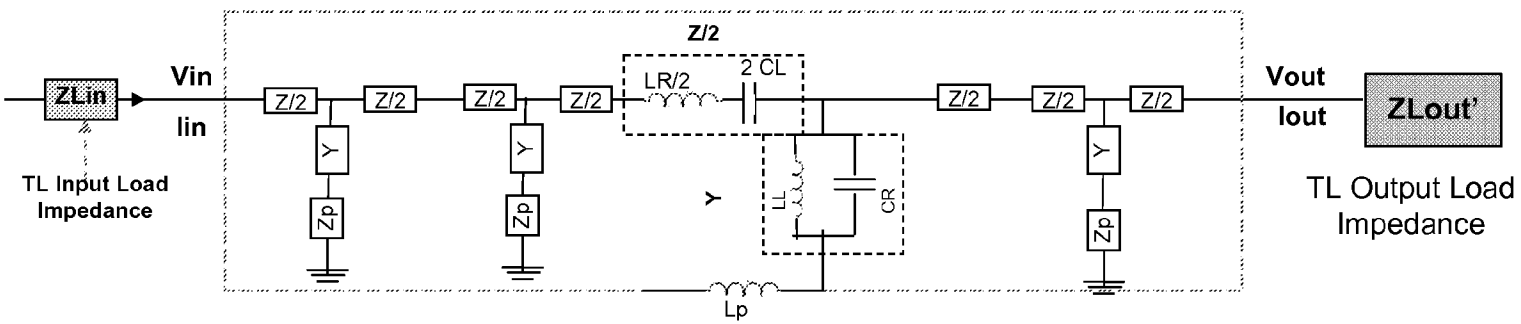

FIGS. 15A and 15B show another example of a truncated GND design. In this example, the ground conductive layer includes a common ground conductive area 1501 and strip lines 1510 that are connected to the common ground conductive area 1501 at first distal ends of the strip lines 1510 and having second distal ends of the strip lines 1510 connected to conductive via connectors of at least a portion of the unit cells underneath the conductive patches of the portion o the unit cells. The strip line has a width less than a dimension of the conductive path of each unit cell.

The equations for truncated GND can be derived. The resonances follow the same equation as in Eq II-1-6 and Table 1 as explained below:

Approach 1(FIGS 14*A* and 14*B*): (II-1-12)

Resonances: same as in Eq II-1-2, 6, 7 and Table one after replacing $LR$ by $LR + Lp$ $CR$ becomes very small Furthermore, for $|n| \neq 0$ each mode has two resoances corresponding to 1) $\omega_{\pm n}$ for $LR \rightarrow LR + LP$ 2) $\omega'_{\pm n}$ for $LR \rightarrow LR + LP/N$, where $N$ is the number of cells The impedance equation becomes:

$$Zin^2 = \frac{BN}{CN} = \frac{B1}{C1}\frac{Z}{Y}\left(1 - \frac{\chi + \chi_P}{4}\right)\frac{(1 - \chi - \chi_P)}{(1 - \chi - \chi_P/N)},$$

where $\chi = -YZ$ and $\chi = -YZ_P$, $Z_P = j\omega L_P$, and $Z$, $Y$ are defined in Eq II-1-3

From the impedance equation in Eq II-1-12, it is clear that the two resonances ω and ω' have low and high impedance respectively. Hence, it is always easier to tune near the ω resonance.

Approach 2(FIGS 15*A* and 15*B*): (II – 1 – 13)

Resonances: same as in Eq II – 1 – 2, 6, 7 and Table one after replacing $LL$ by $LL + Lp$ $CR$ becomes very small In the second approach case, the combined shunt induction (LL+Lp) increases while the shunt capacitor decreases which leads to lower LH frequencies.

ANTENNA EXAMPLES

The antennas described in the examples below consist of:

50Ω CPW (co-planar waveguide) feed line (top layer)

Top ground (GND) around the CPW feed line (top layer)

Launch pad (top layer)

Single cell: top metallization cell patch (top layer), via connecting top and bottom layers, and a narrow strip connecting the via to the main bottom GND (bottom layers).

The antennas were simulated using HFSS EM simulation software. In addition some of the designs were fabricated and characterized by measurements.

Antenna element parts

| Parameter | Description | | Location |
|---|---|---|---|
| Antenna Element | Each antenna element consists of an MTM Cell connected to the 50 Ω CPW line via a Launch Pad and Feed Line. Both Launch Pad and Feed Line are located on the top of substrate. | | |
| Feed Line | Connects the Launch Pad with the 50 Ω CPW line. | | Top Layer |
| Launch Pad | Rectangular shape that connects MTM cell to the Feed Line. There is a gap, $W_{Gap}$, between the launch pad and MTM cell. | | Top Layer |
| MTM Cell | Cell Patch | Rectangular shape | Top Layer |
| | Via | Cylindrical shape and connects the Cell Patch with the GND Pad. | |
| | GND Pad | Small square pad that connects the bottom part of the via to the GND Line. | Bottom Layer |
| | GND Line | Connects the GND Pad, hence the MTM cell, with the main GND | Bottom Layer |

These examples feature truncated ground conductive layer in various geometries.

Example 1

λ/48×λ/20 2×2 WiFi for USB Dongle

Figure 16A:
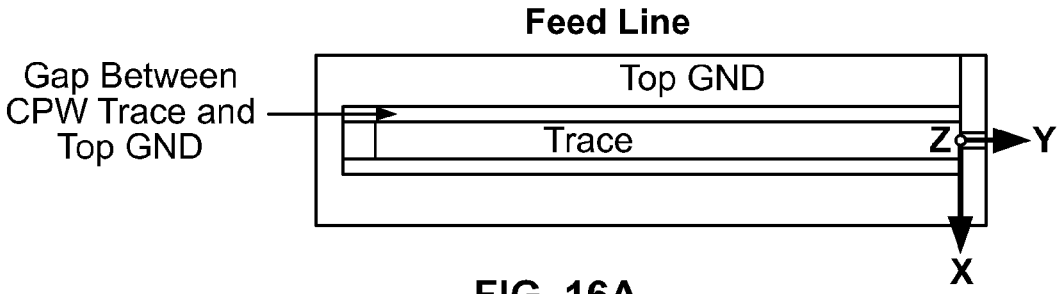
FIG. 16A through 19D show examples of CRLH MTM antennas.
Figure 16B:
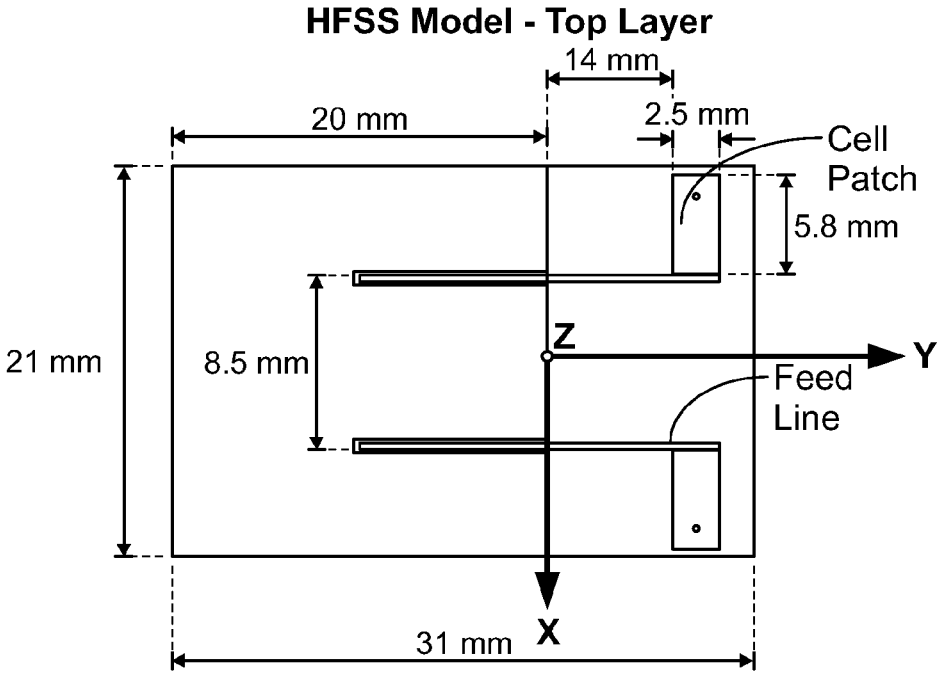
Figure 16C:
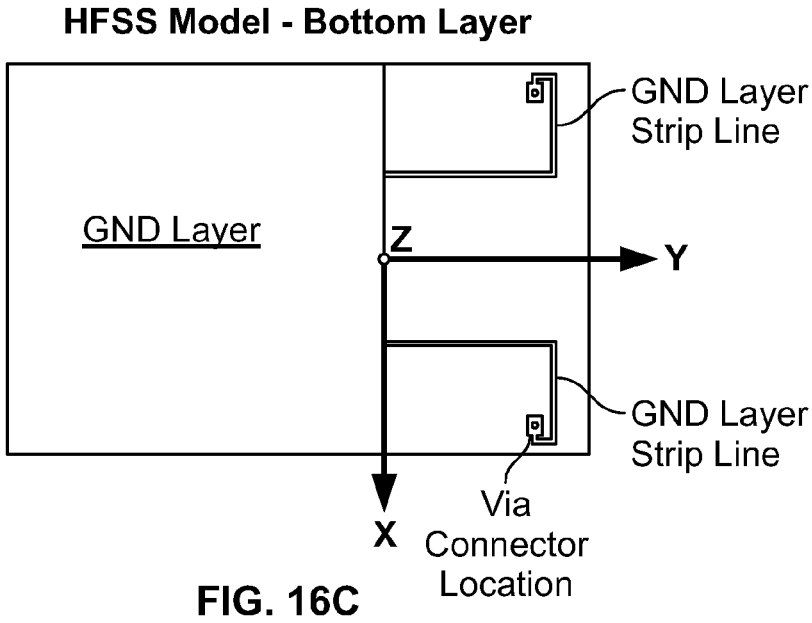
Figure 16D:
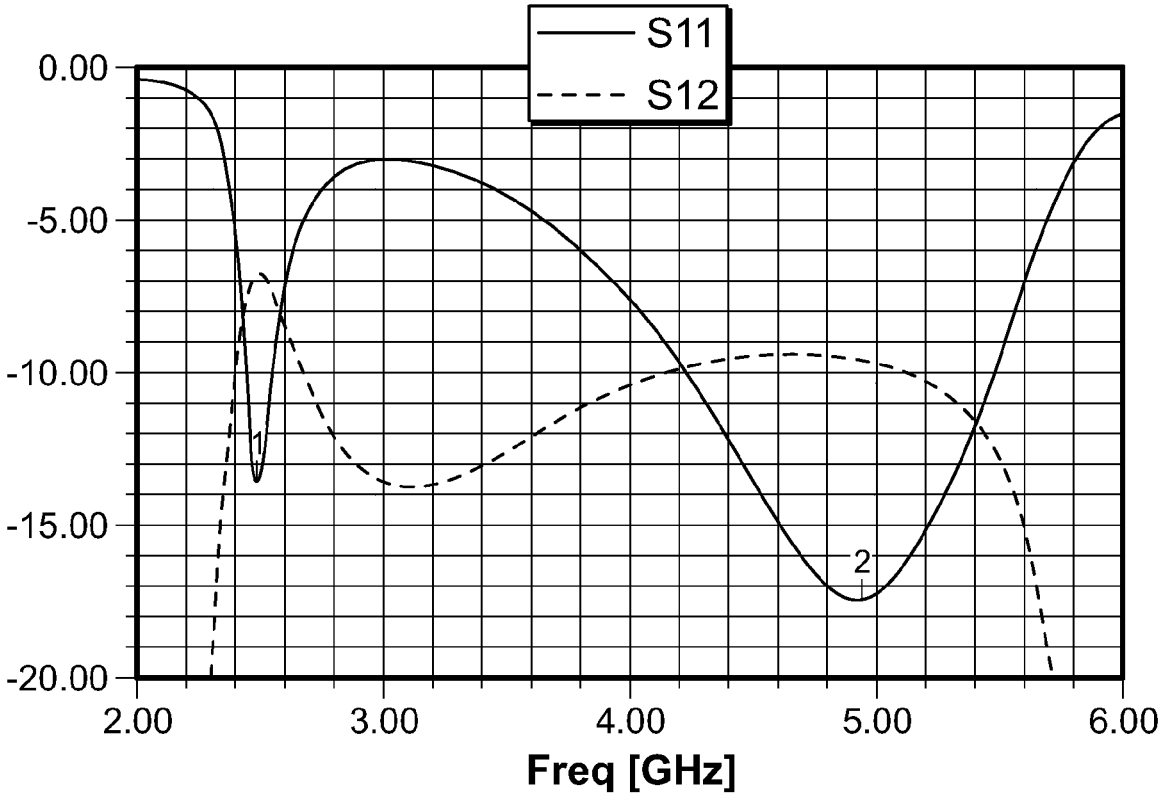
Figure 16E:
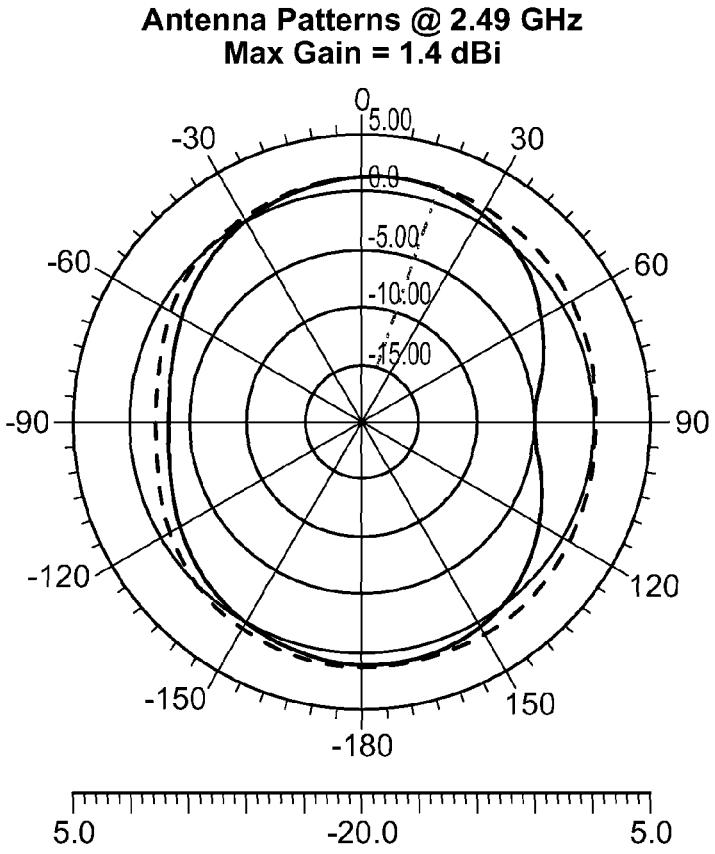
Figure 16E:
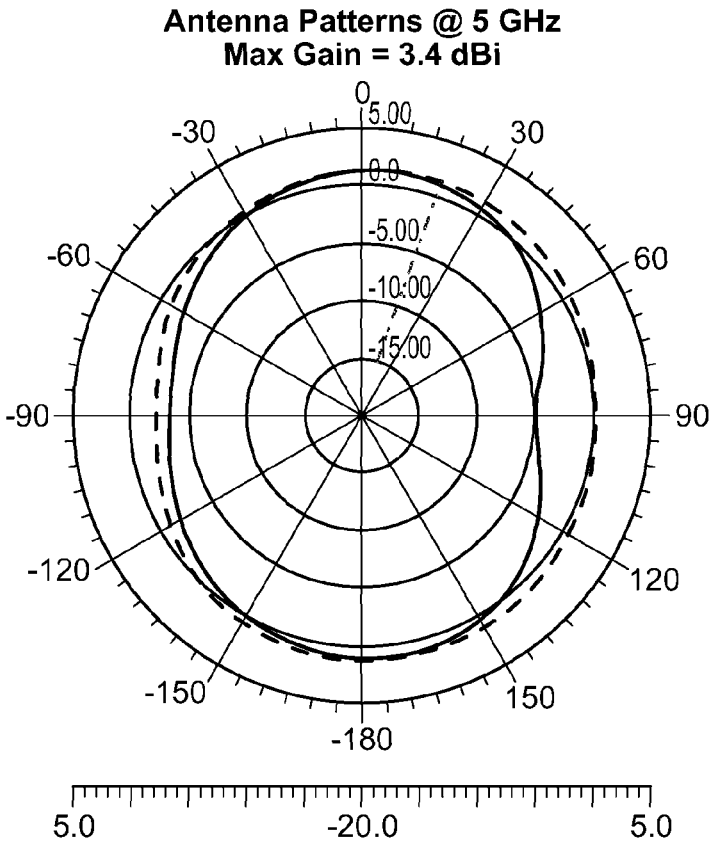

The MIMO antenna design and HFSS simulation results are illustrated in FIGS. 16A, 16B and 16C. It is a 2×2 MIMO USB Dongle that operates at 2.4 GHz and 5 GHz bands. The size of the antenna is λ/48×λ/20 at 2.5 GHz frequency.

The substrate is FR4 with dielectric constant ∈=4.4 and with width=21 mm, L=31 mm, and thickness h=0.787 mm.

GND size is 21×20 mm.

The cell size is 2.5×5.8 mm and is located at 14 mm away for the top GND.

The CPW trace width is 0.3 mm and gap 0.15 mm from top GND as indicated in FIG. 16*a*.

At −10 dB the bands are 2.44-2.55 and 4.23-5.47

The maximum simulated gains are 1.4 dBi at 2.49 GHz and 3.4 dBi at 5.0 GHz, which is an indication that the antennas have adequate efficiency given its extremely small size. The bandwidth is near 5% at 2.4 GHz.

Example 2

Small 2×2 WiFi for USB Dongle (Shaped Cell)

Figure 17A:
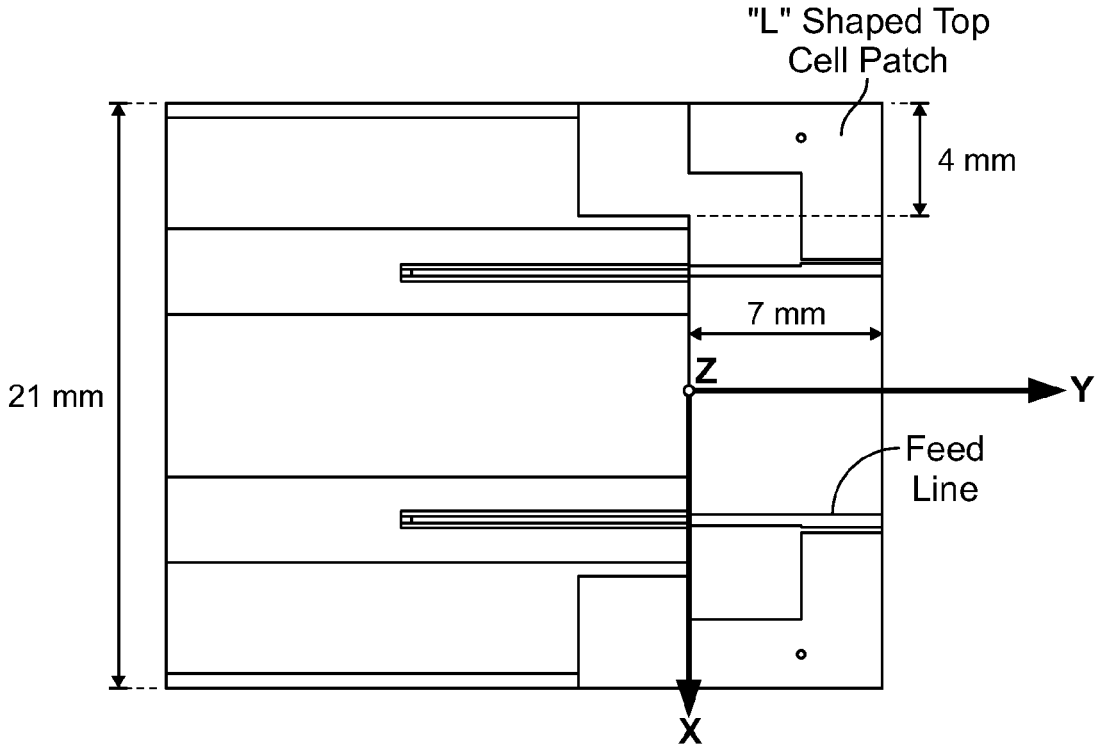
Figure 17B:
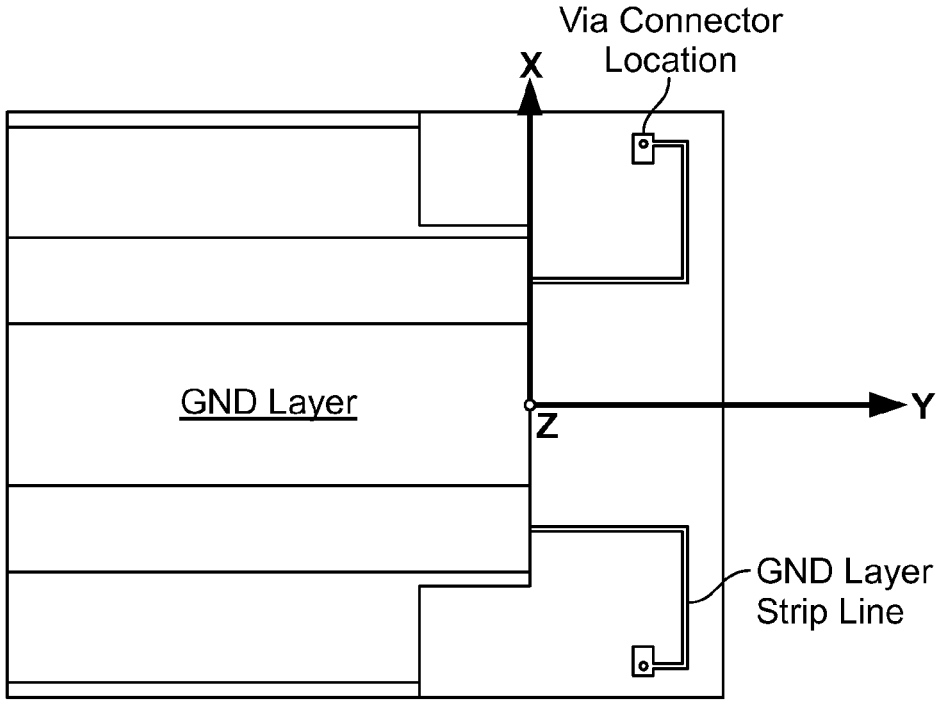
Figure 17C:
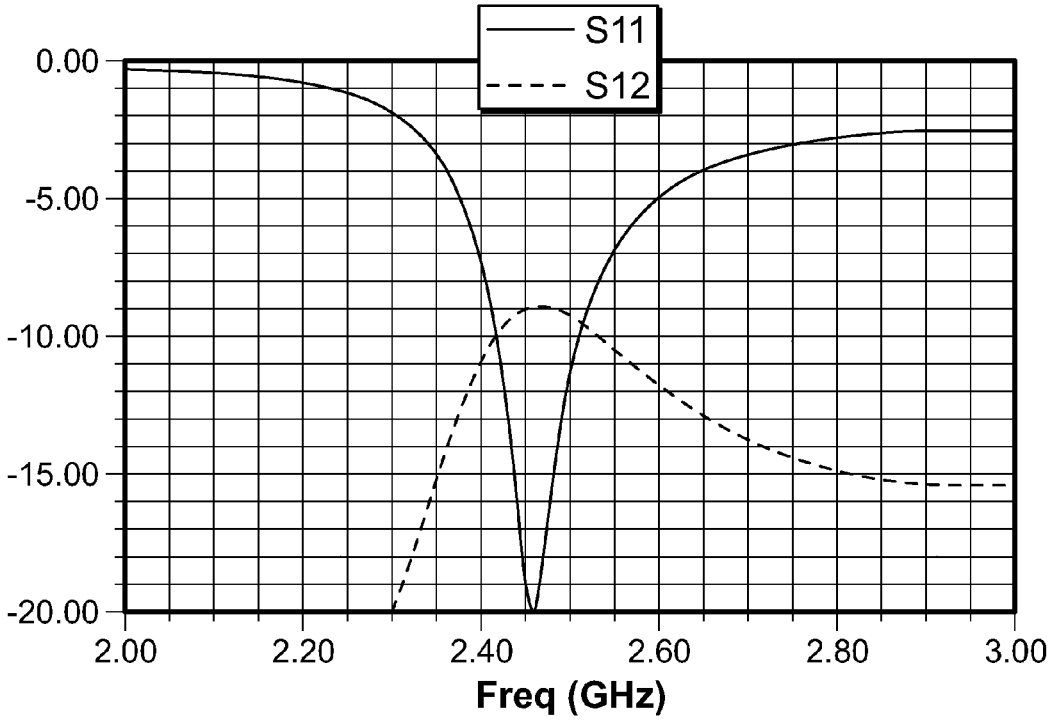
Figure 17D:
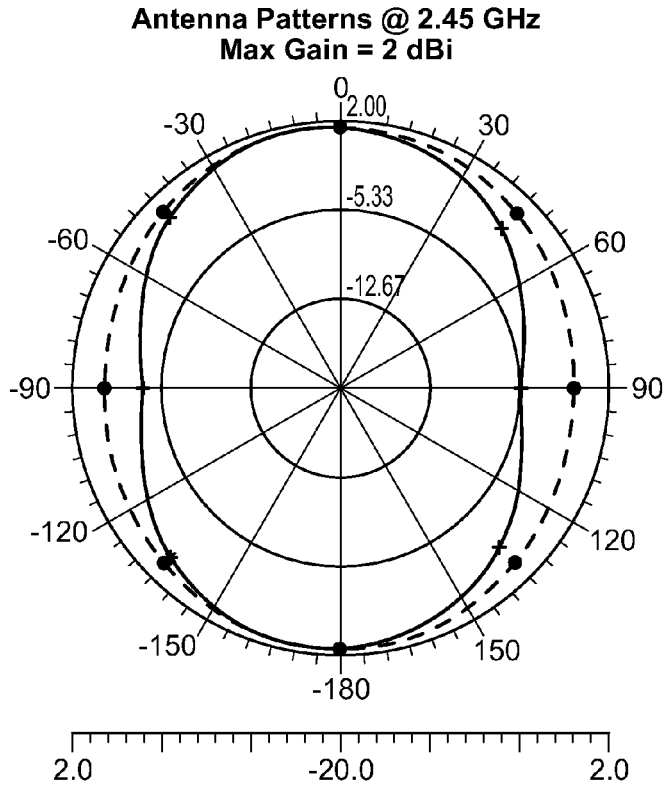

Another MIMO antenna design and HFSS simulation results are illustrated in FIGS. 17A, 17B and 17C. Compared with FIG. 16 antennas, this antennas have better isolation at 2.4 GHz and maximum gain of 2 dBi, which are indications of better performance. This antenna is an example that the geometrical shape of the cell patch can take any shape provided the presence of a via.

The substrate is FR4 with dielectric constant ∈=4.4 and with width=21 mm, L=31 mm, and thickness h=0.787 mm.

GND size is 21×20 mm.

The CPW trace width is 0.3 mm and gap 0.15 mm from top GND as indicated in FIG. 15*a*.

At −10 dB the bands are 2.39-2.50

Example 3

890 MHz Small Antenna

Figure 18A:
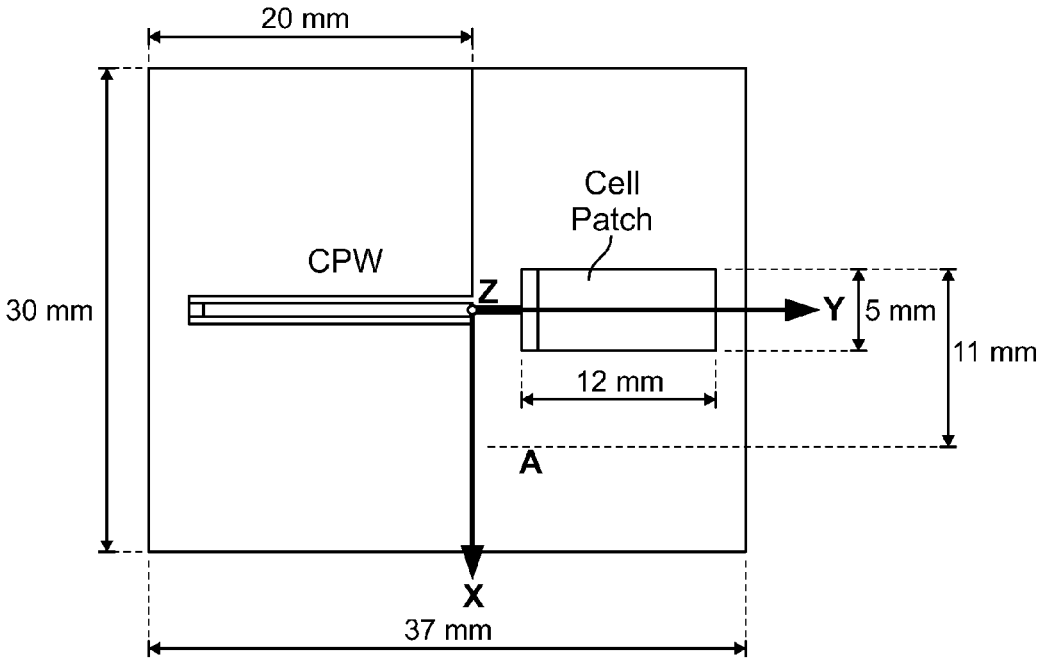
Figure 18B:
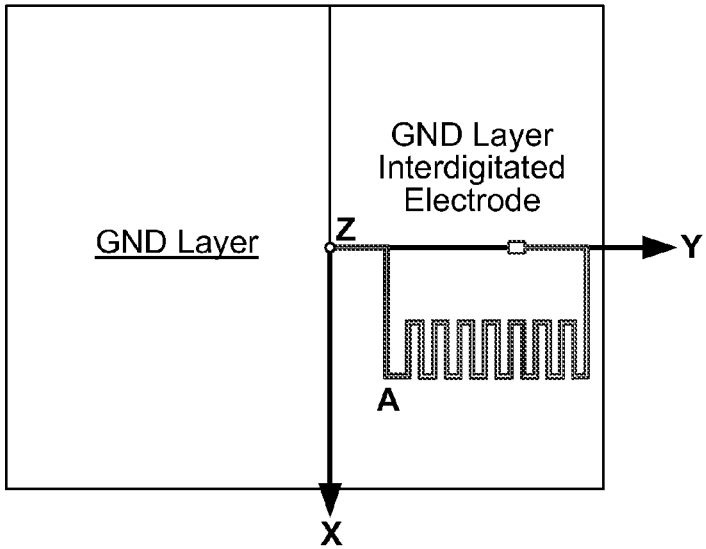
Figure 18C:
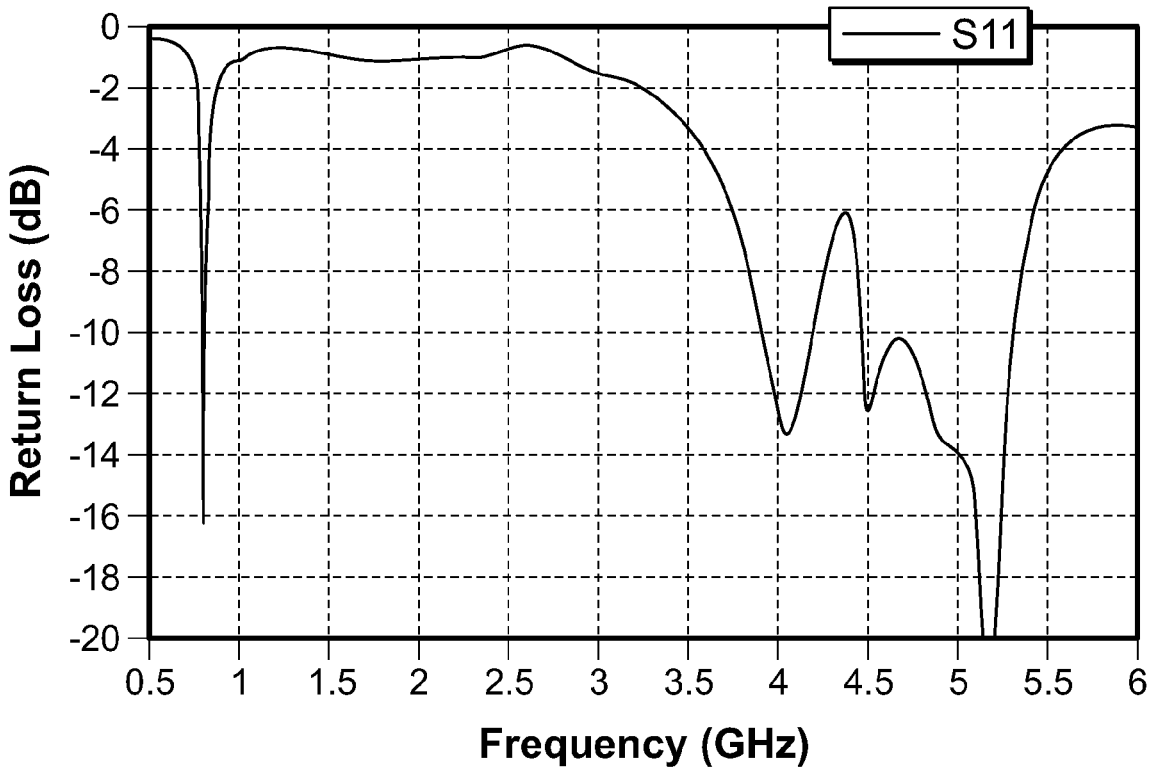
Figure 18D:
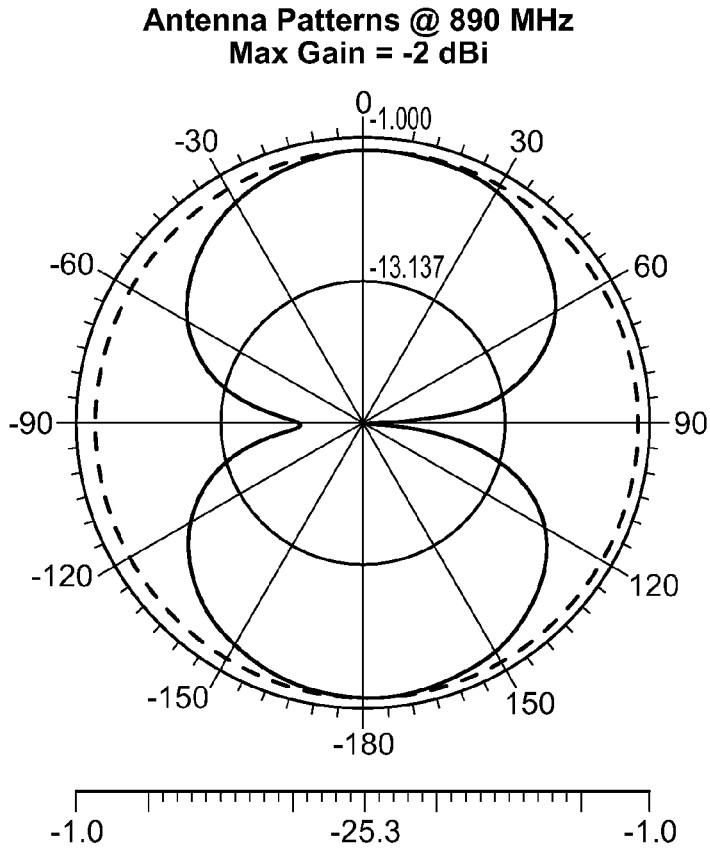
Figure 18D:
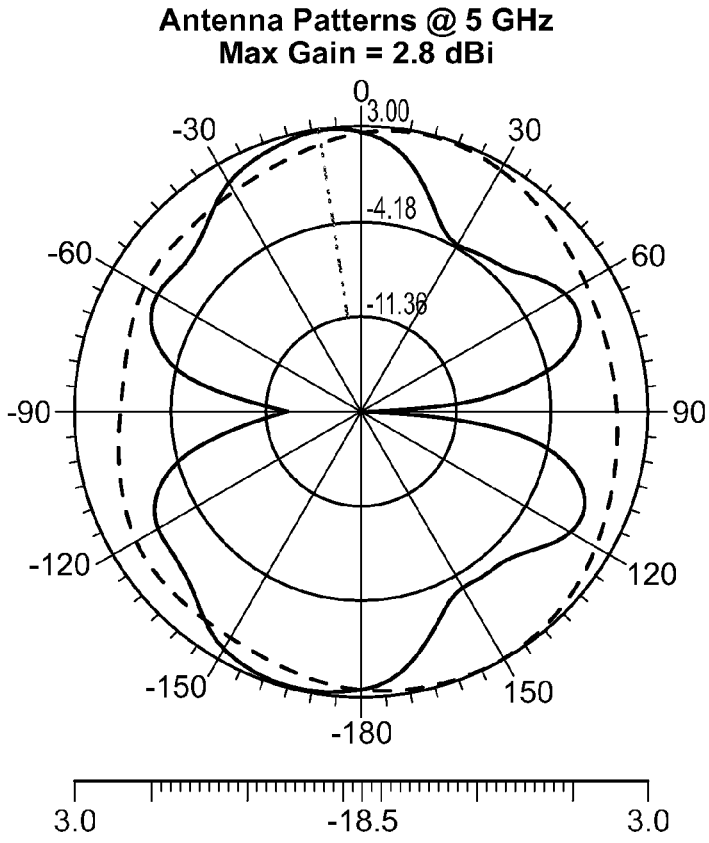

This an example of how frequency can be tuned to lower values when the strip line connecting the via to the bottom GND extends over longer distances as illustrated in FIG. 18A, which corresponds to higher values of induction Lp. The size of the antenna is λ/28×λ/28 at 890 MHz frequency.

The substrate is FR4 with dielectric constant ∈=4.4 and with width=30 mm, L=37 mm, and thickness h=0.787 mm. GND size is 20×30 mm. The cell size is 12×5 mm and is located at 14 mm away for the top GND. The CPW trace width is 1.3 mm and gap 1 mm from top GND as indicated in FIG. 16*a*.

At −6 dB the Bands are 780-830 MHz (Obtained From Measurements)

Additional higher frequency bands at −10 dB are 3.90-4.20 GHz and 4.46-5.31 GHz (obtained from measurements)

The maximum simulated gains are −2 dBi at 890 MHz and 2.8 dBi at 5.0 GHz, which is an indication that the antennas have adequate efficiency given its extremely small size. The efficiency and radiation patterns were verified in a Satimo 64 chamber and found that the efficiency ranges between 55-60% at the 890 MHz and 4.5 GHz bands. The bandwidth is near 3.5% at 890 MHz.

Example 4

UWB Antenna

Figure 19A:
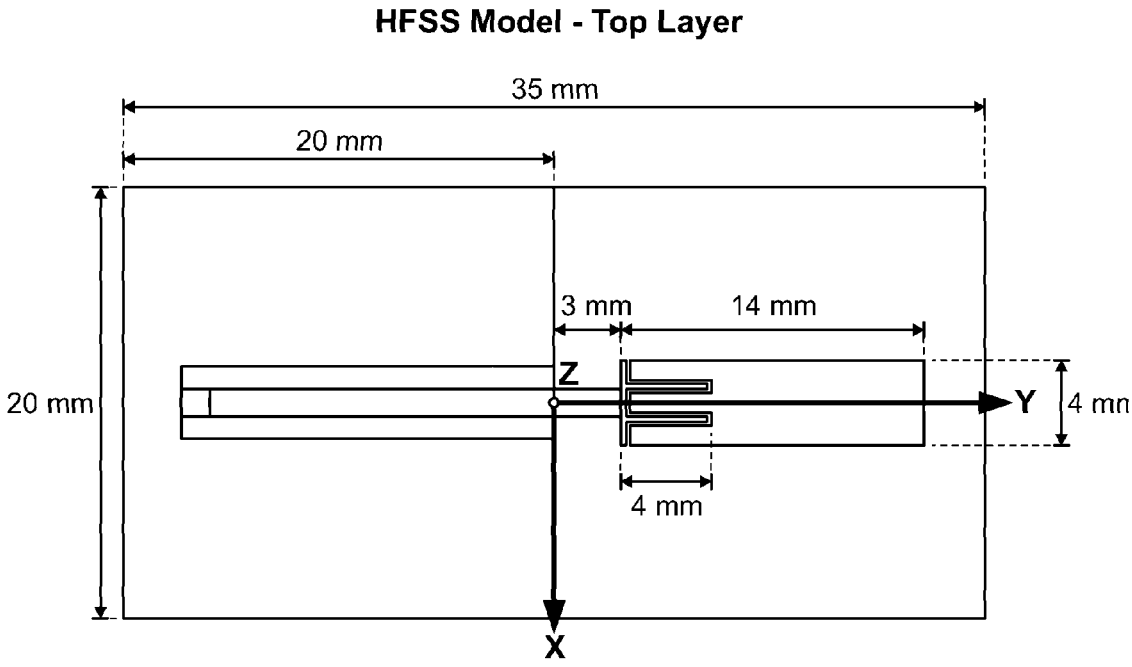
Figure 19B:
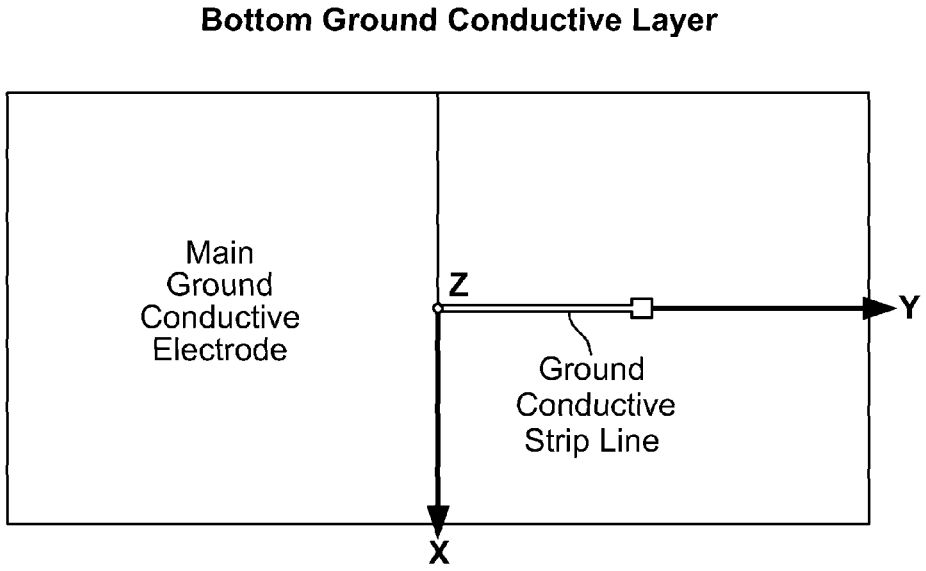
Figure 19C:
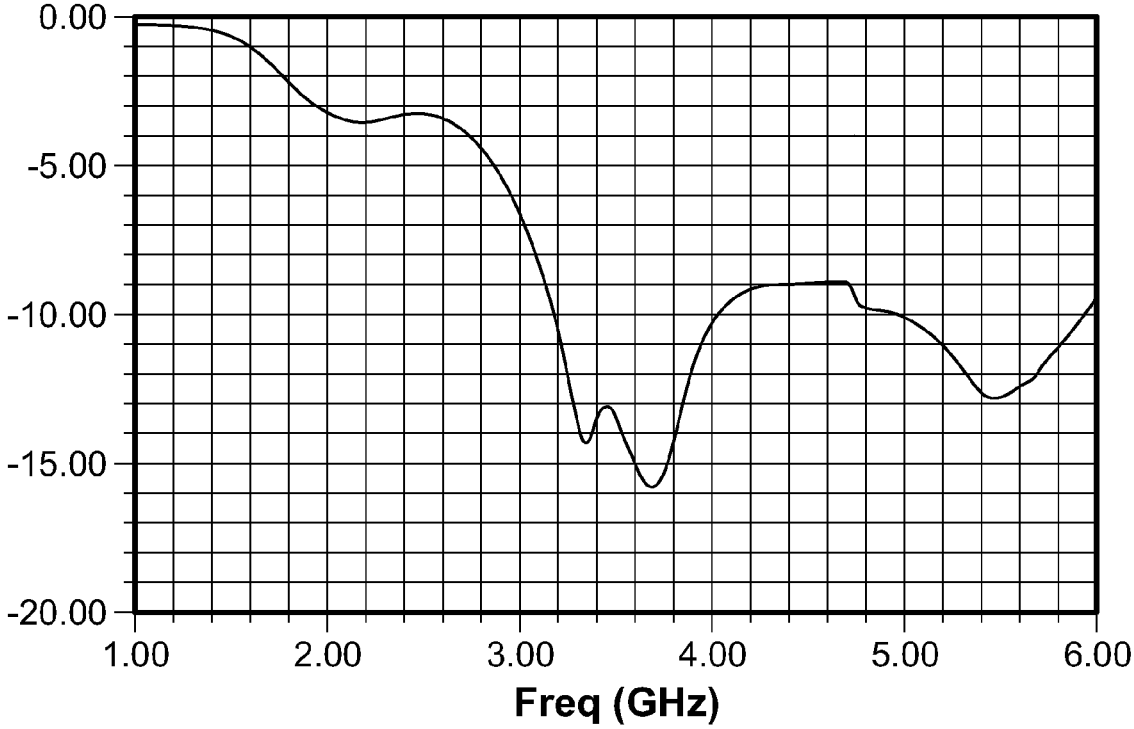
Figure 19D:
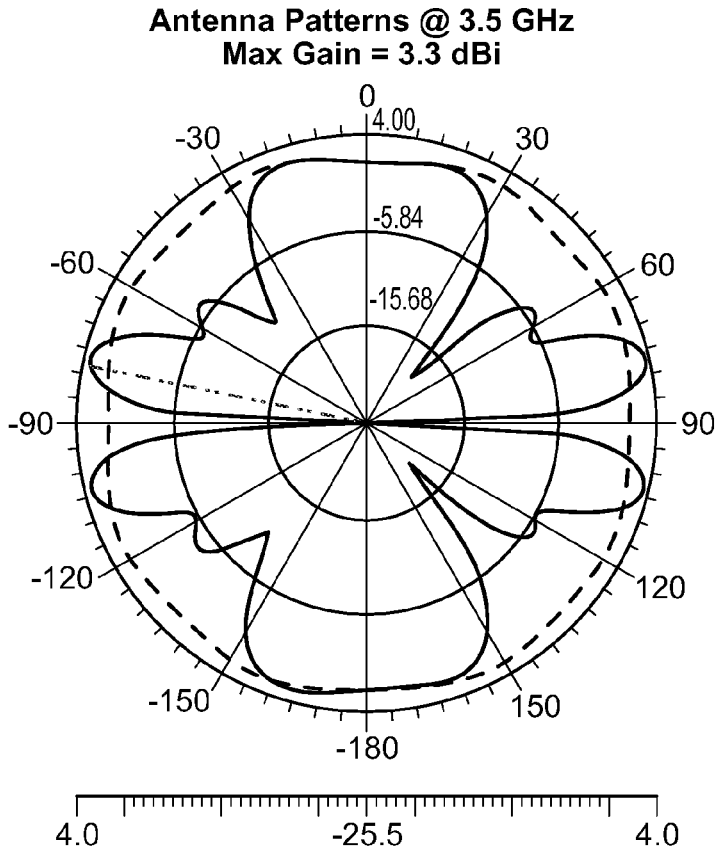

Instead of manipulating Lp, this antenna uses higher coupling capacitance CL between launch pad and the cell to provide better matching conditions. The design and results are illustrated in FIGS. 19A, 19B and 19C respectively. The size of the antenna is λ/56×λ/12 at 1.6 GHz frequency and λ/23×λ/6 at 3.2 GHz frequency.

The substrate is FR4 with dielectric constant ∈=4.4 and with width=20 mm, L=35 mm, and thickness h=0.787 mm.

GND size is 20×20 mm.

The cell size is 14×4 mm and is located at 14 mm away for the top GND.

The CPW trace width is 1.3 mm and gap 1 mm from top GND as indicated in FIG. 16*a*.

The higher coupling capacitance is designed using interdigital capacitor with two fingers of 0.3 mm wide and with 0.1 mm gap. At −6 dB the bands are 1.63-2.34 GHz (obtained from measurements). Additional higher frequency bands at −10 dB are 3.20-4.54 GHz and 5.17-5.56 GHz (obtained from measurements). The maximum simulated gains is 3.5 dBi at 3.3 GHz and the measured efficiency at both 1.6 and 3.2 GHz bands is between 60-70%, which are very high values for antennas of this size and its large bandwidth.

Two-dimensional CRLH metamaterial structures can be used to create spatial isotropic distribution of the structure along two different directions based on either the asymmetric designs of the unit cell arrays or the coupling location of at least one feed line. The following sections describe analysis of 2D structures in order to design MTM membrane where tapping into the different ports along the x and y direction provides information about the distribution of EM fields strength along the Nx×Ny cells which leads to specific radiation patterns.

These 2D structures can also be used enable dual-band antennas because of the different resonance excitations along the x and y directions. These two resonances can be combined to increase bandwidth. These 2D structures also enable diplexing and duplexing functionalities.

2D Anisotropic CRLH TL Structure

The generalization form 1D is straightforward, however the analysis complexity increases because the cells now interconnect through four branches rather than two. The following notation is adopted in our 2D analysis.

There are Nx columns and Ny rows. Each cell is denoted by its position with respect to the array structure: (nx,ny), where nx is its column position and ny is its row position.

As in the 1D case, we use symmetric cells with Zx/2 impedance at each side of the vias along the x axis and Zy/2 impedance at each side of the vias along the y axis. This symmetric notation not only simplifies computation but also give a viable representation of the final implementation.

The edge cells corresponds to nx=1 or Nx and ny=1 or Ny. Input port is located at the (1,nyin) and output port is located at (Nx,nyout). Except for the input and output cells, the rest of edge cells are terminated by "Ztx" for nx=1 or Nx and "Zty" for ny=1 or Ny. Voltages along nx=1 are denoted by $V^x_{(1,ny)}$ and along nx=Nx are denoted by $V^x_{(Nx+1,ny)}$ and their associated currents $I^x_{(1,y)}$ and $I^x_{(Nx+1,ny)}$, where $Vin=V^x_{(1,nyin)}$, $Iin=I^x_{(1,nyin)}$, $Vout=V^x_{(Nx+1,nyout)}$ and $Iout=I^x_{(Nx+1,nyout)}$.

Similar notation used in the 1D case are used in the 2D analysis with $Vout=V^x_{(Nx+1,nyout)}$ and the index of (Nx+1, nyout) is used in the 2D analysis to replace the index of (Nx,nyout) in the 1D analysis.

RF Network matrices are used to solve all boundary and terminations conditions to extract the A, B, C, and D coefficients in Eq. II-1-1 from the equation below:

$$\begin{pmatrix} V^x_{(1)} \\ I^x_{(1)} \end{pmatrix} = \prod_{nx=1}^{nx=Nx} TxThTx = \prod_{nx=1}^{nx=NX} \begin{pmatrix} [1]_{Ny\times Ny} & Zx/2[1] \\ [0]_{Ny\times Ny} & [1] \end{pmatrix} \begin{pmatrix} [1] & [0] \\ [X]_{Ny\times Ny} & [1] \end{pmatrix} \begin{pmatrix} [1] & Zx/2[1] \\ [0] & [1] \end{pmatrix} \begin{pmatrix} V^x_{(Nx)} \\ I^x_{(Nx)} \end{pmatrix} \quad \text{(II-2-1)}$$

where, $$Zx = j\omega LxR + \frac{1}{j\omega CxL},$$

$$Zy = j\omega LyR + \frac{1}{j\omega CyL},$$

$$Yg = j\omega CgR + \frac{1}{j\omega LgL}$$

where, V and I are columns with Ny entries such that $Vin=V^x_{(1,nyin)}$, $Iin=I^x_{(1,nyin)}$, $Vout=V^x_{(Nx+1,nyout)}$, $Iout=I^x_{(Nx+1,nyout)}$, and termination edge cells are $V^x_{(1,ny)}=Ztx\ I^x_{(1,ny)}$ and $V^x_{(Nx+1,ny)}=Ztx\ I^x_{(Nx+1,ny)}$.

All brackets [ . . . ] correspond to an Ny by Ny matrix with the [1] being the identity matrix and [0] representing all zeros matrix. The matrix [X] is derived in Caloz and Itoh, "Electromagnetic Metamaterials: Transmission Line Theory and Microwave Applications," John Wiley & Sons (2006).

The 2Ny by 2Ny matrices in Eq. II-2-1, with its interconnection and termination constraints, can be reduced to the 1D structure denoted in Eq. II-1-1. This process is illustrated below in a specific example for a configuration with Nx=1 and Ny=2.

We derive the characteristic impedance Zc(ω)=Vin/Iin, which is also equal to Zc(ω)=Vout/Iout in our symmetric cell structure provided that nyin=nyout. Dispersion relation for a 1 cell with four ports (building block of a 2D structure) is given by:

$$\chi_y\cos(\beta xPx)+\chi_x\cos(\beta yPy)=\chi_y+\chi_x-\frac{\chi_y\chi_x}{2};\quad \text{(II-2-2)}$$
$$\chi_y=-ZyYg\ \&\ \chi_x=-ZxYg$$

Eq. (II-2-1) is reduced to the 1D case given by Eq. (II-1-5) in the following cases:

Py or βy→0

Zy→∞

Similar to the 1D case, the possible values for $\chi_x$ and $\chi_y$ are as follows:

$$a)\ \text{for } 0\le\beta xPx\le\pi\ \&\ \beta y=0;\quad \text{(II-2-3)}$$
$$\beta xPx=\cos^{-1}\left(1-\frac{\chi_x}{2}\right)\Rightarrow 0\le\chi_x\le 4(1D\ \text{case})$$
$$b)\ \text{for } \beta xPx=\pi\ \&\ 0\le\beta yPy\le\pi;$$
$$\beta yPy=\cos^{-1}\left(1+\frac{2Zy}{Zx}-\frac{\chi_y}{2}\right)\Rightarrow 0\le\chi_x\ \&\ 4\le\chi_y\le 8$$
$$c)\ \text{for independent } \beta x \text{ and } \beta y \text{ propagation } \beta uPu=\cos^{-1}\left(1-\frac{\chi_u}{4}\right)\Rightarrow 0\le\chi_x\le 8$$
$$\text{where } u=x,\ y\ \text{(II-2-3)}$$
$$d)\ \text{General case: Eq II-1-5}\Rightarrow$$
$$1)\ 0\le\chi_x,\ 0\le\chi_y \text{ and } \chi_x+\chi_y\ge\frac{\chi_x\chi_y}{4};$$
$$2)\ 0\ge\chi_{u'},\ \text{and } 0\ge\chi_u\le 4 \text{ for } u\ne u'\in\{x,\ y\}$$

Unlike the 1D case, where χ values are limited between 0 and 4 and tend to reach the value 4 for lower frequencies, the 2D structure is much richer in terms of providing not only a similar 1D structure (Eq II-2-3 case a) and independent propagations along the x and y directions (Eq II-2-3 case c), but also coupled propagations as in cases b and c.

For coupled propagations with near resonances nx and ny, multiple resonances can be combined to increase the bandwidth. Another way is as depicted in case b where Zx provide an additional term to fine tune the dispersion relation along y direction ($\beta_y$) to have steeper slopes, and hence lager BW.

Example of Nx=1 and Ny=2

In this example we consider a special case when Ztx→∞ and Zty→∞ and nyin=nyout=1. In this case, the current components $I^x_{(1,2)}=I^x_{(2,2)}=0$. Substituting these values in Eq. II-1-2 leads to a set of four equations with four unknowns $Vin=V^x_{(1,1)}$, $Iin=I^x_{(1,1)}$, $V^x_{(1,2)}$, and $V^x_{(2,2)}$ to be computed in terms of $Vout=V^x_{(2,1)}$ and $Iout=I^x_{(2,1)}$. After straightforward computations using Eq. II-2-1 and using [X] matrix derived in Ref [1], we find the following for the [A B C D] matrix:

$$\left(\frac{Vin}{Iin}\right)=\begin{pmatrix}1+\frac{Zx}{2Ya}(Ya^2-Yb^2) & Zx\left(1+\frac{Zx}{4Ya}(Ya^2-Yb^2)\right)\\ \frac{(Ya^2-Yb^2)}{Yb} & 1+\frac{Zx}{2Ya}(Ya^2-Yb^2)\end{pmatrix}\left(\frac{Vout}{Iout}\right)\quad \text{(II-2-4)}$$

where,

-continued $$Ya=Yg+\frac{1}{Zy}+\frac{1}{Zy/2+Zty},$$
$$Yb=-\frac{1}{Zy},\ Yc=Yg+\frac{2}{Zy}$$

In the above equation, a condition of Zty→∞ is applied to reflect open circuits at the edges along the y-axes. Based on these A B C D values, the corresponding dispersion curves for this 1×2 2D example and matching conditions can be obtained. As indicated in Eq II-1-8, the value of A sets the resonances and BW. Unlike the 1D case, the 2D structure has two additional design parameters in Zy and a third one if we choose CR in Yg to have different values in x and y directions.

Since Nx=1, then resonances with nx=0 can occur, however and because there are two cells along the y direction, then A=1 is also satisfied when $\chi_y=2$, which corresponds to |ny|=1 resonances as indicated in Table 1. It is the combination of these two possibilities that provide ways to combine resonances.

Matching impedance Zc can be set to match the Input/Output impedance over resonance frequencies. Zin=Zout is due to the fact the network is completely symmetric when viewed by either sides. Next, Zc is computed to determine a structure that works with a constant value of Zc over desired frequency bands:

$$Zc=\frac{Vin}{Iin}=\frac{Vout}{Iout}=\frac{\left(1+\frac{Zx}{2Ya}(Ya^2-Yb^2)\right)Zc+Zx\left(1+\frac{Zx}{4Ya}(Ya^2-Yb^2)\right)}{\left(\frac{(Ya^2-Yb^2)}{Yb}\right)Zc+1+\frac{Zx}{2Ya}(Ya^2-Yb^2)}\quad \text{(II-2-5)}$$

The following sections describe, in part based on the analysis on 1D arrays of unit cells, CRLH MTM structures with unit cells arranged in 2-D arrays. Such 2-D arrays of unit cells can be used to construct various MTM membranes having one or more ports for various applications. For example, MTM membranes with different ports along two orthogonal directions x and y can be used to achieve a desired distribution of EM fields along the Nx×Ny cells and to provide radiation patterns tailored for specific applications.

Offset Feed Designs

Examples described above show the signal propagation along one direction or decoupled propagation along the x and y directions. Another device parameter that can be used to increase bandwidth and optimize matching conditions is the offset feed. That means placing the feed along the x direction off center in such a way that the x-y plane underneath and above it are asymmetric. This triggers an EM wave to propagate in the y direction as well without having a separate feed that excites the ny mode along the y direction.

For example, in a 3 by 3 structure if the feed is placed at the center y-edge of the cell (nx=1,ny=2), it is considered as centered feed. If instead the feed is placed at the center y-edge of the cell (nx=1,ny=1), or (nx=1, ny=3) because of symmetry, then the feed is considered off center. The same reasoning can be done if the feed is still at the (nx=1,ny=2) cell but and a spatial offset δ from the center along the y-edge.

Under such offset feeding, the dispersion curves βx and βy can be crafted to be almost on top of each other so that nx and ny resonance have close values and similar bandwidth (BW) (slopes).

FIG. 20A-20E show an example of such a Metamaterial antenna and the x- and y-modes of excitations. FIG. 3 shows a specific example of such a CRLH metamaterial antenna with two I/O ports along x and y directions. The multi-cell CRLH MTM structure can be designed to have a 2-D anisotropic metamaterial structure as a single antenna in which (LH-) resonant modes are excited at two different (desired) frequencies, due to the different physical dimensions (and thus different equivalent-circuit parameters) of the unite cell in x- and y-directions. These resonant x and y modes can be of the same or of different order, i.e. both corresponding to n=−1 or one corresponding to n=0 and the other corresponding to n=−1. Both feeds centered in the middle cell along x and y directions.

Since each of these two modes can be excited only via the corresponding port of the antenna, signals at the desired band can be used only by the Tx- or Rx-port of the device, thus eliminating the need of a Duplexer. Furthermore, by appropriately designing the transmission lines at the antenna, so that they match the impedance of the corresponding RF chains, selective filtering of the signal can be provided by these lines. In this case, the need of the corresponding BP filters can be eliminated too, which reduces device size and complexity even further.

As a specific example, the unit cell in FIGS. 20A-E can include two substrates and three metal layers. A thicker substrate RO 4350 with a low dielectric constant (∈r1=3.5, h1=3.048 mm) and a thinner substrate RO 3010 with high dielectric constant (∈r2=10.2, h2=0.25 mm) are stacked together. Each unit cell includes a 4.8 by 4.8 mm2 square patch with 0.2 mm gap between the adjacent patches on top, a metallic via connected to the ground. The four MIM capacitors linked to the adjacent cell in both x and y direction and are 4.5 mm2 and 3.8 mm2 respectively. However, the designs are not limited to this material only and any dielectric material suitable for RF and microwave applications can be used instead. The overall size of the advanced MTM antenna subsystem is 13.2 mm (width), 13.2 mm (length) and 3.278 mm (height). The feeds are 14×2 microstrip lines on the top metallization layer.

The model of the advanced MTM antenna is built in the full-wave high-frequency simulation tool Ansoft HFSS. FIG. 20F shows results from HFSS simulations of the 2-D MTM antenna with 2-ports in FIGS. 20A-20E. The anisotropy in this case is adjusted such that the antenna can operate as an advanced duplexer for the WCDMA frequencies. The transmit band center frequency is 1.95 GHz and the receive band center frequency is 2.14 GHz. The port 1 return loss shows the resonance of port 1 in the transmit band. The port 2 return loss shows the resonance of port 2 in the receive band. It is evident from the S12 plot that more than 25 dB isolation is achieved from Tx path to Rx path. The EM field distribution along the 2D structure when the port along the x-axis is excited and the most filed is concentrated along the gaps that follow excitation direction.

Figure 20A:
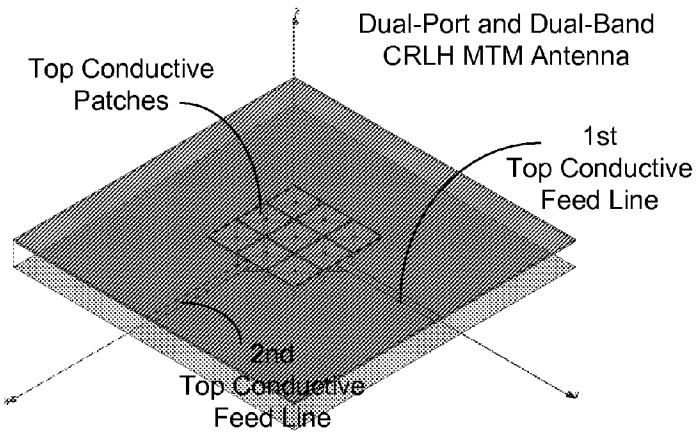
FIGS. 20A-20E show an example of a dual-port, dual-band CRLH MTM antenna system based on spatial anisotropic design of 2-D unit cells.
Figure 20E:
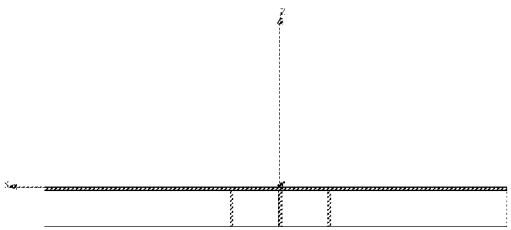
Figure 20B:
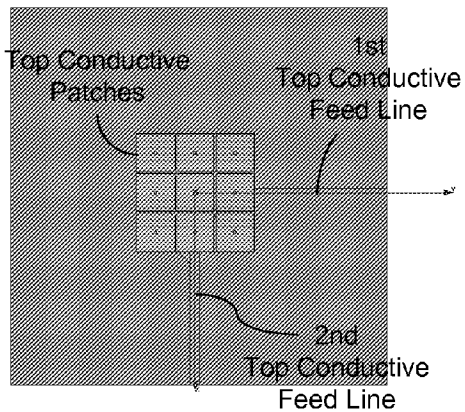
Figure 20C:
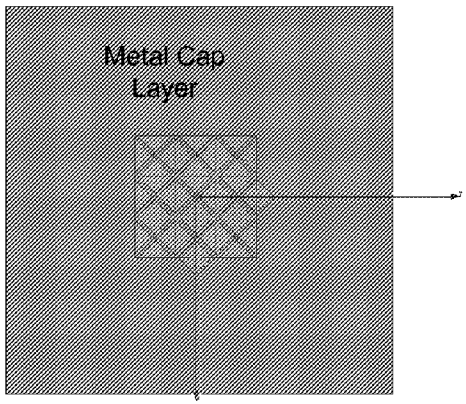
Figure 20D:
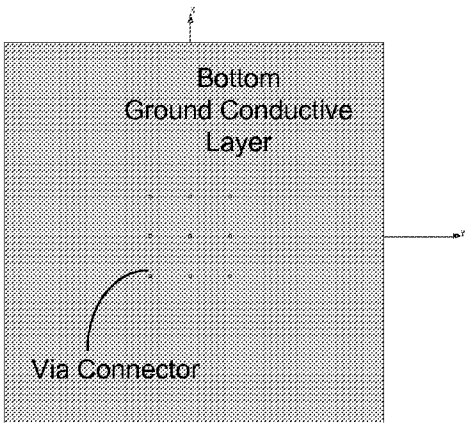
Figure 20F:
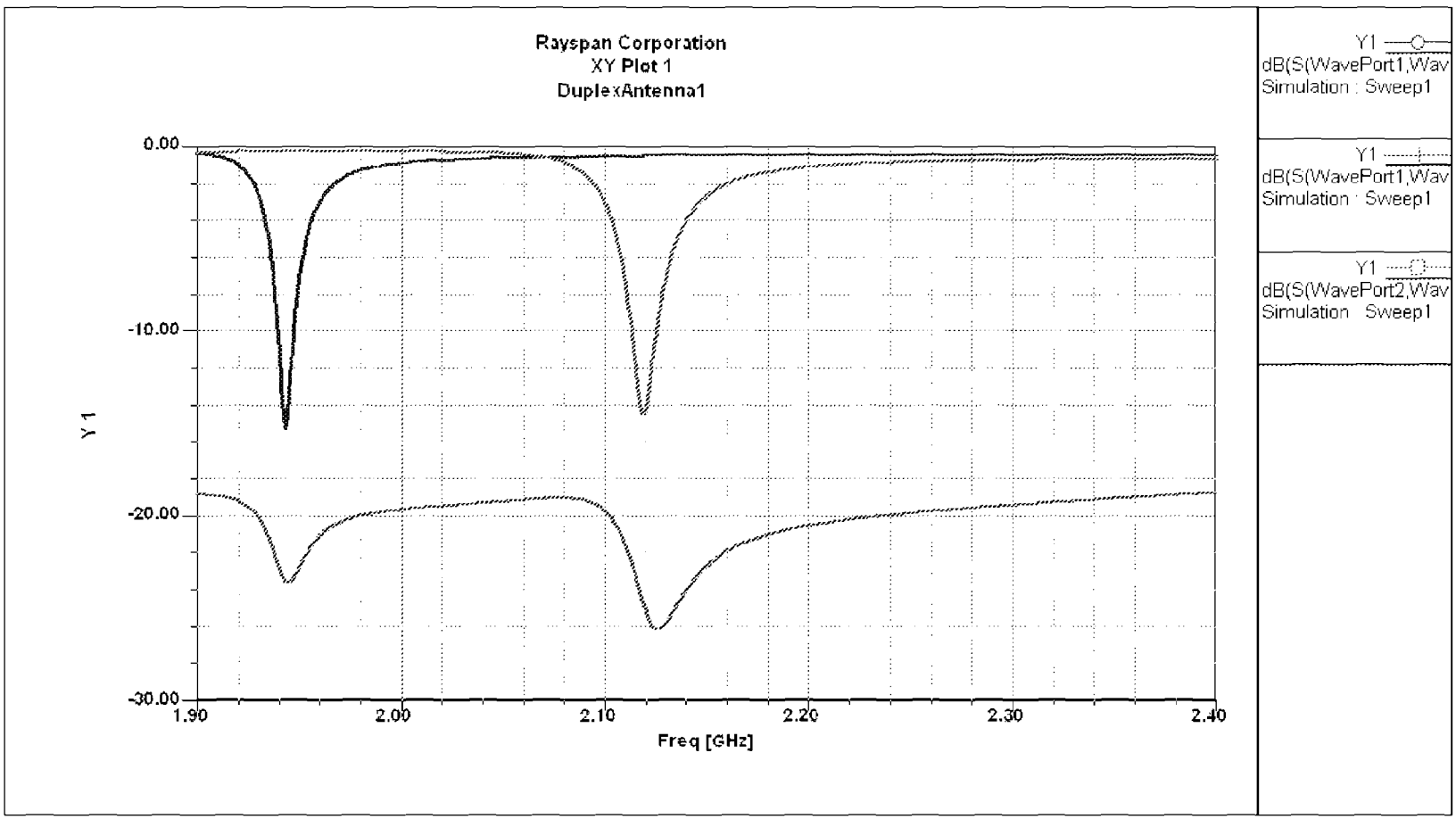
FIG. 20F shows performance of the antenna in FIG. 20A.
Figure 20G:
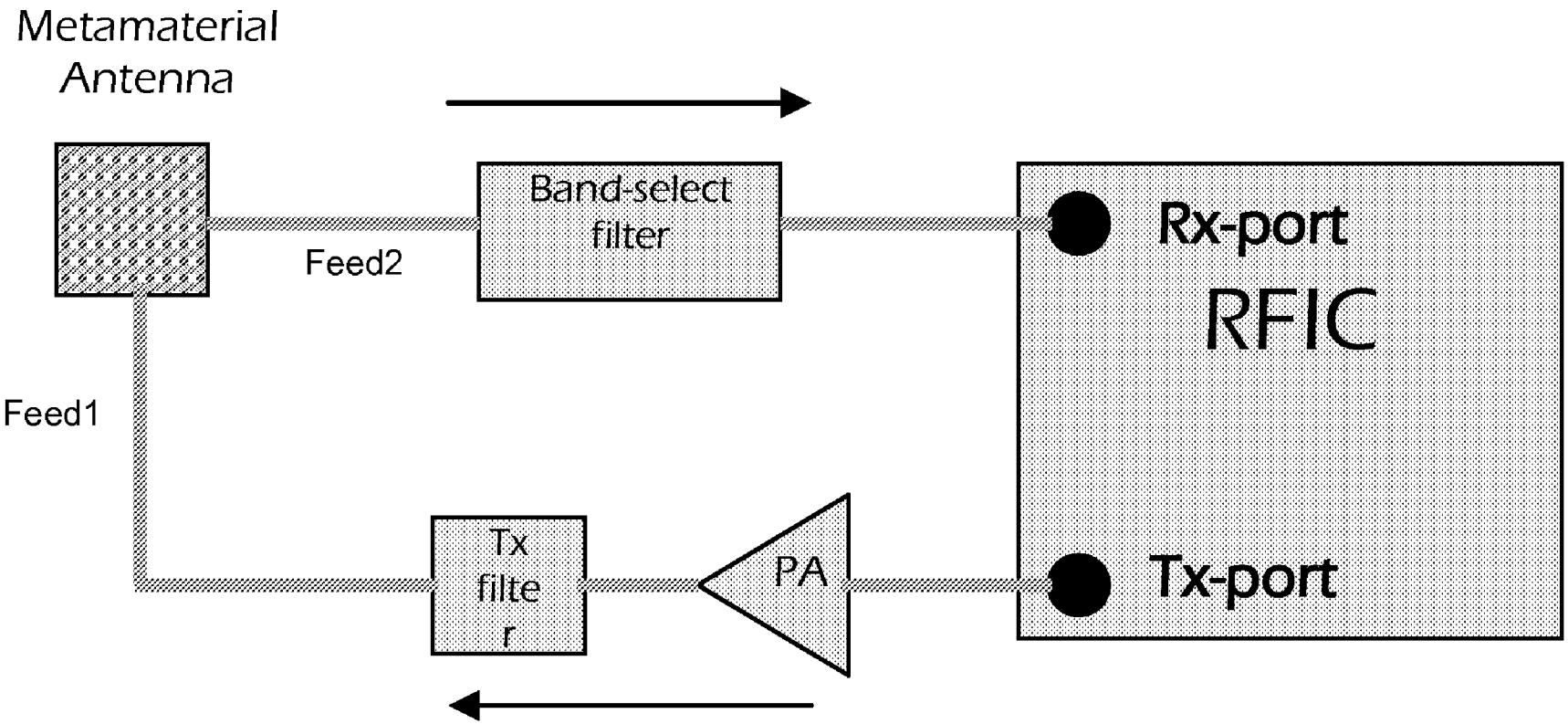
FIG. 20G shows an FDD device based on the antenna in FIG. 20A.
Figures 21A, 21B, 21C, 21D, 21E:
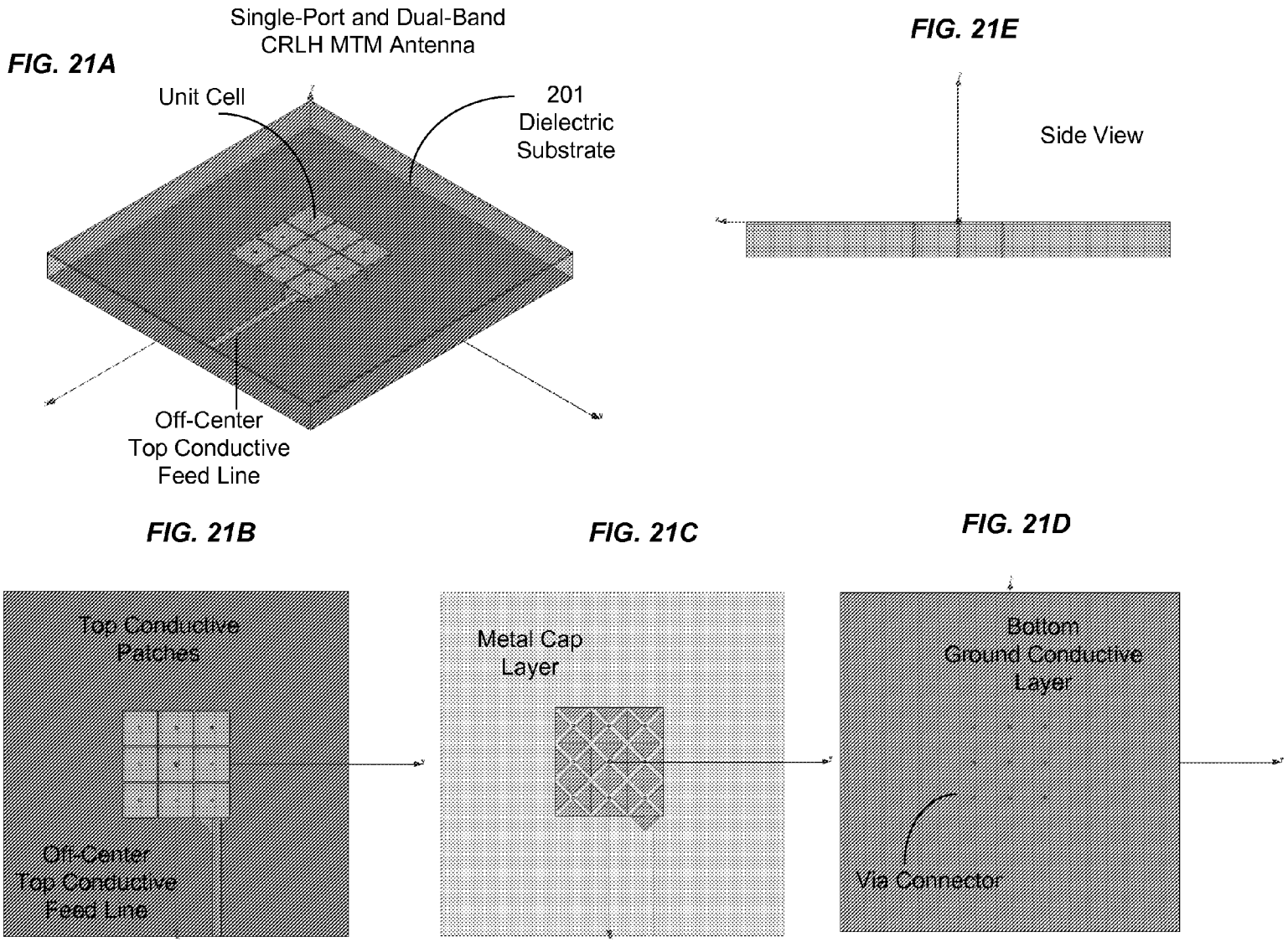
FIGS. 21A-21E show an example of a single-port, dual-band CRLH MTM antenna.

FIG. 20G shows an exemplary MTM FDD device based on the dual-port dual-band MTM antenna in FIG. 20A. In this example, the MTM FDD device includes two-port metamaterial antenna, RFIC with Transmit- (Tx) and Receive- (Rx) ports for independent transmission and reception of the signal, two feed lines, Feed1 and Feed2, which connect the corresponding antenna ports to either the Tx-port or the Rx-port of the RFIC, and band-pass filters respectively connected in the Tx- and Rx-chains of the device for selecting signals in the appropriate operating band.

Hence, a metamaterial antenna sub-system for FDD includes two-port metamaterial antenna having two antenna ports; and two feed lines, which connect the corresponding antenna ports to carry, respectively, a transmission channel signal Tx at a transmission frequency produced by an RFIC circuit and a reception channel signal Rx at a different reception frequency received from the antenna and to be directed to the RFIC circuit. The metamaterial antenna is a 2-D anisotropic antenna providing two different resonant modes, each one of which is excited via one of the corresponding antenna port.

In addition, a two-port metamaterial antenna can include two antenna ports and two feed lines, which connect the corresponding antenna ports to carry, respectively, a transmission channel signal Tx at a transmission frequency produced by an RFIC circuit and a reception channel signal Rx at a different, reception frequency received from the antenna and to be directed to the RFIC circuit. The two feed lines are designed to respectively match impedances of the corresponding RFIC chains at a reference plane without bandpass filters for filtering signals at the transmission frequency and the reception frequency in the pats of the transmission channel signal and the reception channel signal, respectively. The Metamaterial antenna is a 2-D anisotropic antenna providing two different resonant modes, each one of which is excited via one of the corresponding antenna port. The device can further include a transmission band-pass filter and a reception band filter, respectively coupled in the Tx- and Rx-chains of the device.

A wireless FDD device based on the above MTM designs can include a two-port metamaterial antenna having a transmission port in resonance at a transmission frequency and a reception port in resonance at a different, reception frequency; an RFIC circuit having a Transmit- (Tx) port and a Receive- (Rx) port for independent transmission of a signal at the transmission frequency and independent reception of a signal at the reception frequency; and two feed lines, which respectively connect the corresponding antenna ports to the Tx-port and the Rx port of the RFIC circuit, respectively. The antenna feed lines can be designed to match the impedances of the corresponding RFIC chains at a reference plane without a band pass filter in each signal path.

In another implementation, the metamaterial antenna is a 2-D anisotropic antenna providing two different resonant modes, each one of which is excited via one corresponding antenna port only.

FIGS. 21A-21E show another example of a two-mode CRLH MTM antenna. The 2-D antenna can have different parameters along the x- and y-directions, i.e. an anisotropic MTM structure. Because of its anisotropicity, LH resonances of the same order can be excited at different frequencies. By designing antenna with appropriate CLRH parameters the x- and y-modes can appear very close to each other and, thus, can be used to create an antenna with combined BW, which equals the sum of the BW of the individual resonances. One feature of the implementations is that an offset feed can be applied to the MTM structure at a point, which allows for exciting both the x- and the y-mode. The bottom layer has full metallic GND plane and a feed line with an offset from the central axis of the structure.

Figure 22:
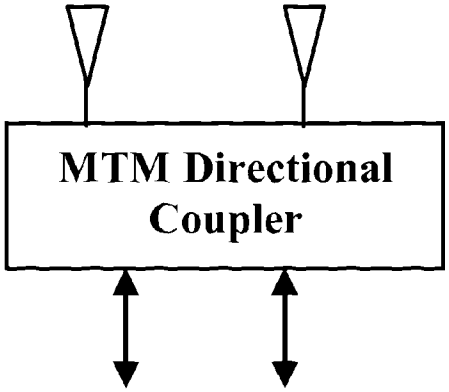

The CRLH MTM structures may also be used to construct direction RF couplers which use a directional coupler with MIMO antennas to reduce coupling between adjacent antennas. As shown in FIG. 22, directional couplers are four ports devices that improve isolation between closely spaces antennas, such as λ/10 spacing, to restore orthogonality between signals in the analogue domain and in a passive fashion. The signals received from the antennas are decoupled by using either a 90° or a 180° directional coupler. Reducing the coupling between antennas can be a key component in successful MIMO antenna array design because it generates uncorrelated paths.

Conventional directional couplers require TL with several sections of λ/4 lengths which make their implementation impractical because of their large sizes. CRLH MTM structures can be used to reduce the size of 90° or a 180° directional couplers. This can be accomplished by designing the four port directional coupler with two ports connected to the antennas and the other two to the radio transceiver. Two different excitations can be applied to the antenna ports to reduce isolation, such (0°, 90°) and (90°, 0°). This was the radiation patterns of the antennas a close to become orthogonal. With the 180° coupler the different excitations are (0°, 0°) and (0°, 180°) excitations which corresponds to the sum and differences between inputs signals.

Figure 23:
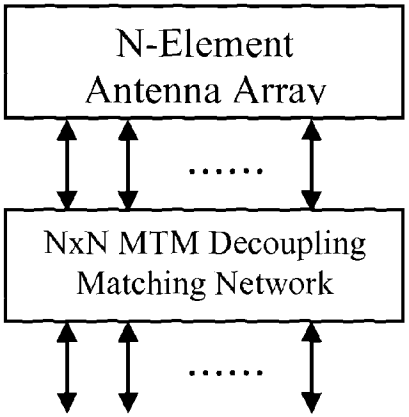

FIG. 23 shows an example of a MTM decoupling matching network. Because directional couplers reduce the coupling between adjacent antennas, similarly it is desirable to find means to design optimal matching networks that not only decouples antennas closely spaced but also allows arbitrary beam patterns assigned to each antenna port. A practical iterative approach was defined to build such passive and lossless Decoupling and Pattern Shaping Matching Networks (DPSN). Unlike directional couplers where only two antennas can be decoupled at a time, DPSN connects to N antenna ports and N transceiver ports. The entries of this matching network include specific values of phase offsets between the N antenna ports and N transceivers ports. So, directional couplers is considered a special case of DPSN where N=2 and the phase offsets are either 90° or 1800. Balanced CRLH TL is used here too to design and reduce the size of DPSN.

Antenna arrays combine multiple MTM antennas such that their layout is defined by different geometries to optimize radiation patterns and polarization based on final application. For example, in a WiFi access point (AP), the antennas can be printed along the perimeter of the board with CPW line connecting them to power combiners/splitters and switches. The same can be implemented along laptop display or in other communication devices.

Figure 24:
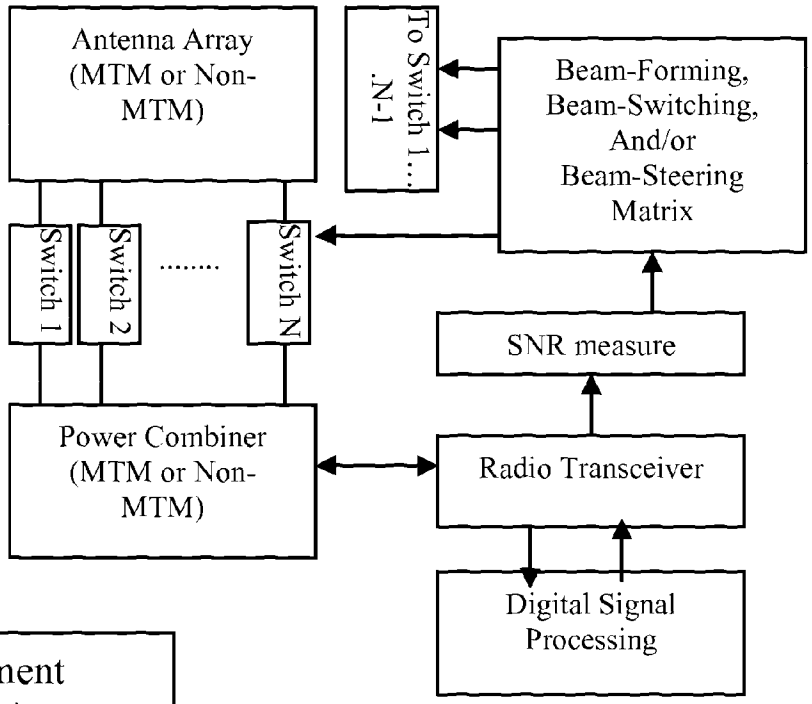
FIGS. 22, 23, 24, 25, 26 and 27 shows examples of apparatus and subsystems based on CRLH MTM antennas or RF circuit elements.
Figure 25:
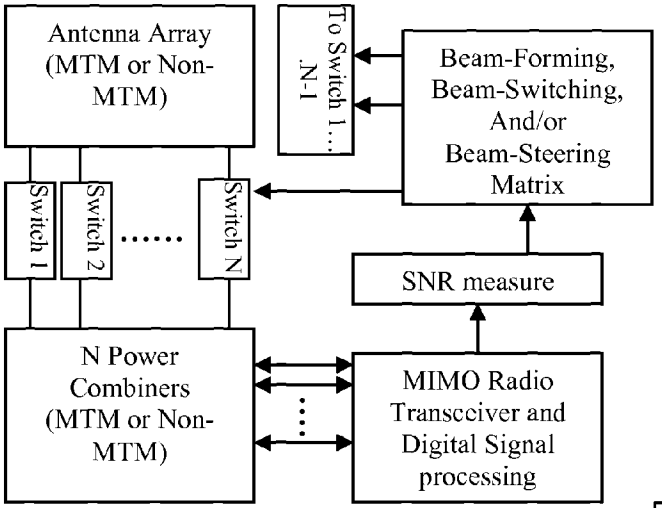

FIGS. 24 and 25 show two examples. Switching elements, such as diodes, are used along the traces connecting antenna elements to the power combining/splitting module. These diodes are controlled by the Beam Switching Controller (BSC) to activate only a subset of the antenna array. The switching elements may be placed at λ/2, where λ is the wavelength of the propagating wave, from the power combiner/splitter to improve matching conditions. Phase shifter and/or delay lines can be used to further enhance beam patterns of the selected antennas. The Power Combiner/Divider (PCD) can be an off-the-shelf component or a printed directly on the board.

Printed PCS can be based on conventional designs such as the Wilkinson PCD or MTM designs such as Zeroth Order Power combiner and splitter (UCLA 2005 disclosure). In the example below we illustrate a printed Wilkinson PCD.

The Input/Output signal from the PCD is fed to the radio transceiver to be processed. The digital signal processor is equipped with means to evaluate link performance. This can be based on packet error rate and RSSI (received signal strength intensity). The digital processor provides feedback to the BSC based on the level of signal performance.

The operation of the BSC can be described by the following stages when converging toward the optimal beam pattern suitable for communication environment at a specific location and time:

Scanning mode: this is the initialization process where wider beams are used first to narrow down the directions of the strong paths before transitioning to narrower beams. Multiple directions may exhibit the same signal strength. These patterns are stamped with client information and time before being logged in memory.

Locked mode: Lock the link to one of the single pattern that exhibited highest signal strength.

Rescanning mode: If the link starts showing lower performance, then trigger the Re-scanning mode that will consider beam patterns logged in memory first and change beam orientations from these directions first.

MIMO mode: In MIMO systems, it is desired to find the directions of strong multipath links first before locking the MIMO multiple antenna patterns to these directions. Hence, multiple subsets of the antennas are operating simultaneously and each connected to the MIMO transceiver.

ZOR Power Combiner Divider

The power combiner can include a zero degree composite right/left hand (CRLH) transmission line (TL) with an output port and N branch of input ports. Each input port configured to receive output signals from antennas. The input ports are combined in-phase by the ZOR TL to generate the output signal. The ZOR mode corresponds to an infinite wavelength stationary wave resonator where branch ports are loosely coupled to combine their signals and the other end of the TL is open ended. The power combiner can be built using lumped inductors and capacitors. The feed-line can be either printed micro-strip or CPW feed-line. The output port is configured to match the impedance of the connected device. The N branch input lines have an integrated switch to activate or disable the port. The switch can be a diode or MEMS device. Examples of zero-order CRLH MTM transmission lines are descried in U.S. Patent Publication No. 20060066422 entitled "zeroth-order resonator" by Itoh et al. and published on May 30, 2006, which is incorporated by reference as part of the specification of this application.

The power divider can include a zero degree CRLH transmission line (TL) with an input port and N branch of output ports. Each output port configured to transmit the signals to antennas. The input single is equally divided in-phase to generate the N output port. The ZOR mode corresponds to an infinite wavelength stationary wave resonator where branch ports are loosely coupled to equally divide the signal from the main input port and the other end of the TL is open ended. The power combiner can be built using lumped inductors and capacitors. The feed-line can be either printed micro-strip or CPW feed-line. The input port is configured to match the impedance of the connected device. The N branch output lines have an integrated switch to activate or disable the port. The switch can be a diode or MEMS device.

Figure 26:
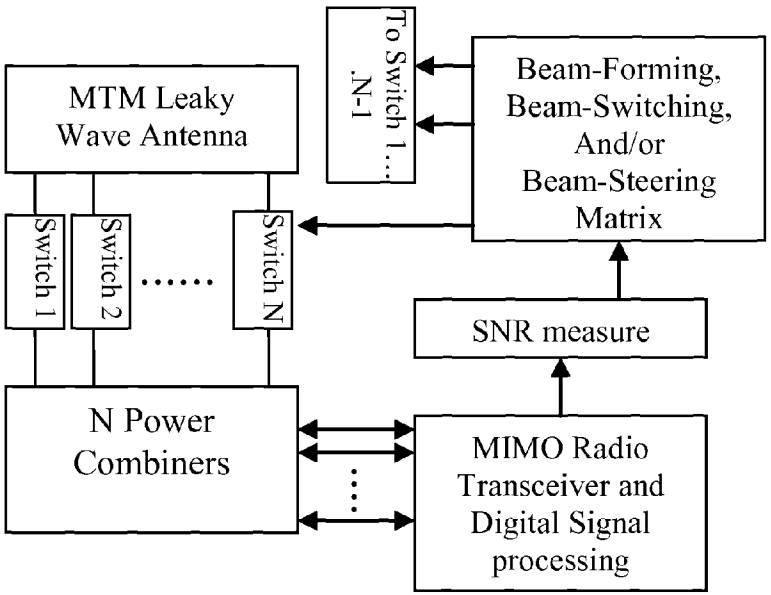

Instead of a collection of MTM antennas and a power combiner/divider, an MTM Leaky wave antenna can be used to shape, steer, or switch between beam patterns. FIG. 26 shows an example. Leaky wave antennas can be built using ZOR TL with one end connected to radio transceiver while the other end is terminated with the same impedance as the input/output port.

The beam width of the radiation pattern depends on the number of cells of the TL. The higher is the number of cells the narrower is the beam width. The direction orthogonal to the TL corresponds to the ZOR frequency, while the forward and backward direction beams correspond to RH and LH regions respectively. Since the antenna needs to operate at the same frequency while generating these different beam directions, then the values of the capacitance and inductors vary to make the structure resonate at the same frequency in the LH, RH, and ZOR regions.

The collection of antennas and power combiner/divider can be used in conjunction with Leaky Wave antenna. This is accomplished by using the power combiner/divider structure as a leaky wave antenna as well since its design is similar to the power combiner/divider with the only exception of terminating the other TL port with same impedance as the main port.

Figure 27:
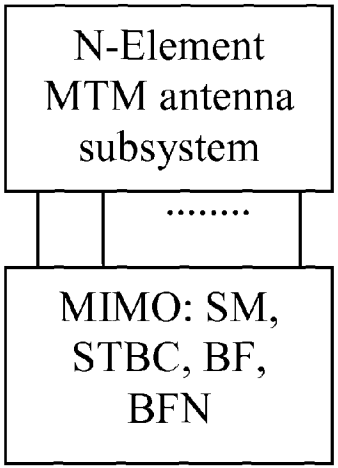

FIG. 27 further illustrates an antenna system using N MTM antenna elements that are coupled to an analog circuit that provides signals in connection with one or more of MIMO, SM, STBC, BF and BFN functions. In the examples in FIGS. 24-27, at least one element is made from CRLH MTM structures to address technical or engineering issues that may be difficult to solve with non-MTM structures. When the antenna or the antenna array is made of CRLH MTM structures and an RF circuit element coupled to the antenna or antenna array is also an CRLH MTM structure, the two MTM structures can be different. MTM structures can provide additional design flexibility and operations in designing various RF components, devices and systems.

Using the MTM concept in 1D and 2D, single and multiple layers can be designed to comply with RF chip packaging techniques. The first approach is leveraging the System-on-Package (SOP) concept by using Low-Temperature Co-fired Ceramic (LTCC) design and fabrication techniques. The multilayer MTM structure is designer for LTCC fabrication by using the high dielectric constant $\in$, for example DuPont 951 with $\in$=7.8 and loss tangent 0.0004. The higher $\in$ value leads to further size miniaturization. Therefore, all the designs and examples presented in previous section using FR4 substrates with $\in$=4.4, can be ported to LTCC with tuning the series and shunt capacitors and inductors to comply with LTCC higher dialectic constant substrate.

In contrast with high dielectric constant of LTCC substrate, another technique that can be used to reduce the printed MTM design to RF chips is Monolithic Microwave IC (MMIC) using GaAs substrates and thin polyamide layers. In both cases the original MTM design on FR4 or Roger substrates is tuned to comply with the LTCC and MMIC substrates/layers dielectric constants and thicknesses.

| Acronyms | |
|---|---|
| AA | Active Antenna |
| AP | Access Point |
| BS | Base Station |
| BER | Bit Error Rate |
| BF | Beamforming |
| BFN | Beamforming and Nulling |
| ChDiv | Channel Diversity |
| $C_L$ | $C_{series}$: series capacitor in the equivalent Metamaterial circuit |
| $C_R$ | $C_{shunt}$: shunt capacitor in the equivalent Metamaterial circuit |
| $L_R$ | $L_{series}$: series inductance in the equivalent Metamaterial circuit |
| $L_L$ | $L_{shunt}$: shunt inductance in the equivalent Metamaterial circuit |
| CRLH | Composite Right/Left-Handed |
| CSAA | Collective Single Antenna Array |
| DSS | Direct Spread Spectrum |
| FF | Far Field |

-continued

| Acronyms | |
|---|---|
| H | Channel representation: integer function for SISO and matrix function for MIMO |
| Hpol | Horizontal Polarization |
| LHCpol | Left-Handed Circular Polarization |
| LHM | Left-handed Material |
| LOS | Line of Sight |
| NF | Near Field |
| MIMO | Multiple Input Multiple Output |
| NIR | Negative Index of Refraction |
| NLOS | Non Line of Sight |
| NR | Number of Receiver channels (integer number) |
| NT | Number of Transmit channels (integer number) |
| OFDM | Orthogonal Frequency Division Multiplexing. |
| PaDiv | Pattern Diversity |
| PoDiv | Polarization Diversity |
| RHCpol | Right-Handed Circular Polarization |
| RHM | Right Handed Material |
| Rx | Receiver |
| SA | Smart Antennas |
| SISO | Single Input Single Output |
| SM | Spatial Multiplexing |
| SNR | Signal to Noise Ratio |
| SpDiv | Spatial Diversity |
| STBC | Space Time Block Code |
| TDD | Time Division Duplexing |
| TL | Transmission Line |
| Tx | Transmitter |
| Vpol | Vertical Polarization |

While this specification contains many specifics, these should not be construed as limitations on the scope of an invention or of what may be claimed, but rather as descriptions of features specific to particular embodiments of the invention. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or a variation of a subcombination.

Only a few implementations are disclosed. However, it is understood that variations and enhancements may be made.

What is claimed is:

1. A device, comprising:

a dielectric substrate having a first surface on a first side and a second surface on a second side opposing the first side;

a plurality of conductive patches formed on the first surface and separated from one another;

a ground conductive layer formed on the second surface; and a plurality of conductive via connectors formed in the substrate to connect the conductive patches to the ground conductive layer, respectively, to form a plurality of unit cells each comprising a volume having a respective conductive patch on the first surface, and a respective via connector connecting the respective conductive path to the ground conductive layer;

wherein the device is structured to form a composite left and right handed (CRLH) metamaterial structure from the unit cells;

wherein the ground conductive layer is patterned to have a dimension underneath a respective conductive patch to be less than a dimension of the respective conductive patch; and wherein the ground conductive layer comprises a strip line that is connected to the conductive via connectors of at least a portion of the unit cells and passes through underneath the conductive patches of the portion of the unit cells, and wherein the strip line has a width less than a dimension of the conductive patch of each unit cell.

2. The device as in claim 1, comprising:

a wireless access point or router coupled to the CRLH metamaterial structure through which a wireless signal is transmitted or received.

3. The device as in claim 1, wherein:

each unit cell has a dimension not greater than one tenth of a wavelength of a signal in resonance with the CLRH metamaterial structure.

4. The device as in claim 3, wherein:

each unit cell has a dimension not greater than one fortieth of a wavelength of a signal in resonance with the CRLH metamaterial structure.

5. The device as in claim 1, further comprising:

an RF circuit coupled to the CRLH metamaterial structure and structured to be in a second CRLH metamaterial structure.

6. The device as in claim 1, wherein:

the ground conductive layer comprises:

a common ground conductive area;

a plurality of strip lines that are connected to the common ground conductive area at first distal ends of the strip lines and having second distal ends of the strip lines connected to conductive via connectors of at least a portion of the unit cells underneath the conductive patches of the portion of the unit cells; and wherein the strip line has a width less than a dimension of the conductive patch of each unit cell.

* * * * *